US009493963B2

(12) United States Patent
Maginot et al.

(10) Patent No.: US 9,493,963 B2
(45) Date of Patent: Nov. 15, 2016

(54) PORTABLE BARRIER AND ASSOCIATED METHOD OF USE

(71) Applicant: Shadiant, LLC., Indianapolis, IN (US)

(72) Inventors: Paul J. Maginot, Fishers, IN (US); Gary A. Vandenbark, Greenfield, IN (US)

(73) Assignee: Shadiant, LLC, Indianapolis, IN (US)

( * ) Notice: Subject to any disclaimer, the term of this patent is extended or adjusted under 35 U.S.C. 154(b) by 0 days.

(21) Appl. No.: 14/487,884

(22) Filed: Sep. 16, 2014

(65) Prior Publication Data

US 2015/0075577 A1 Mar. 19, 2015

Related U.S. Application Data

(60) Provisional application No. 61/879,041, filed on Sep. 17, 2013.

(51) Int. Cl.
*E04H 15/44* (2006.01)
*E04H 15/58* (2006.01)
(Continued)

(52) U.S. Cl.
CPC ..... *E04H 15/44* (2013.01); *E04H 15/48* (2013.01); *E04H 15/58* (2013.01); *E04H 15/54* (2013.01); *E04H 15/56* (2013.01)

(58) Field of Classification Search
CPC ..... E04H 15/48; E04H 15/44; E04H 15/001; E04H 15/58; E04H 15/003; A01M 31/025; Y10S 135/901; A47C 7/66
USPC ..... 135/132–133, 147, 151, 152, 117, 901; 403/217–219; 297/184.11, 184.15
See application file for complete search history.

(56) References Cited

U.S. PATENT DOCUMENTS 1,913,572 A 6/1933 Thonet-Drechsel
2,166,625 A 7/1939 Deak
(Continued)

FOREIGN PATENT DOCUMENTS

GB 2259927 3/1993

OTHER PUBLICATIONS

International Search Report and Written Opinion corresponding to PCT Application No. PCT/US2014/056058, mailed Dec. 15, 2014 (13 pages).

*Primary Examiner* — Winnie Yip

(57) ABSTRACT

A portable barrier includes a junction assembly. The portable barrier further includes a pedestal assembly including (i) a plurality of legs that are movable with respect to each other, the plurality of legs includes a first leg and a second leg, and (ii) a first limiter connected to the first leg and the second leg. In addition, the portable barrier includes a cover assembly including (i) a plurality of arms that are movable with respect to each other, the plurality of arms includes a first arm and a second arm, and (ii) a covering connected to the first arm and the second arm. Further, the portable barrier includes a second limiter extending between the first arm and the first leg. The portable barrier also includes a supplemental component movable with respect to the second arm. Additionally, the portable barrier includes a third limiter extending between the second arm and the supplemental component. The first leg includes (i) a first strut portion extending from the junction assembly, and (ii) a first extension portion pivotably coupled to the first strut portion, the first extension portion terminates in a first unsupported end. The second leg includes (i) a second strut portion extending from the junction assembly, and (ii) a second extension portion pivotably coupled to the second strut portion, the second extension portion terminates in a second unsupported end. The first arm includes (i) a third strut portion extending from the junction assembly, and (ii) a third extension portion pivotably coupled to the third strut portion, the third extension portion terminates in a third unsupported end. The second arm includes (i) a fourth strut portion extending from the junction assembly, and (ii) a fourth extension portion pivotably coupled to the fourth strut portion, the fourth extension portion terminates in a fourth unsupported end.

15 Claims, 92 Drawing Sheets

(51) Int. Cl.

| | |
|---|---|
| ***E04H 15/48*** | (2006.01) |
| *E04H 15/56* | (2006.01) |
| *E04H 15/54* | (2006.01) |

(56) References Cited

U.S. PATENT DOCUMENTS

| | | | |
|---|---|---|---|
| 2,910,078 | A | 10/1959 | Schunck |
| 2,969,075 | A | 1/1961 | Girten |
| 2,992,649 | A | 7/1961 | Swallow |
| 3,007,735 | A | 11/1961 | Cohn |
| 3,368,575 | A | 2/1968 | Besonen |
| 3,491,781 | A | 1/1970 | Reese |
| 3,513,861 | A | 5/1970 | Johnson |
| 3,581,751 | A | 6/1971 | Evans |
| 3,874,398 | A | 4/1975 | Hendrickson |
| 4,069,833 | A | 1/1978 | Johansson |
| 4,098,281 | A | 7/1978 | Bonfilio |
| 4,227,542 | A | 10/1980 | Bonfilio |
| 4,275,921 | A | 6/1981 | Genin |
| 4,520,835 | A | 6/1985 | Moeller |
| 5,159,947 | A | 11/1992 | Chuang et al. |
| 5,271,423 | A | 12/1993 | Eychaner |
| 5,573,027 | A | 11/1996 | Hsiung |
| 5,752,537 | A | 5/1998 | Kranzler |
| 6,123,091 | A | 9/2000 | Flynn et al. |
| 6,439,645 | B1 | 8/2002 | Pedersen |
| 6,823,883 | B1 | 11/2004 | Sears |
| 7,137,399 | B1 | 11/2006 | Ransom et al. |
| 8,079,380 | B2 | 12/2011 | Engstrom et al. |
| 8,171,948 | B2 | 5/2012 | Maginot |
| 8,176,928 | B2 | 5/2012 | Maginot |
| 8,205,628 | B2 | 6/2012 | Maginot |
| 8,464,739 | B2 | 6/2013 | Maginot |
| 8,651,125 | B2 | 2/2014 | Maginot |
| 2003/0046855 | A1 | 3/2003 | Bergdall |
| 2005/0056309 | A1 | 3/2005 | Bree et al. |
| 2009/0039685 | A1 | 2/2009 | Zernov |

PORTABLE BARRIER AND ASSOCIATED METHOD OF USE

This application claims the benefit of priority of U.S. provisional application Ser. No. 61/879,041, filed on Sep. 17, 2013, the disclosure of which is herein incorporated by reference in its entirety.

BACKGROUND

The present disclosure relates generally to devices configured to protect or shield an individual from environmental elements such as the sun, wind, and rain. More particularly, the present disclosure relates to portable barriers or screening devices that can be quickly deployed at a location where protection from the elements is desired such as a beach or a sideline of a sporting event, and then readily collapsed and transported after use.

Various existing devices for protecting or shielding an individual from environmental elements have been designed. For example, such devices are disclosed in the following U.S. Pat. Nos. 8,171,948; 8,176,928; 8,205,628; 8,464,739; and 8,651,125, the disclosures of each of the five (5) above-identified patents are hereby totally incorporated by reference herein in their entirety.

It would be desirable to construct the portable barrier so that it occupies a relatively small space when it is positioned in its stowed position. It would be further desirable to construct the portable barrier so that it assumes a convenient shape for carrying when it is positioned in its stowed position. In addition, it would be desirable to construct the portable barrier so that it is relatively less by wind when the portable barrier is positioned in its deployed or use position. It is also desirable to construct the portable barrier so that it is durable and can be manufactured in a relatively low cost manner.

DESCRIPTION OF THE PREFERRED EMBODIMENTS

Figure 1:
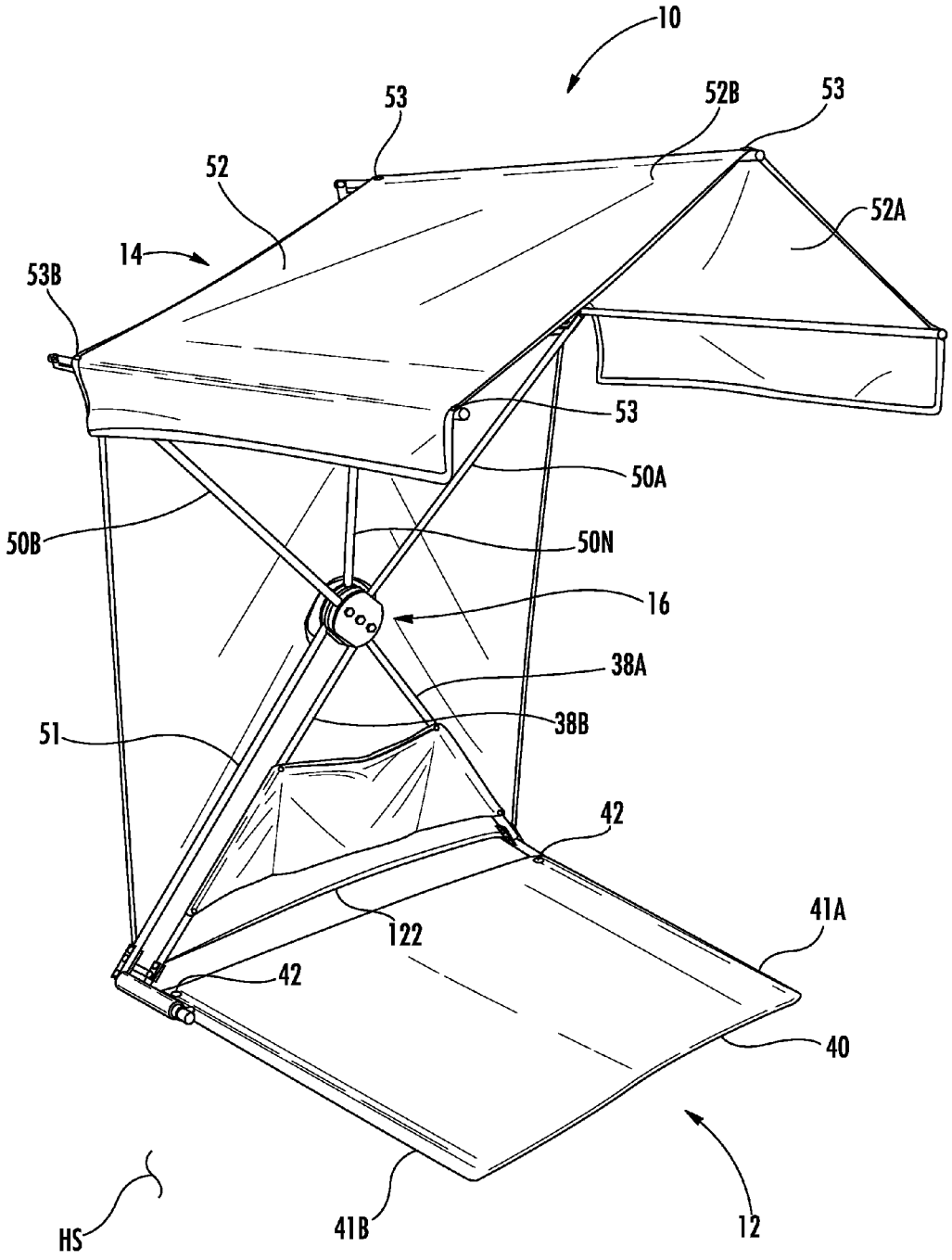
FIGS. 1-10 show various views of a portable barrier of the present disclosure, with the portable barrier shown in its protection mode of operation.

While the portable barrier and its method of use described herein is susceptible to various modifications and alternative forms, specific embodiments thereof have been shown by way of example in the drawings and will herein be described in detail. It should be understood, however, that there is no intent to limit the portable barrier and its method of use to the particular forms disclosed, but on the contrary, the intention is to cover all modifications, equivalents, and alternatives falling within the spirit of the inventions described herein.

Figure 4:
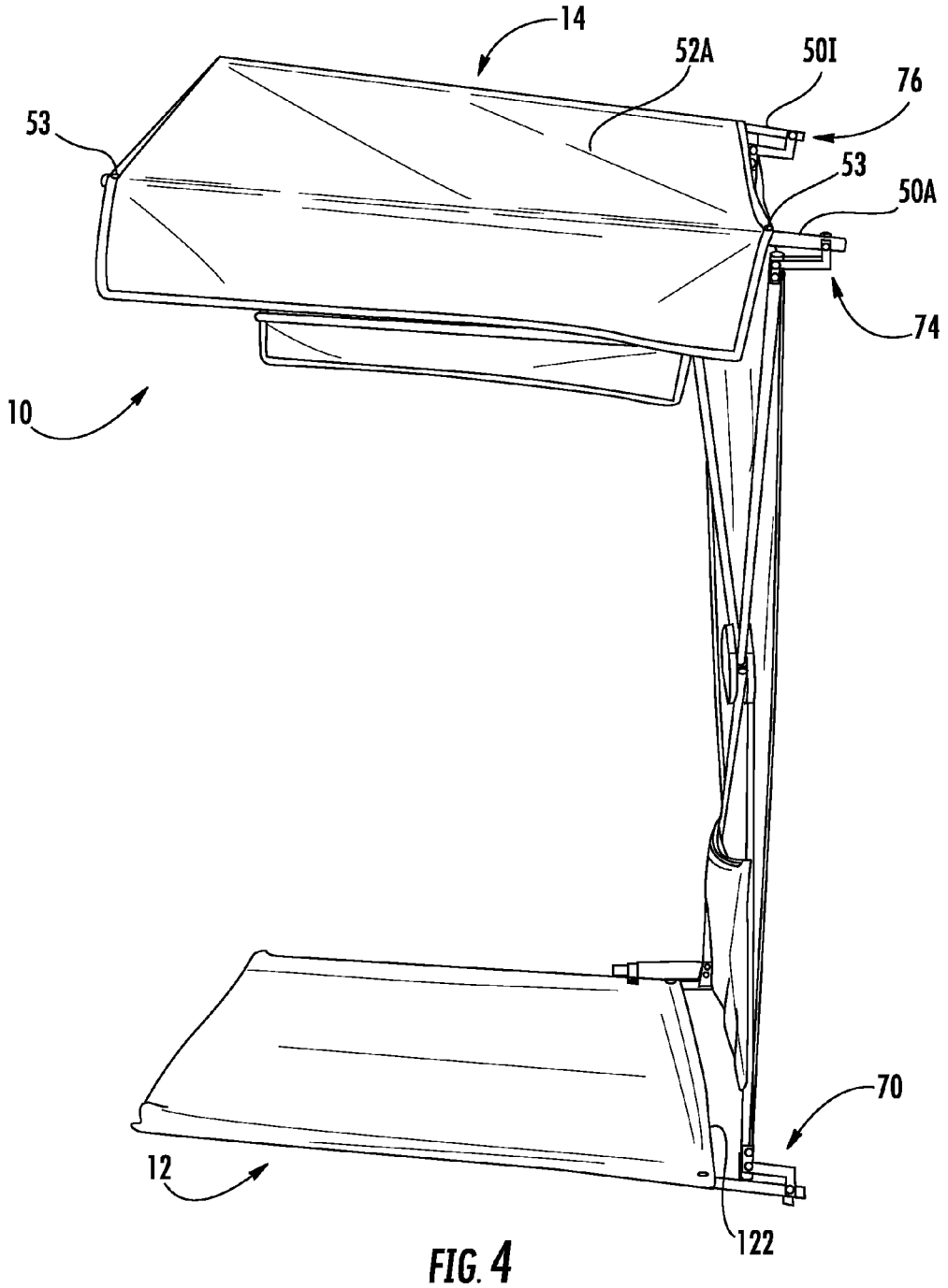
Figure 5:
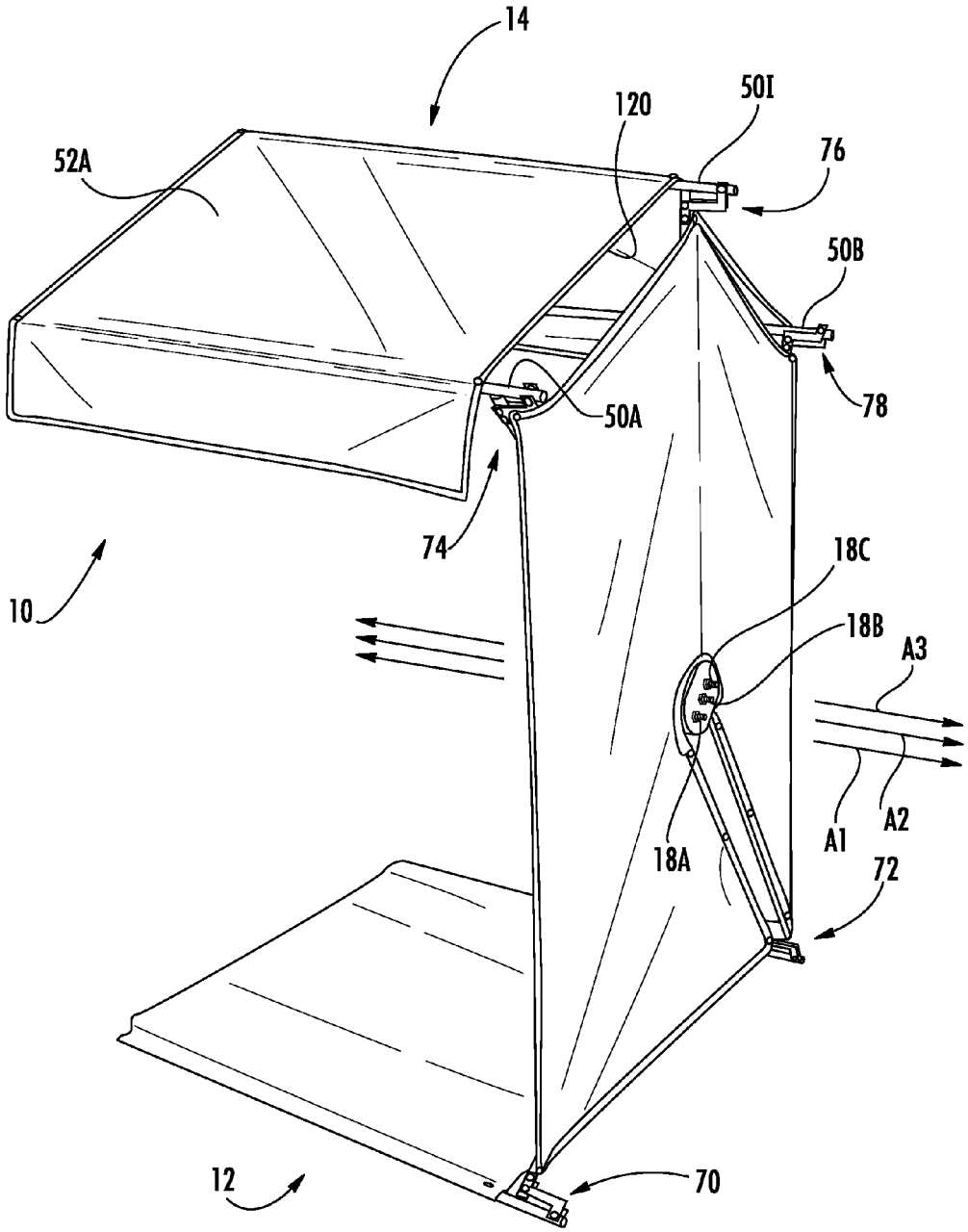
Figure 81:
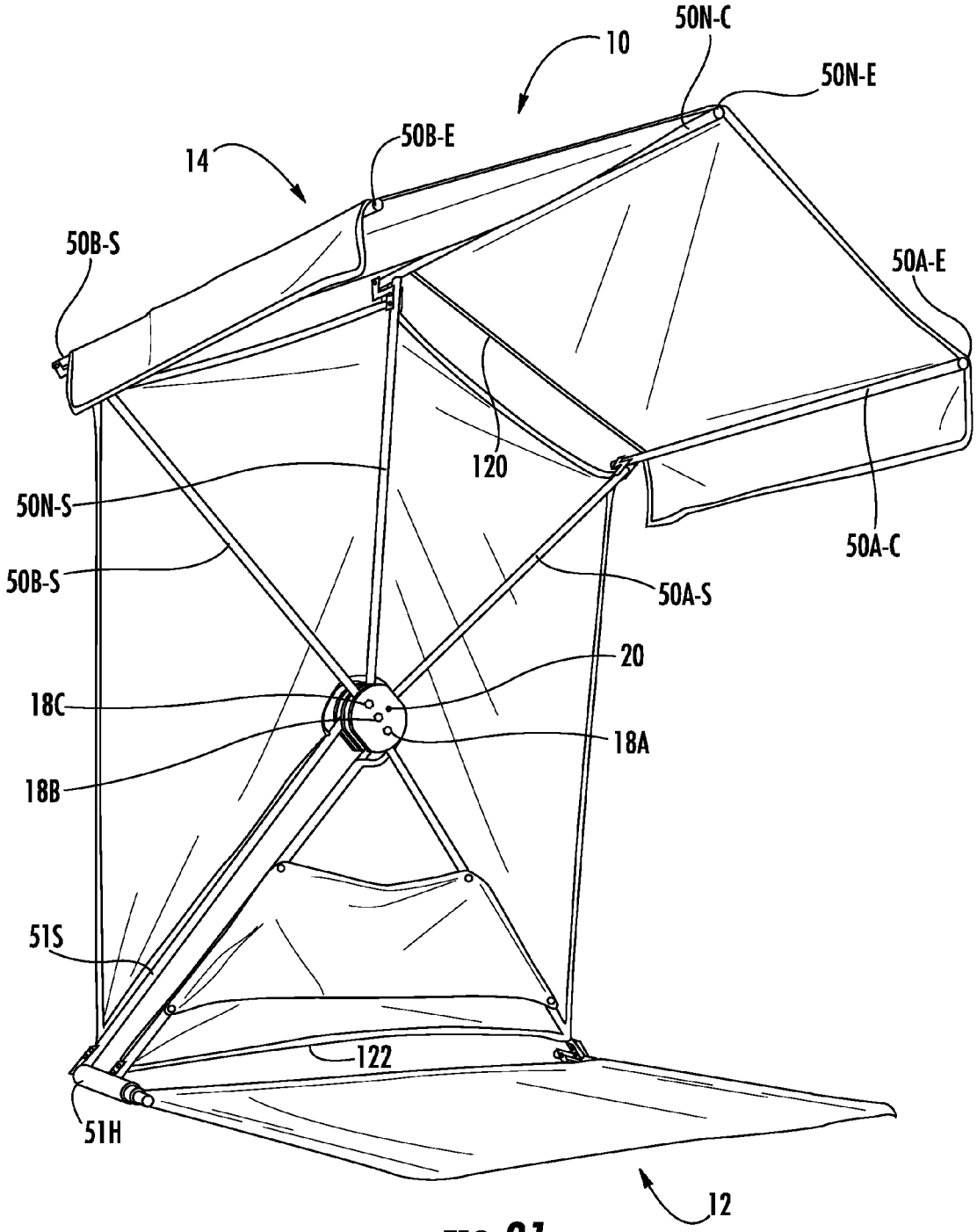
FIGS. 81-87 are various perspective views of the portable barrier of FIG. 1, with the portable barrier positioned in its protection mode of operation.
Figure 90:
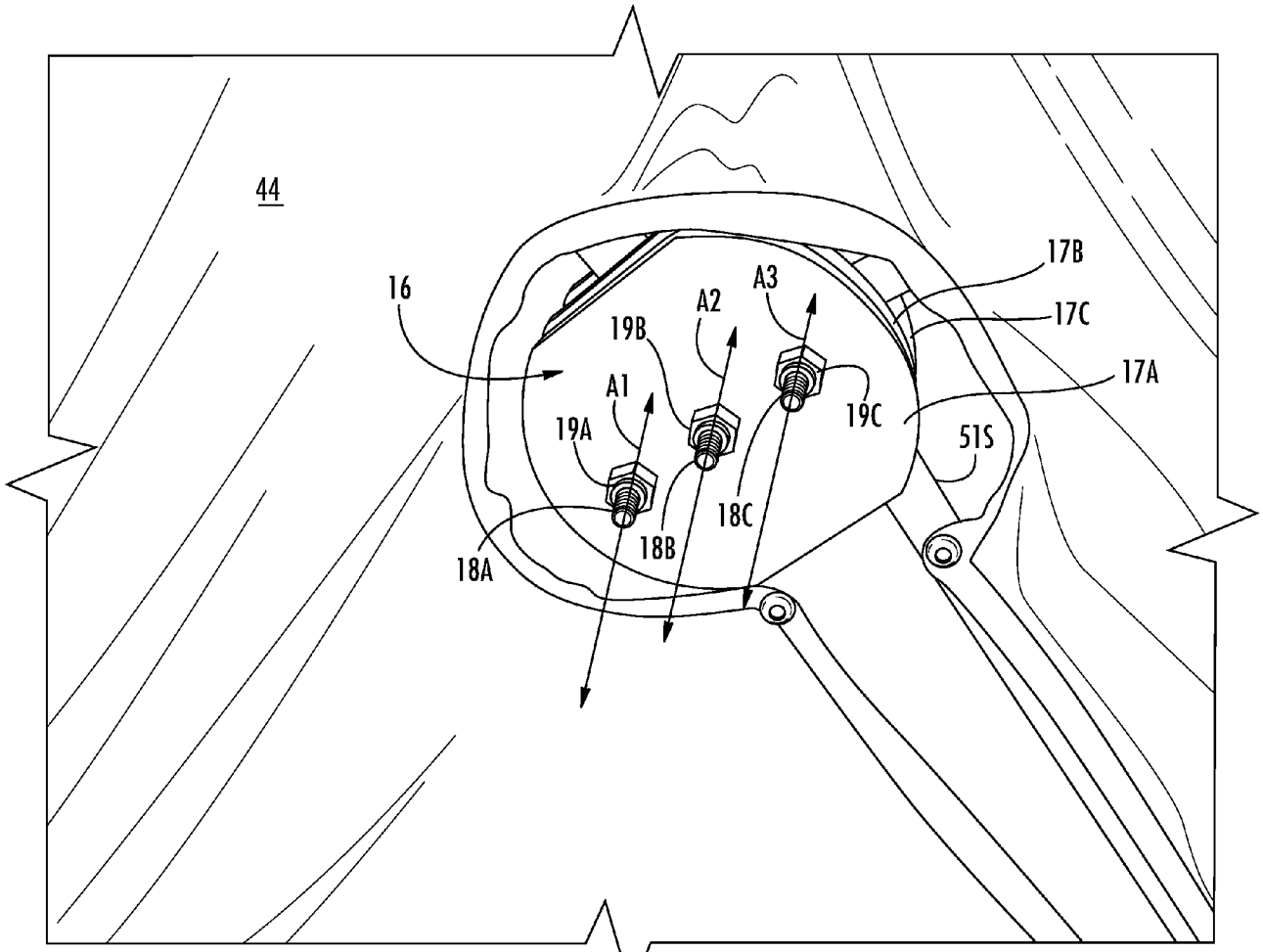
FIG. 90 is a rear perspective view of the junction assembly of the portable barrier of FIG. 1, with the portable barrier positioned in its protection mode of operation.

Referring now to FIGS. 1-12, there is shown a portable barrier 10 that incorporates the features of the present disclosure. The portable barrier 10 includes a pedestal assembly 12 and a cover assembly 14. The portable barrier 10 further includes a junction assembly 16 interposed between the pedestal assembly 12 and the cover assembly 14. The junction assembly includes a plurality of plates 17A, 17B, 17C that are oriented parallel fashion with respect to each other. The plates 17A, 17B, 17C are made of an aluminum material. The plates 17A, 17B, 17C may alternatively be made from steel. In another alternative embodiment shown in FIGS. 30-45, the plates 17A, 17B, 17C are made of a plastic material such as a high density polyethylene material, such as a UHMW polyethylene material. Each of the plates 17A, 17B, 17C possesses a generally circular configuration with a 4.5" diameter as shown in FIGS. 1-12 (and FIGS. 30-45). The junction assembly 16 further includes a plurality of bolts 18A, 18B, 18C that extend through the plurality of plates (see, e.g., FIGS. 1, 5 and 90). The bolt 18A defines an axis A1, and the bolt 18B defines an axis A2, and the bolt 18C defines an axis A3 as shown in FIGS. 5 and 90. The lines defined by the axis A1, A2, and axis A3 are parallel with respect to each other. The junction assembly 16 further includes a plurality of nuts 19A, 19B, 19C that are respectively threadingly engaged to the plurality of bolts as shown in FIG. 90. The junction assembly 16 also includes a set screw 20 that extends through the plate 17A so as to threadingly engage one of the arms of the pedestal assembly 12 as shown in FIG. 81. The operation of the junction assembly 16 will be discussed in further detail below.

Figure 11:
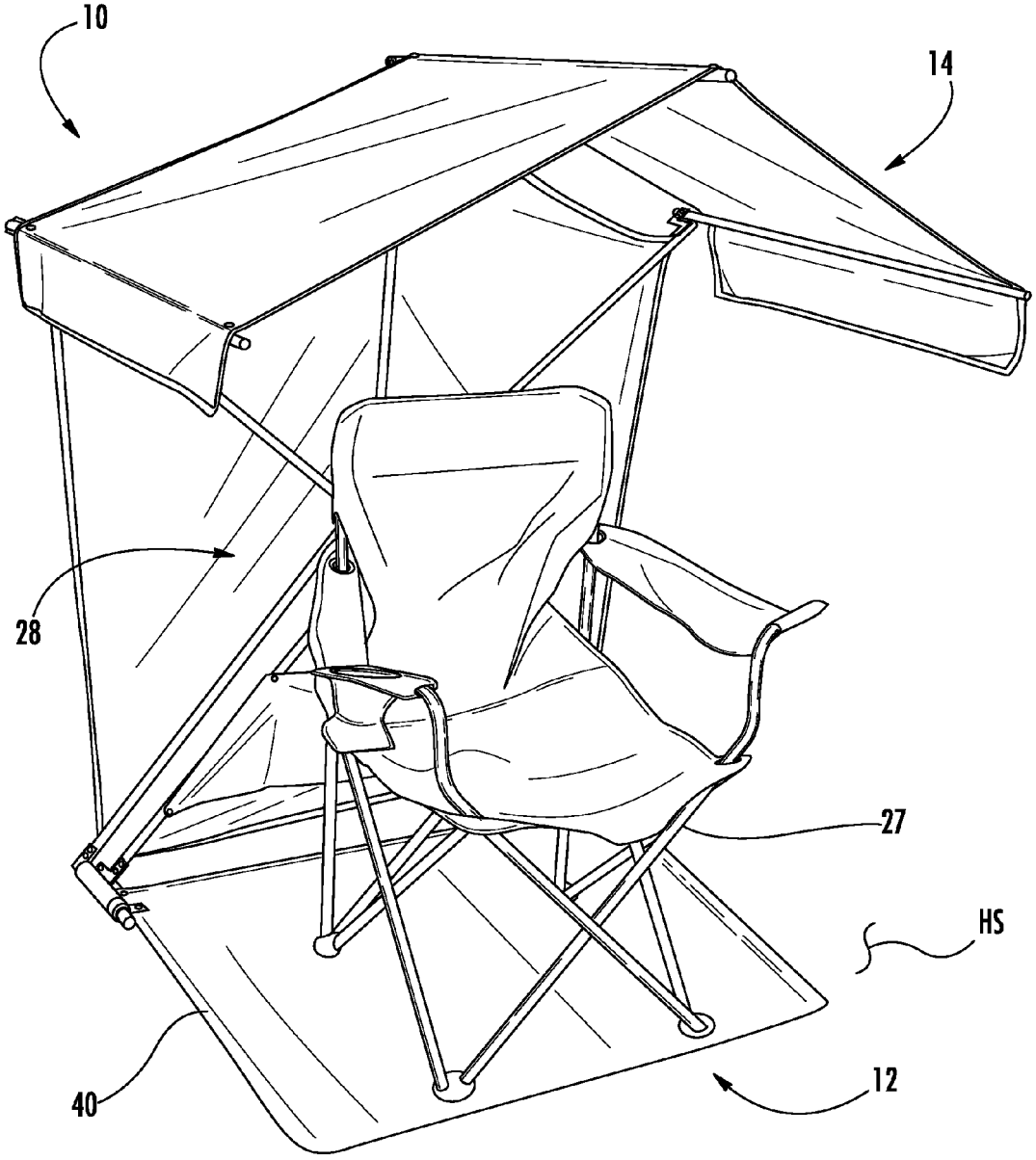
FIG. 11 shows a left side elevational view of the portable barrier of FIG. 1, with a chair located within the occupant space and supported on the flooring of the portable barrier.
Figure 12:
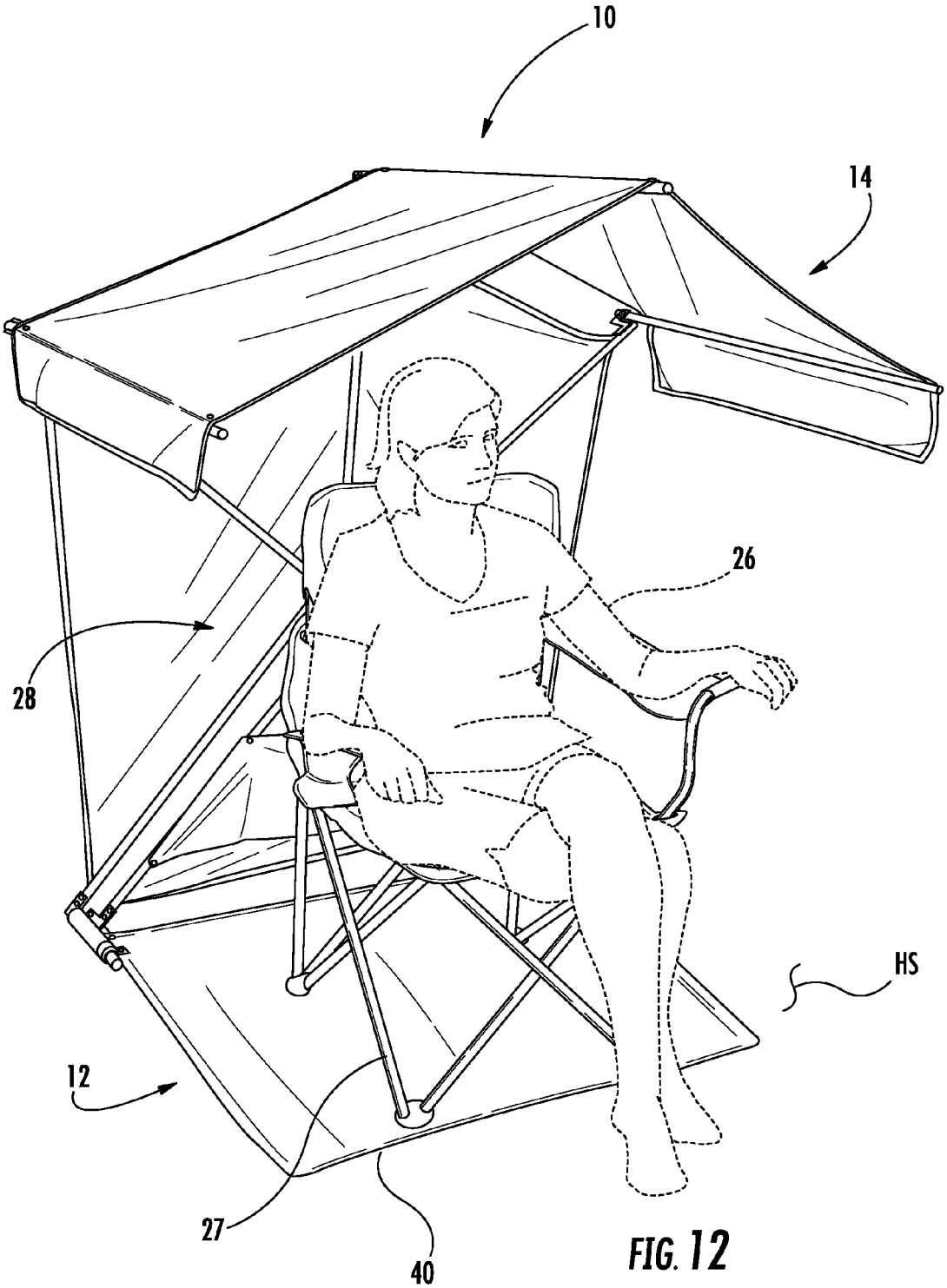
FIG. 12 is a view similar to FIG. 11, but showing an occupant located in the occupant space and sitting in the chair.
Figure 13:
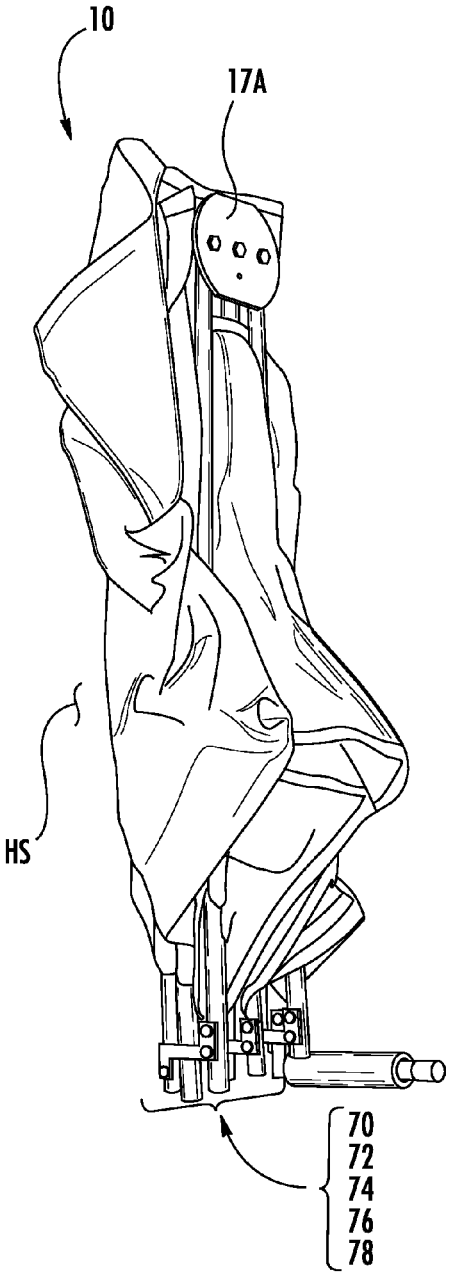
FIG. 13 is a perspective view of the portable barrier of FIG. 1, with the portable barrier shown in its storage mode of operation, and further with the portable barrier shown lying on a horizontal surface.
Figure 15:
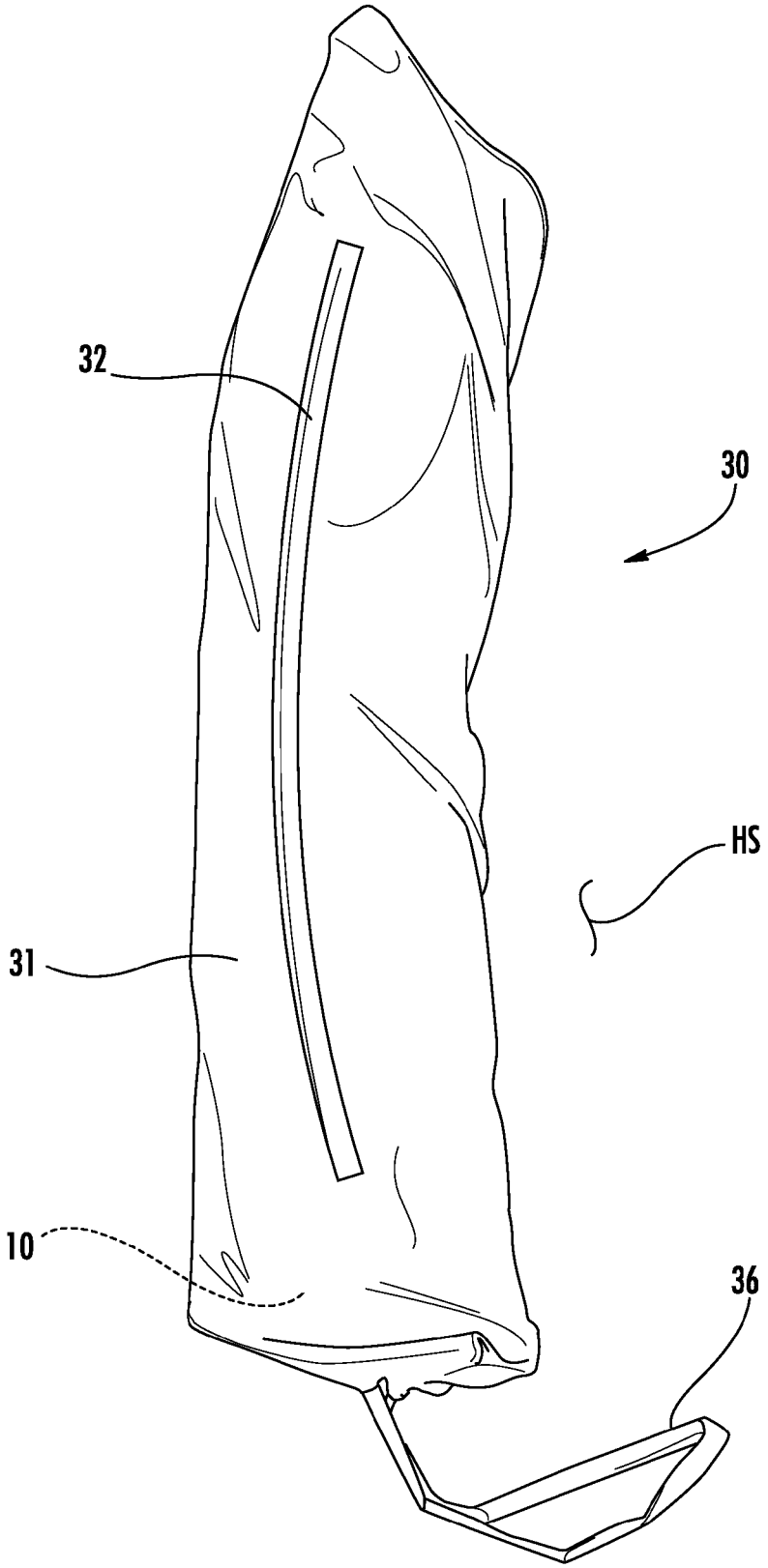
FIG. 15 is a perspective view of a carrier bag shown lying on a horizontal surface, with the portable barrier positioned therein.
Figure 16:
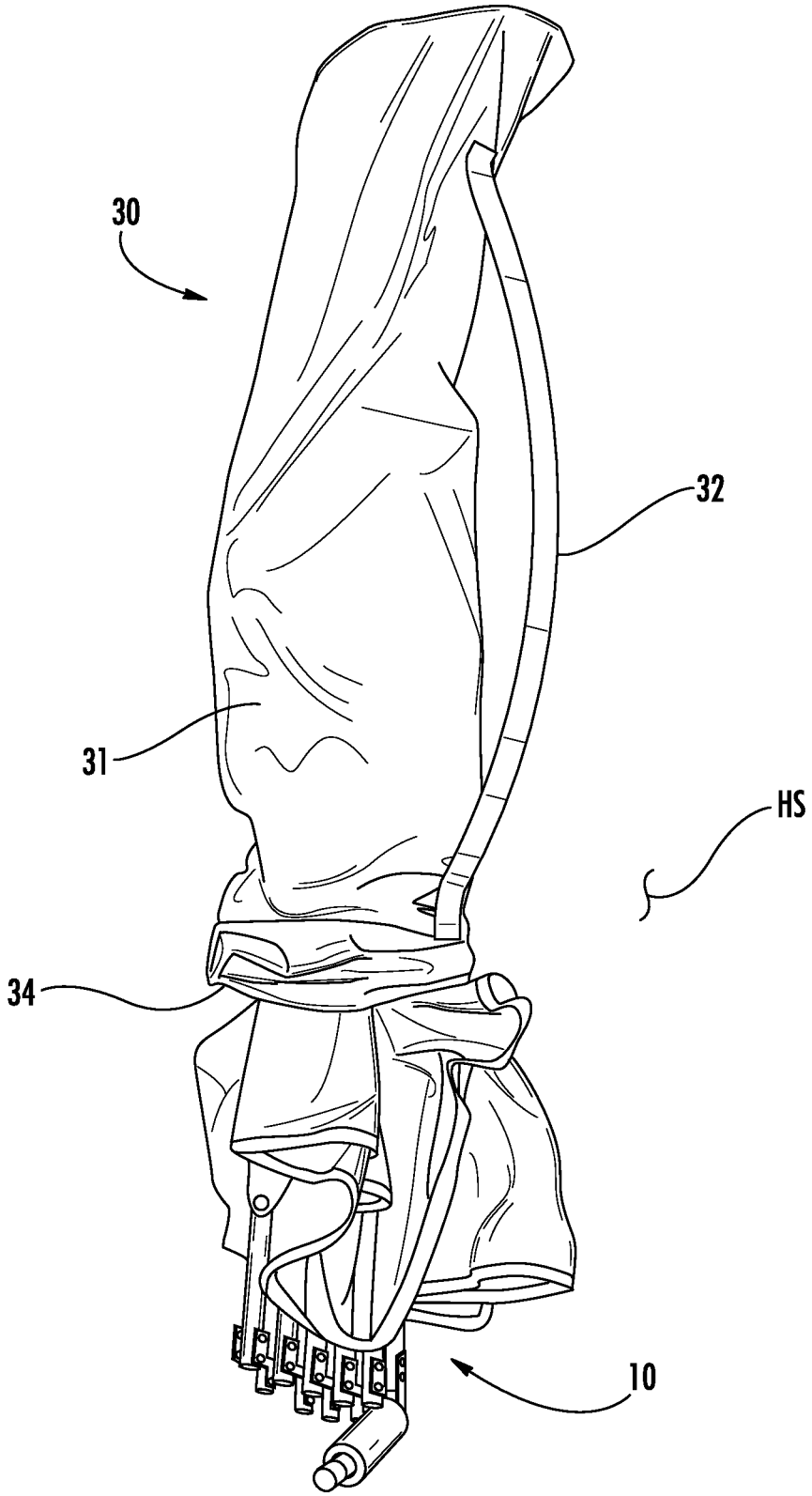
FIG. 16 is a perspective view of the portable barrier of FIG. 1 and the carrier bag of FIG. 14, with the portable barrier shown in its storage mode of operation, and further with the portable barrier shown partially located within the carrier bag.

The portable barrier 10 is configured to be moved between a protection mode of operation as shown in FIGS. 1-12 and a storage mode of operation as shown in FIGS. 13, 15, and 16. When in the protection mode, the portable barrier 10 is configured to assume an expanded configuration which provides protection of an occupant 26 located in a cavity or occupant space 28 defined by the portable barrier as shown in FIGS. 11-12. For example, the portable barrier 10 protects the occupant 26 from exposure to sun, wind, and/or rain while positioned in the occupant space 28 such as while the occupant is sitting in a chair 27 that is located in the occupant space and the chair is supported on a flooring of the portable barrier. (See FIGS. 11-12.). Since the portable barrier 10 does not possess any side screens, the occupant 26 is allowed uninhibited laterally viewing out of the portable barrier. When in the storage mode, the portable barrier 10 is configured in a collapsed configuration which facilitates convenient transportation and storage of the portable barrier.

Figure 14:
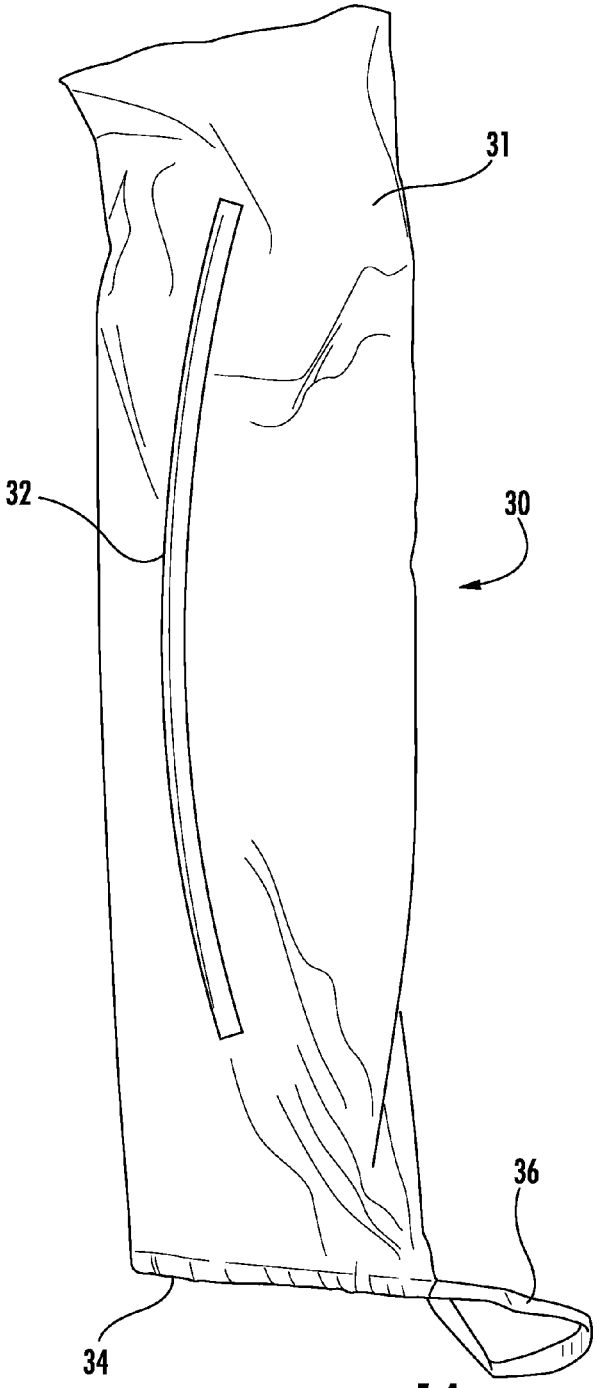
FIG. 14 is a perspective view of a carrier bag shown lying on a horizontal surface, with the portable barrier removed therefrom.

When in the storage mode, the portable barrier 10 is configured to be stowed in a flexible carrier bag 30 as shown in FIGS. 14-16 so as to facilitate convenient transportation and subsequent long term storage of the portable barrier. The carrier bag 30 includes a sleeve portion 31 having an open end and a closed end. The carrier bag 30 also includes a flexible handle 32 such as a strap connected to a side of the sleeve portion 31. The sleeve portion 31 defines a cavity 34 in which the portable barrier 10 is located during transportation and storage of the portable barrier 10 as shown in FIG. 15. The carrier bag 30 further includes a draw string 36 which is slidably attached to the sleeve portion 31 and configured to be pulled so as to cinch the sleeve portion closed thereby trapping the portable barrier 10 within the carrier bag 30 (as shown in FIG. 15) for ready transportation and ultimate storage at a storage location such as an occupant's garage or basement.

Pedestal Assembly

The pedestal assembly 12 includes a plurality of legs that are movable with respect to each other. The pedestal assembly 12 is configured to be moved from an expanded configuration as shown in FIGS. 1-12 to a collapsed configuration as shown in FIGS. 13, 15, and 16. The plurality of legs includes a leg 38A and a leg 38B (see, e.g., FIG. 1). While the pedestal assembly 12 includes only two legs in the embodiment(s) shown in the figures of the present disclosure, it should be appreciated that alternative embodiments of the pedestal assembly 12 may include more than two legs such as three or four legs.

The pedestal assembly 12 further includes a limiter or flooring 40 that is connected to the leg 38A and the leg 38B. In particular, a plurality of fasteners 42, such as screws or rivets, is secured to the legs 38A, 38B so as to connect the flooring 40 to the legs. The flooring 40 defines a pocket structure 41A in which the leg 38A extends, another pocket structure 41B in which the leg 38B extends. After the legs 38A, 38B are located in the pocket structures 41A, 41B during assembly, a fastener 42 is secured to each leg 38A, 38B so as to trap the flooring 40 between the fastener and the respective leg thereby securing the flooring 40 to the legs 38A, 38B. The legs 38A, 38B are made from aluminum. Alternatively, the legs 38A, 38B may be made from steel. The legs 38A, 38B may be made from the same materials used to make posts of commercially available portable chairs comprised of flexible material and pivoting posts.

Figure 41:
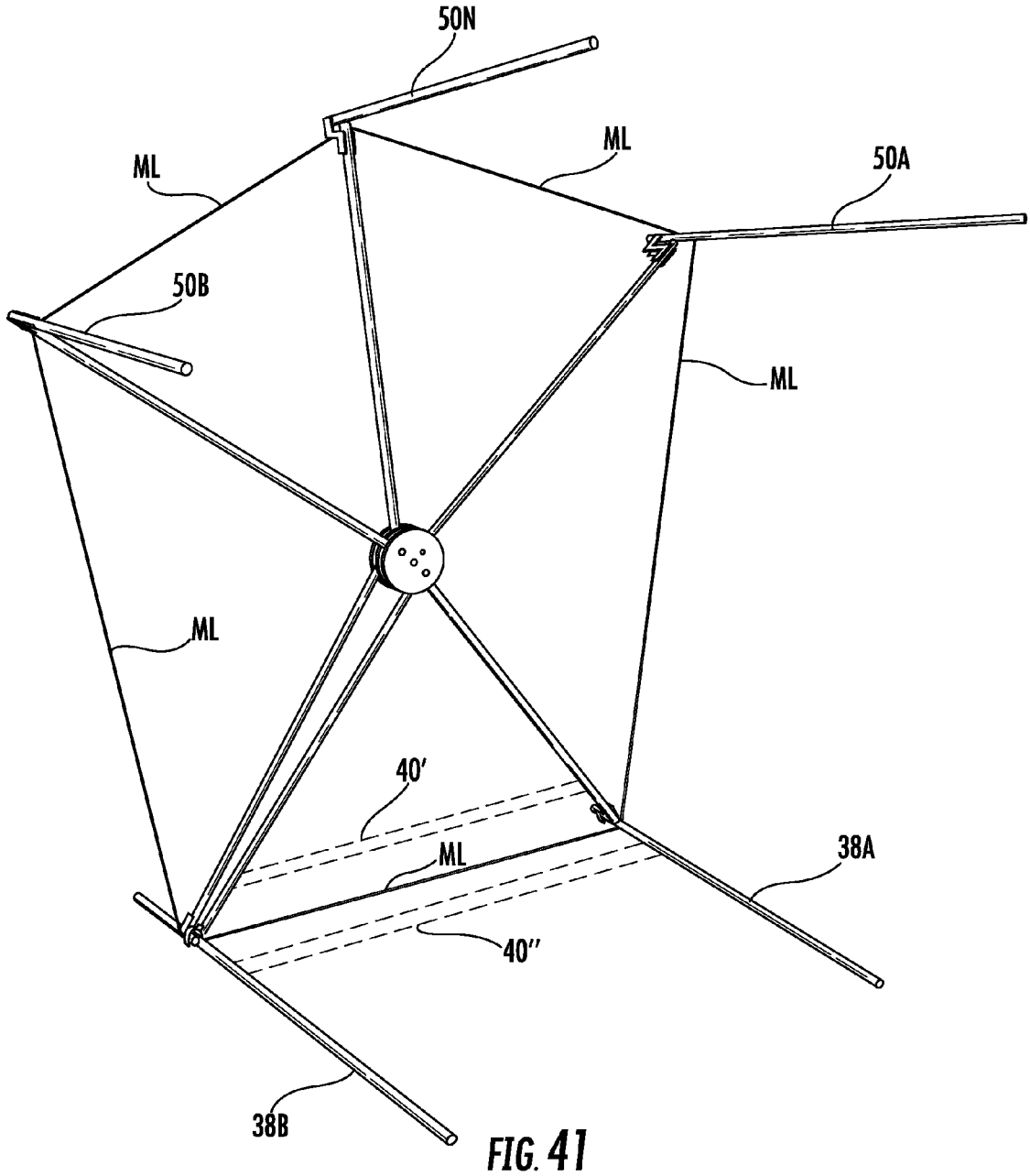
FIGS. 41-45 are perspective views of the framework of FIGS. 30-37.

The flooring 40 is made of a fabric material such as a polyethylene fabric or polyester fabric. As one example, the flooring 40 is made from a 1000 Denier 130 g/m$^2$ polyethylene sheeting treated for water resistance and flame resistance. The flooring 40 may be made from the same material that is used to make the flooring of commercially available tents. Alternatively, the flooring 40 may be made from the same materials used to make the seat portion of commercially available portable chairs comprised of flexible material and pivoting posts. In an alternative embodiment, as shown in FIG. 41, the limiter 40 is a flexible strap 40', 40"

Figure 88:
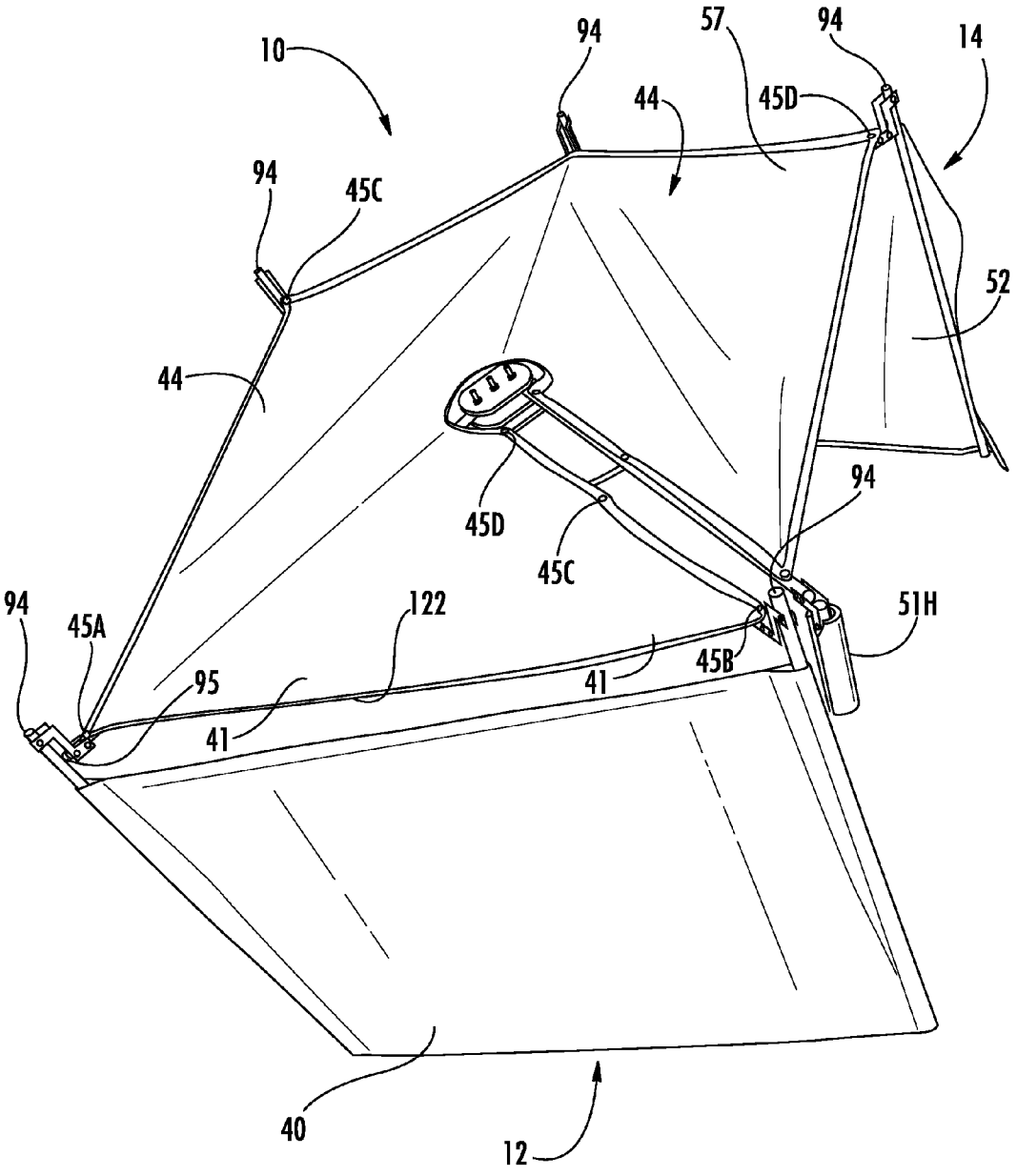
FIGS. 88-89 are perspective views of the portable barrier of FIG. 1, with the portable barrier positioned in its protection mode of operation, and with the portable barrier tipped over so as to be oriented 90 degrees from its normal protection mode of operation so as to exposed the bottom of the flooring for clarity of viewing.

(depicted in dashed lines) that is connected between the leg 38A and the leg 38B. As one alternative, the flexible strap 40' may be connected to the strut portion of leg 38A and the strut portion of leg 38B. As another alternative, the flexible strap 40" may be connected to the cantilevered portion of leg 38A and the cantilevered portion of leg 38B. As still another alternative, the limiter may be a portion 40''' of the back screen that is connected between the strut portion of leg 38A and the strut portion of leg 38B and held in place by fasteners 45A, 45B as shown in FIG. 88. In such an alternative embodiment, no flooring or strap is present.

Figure 78:
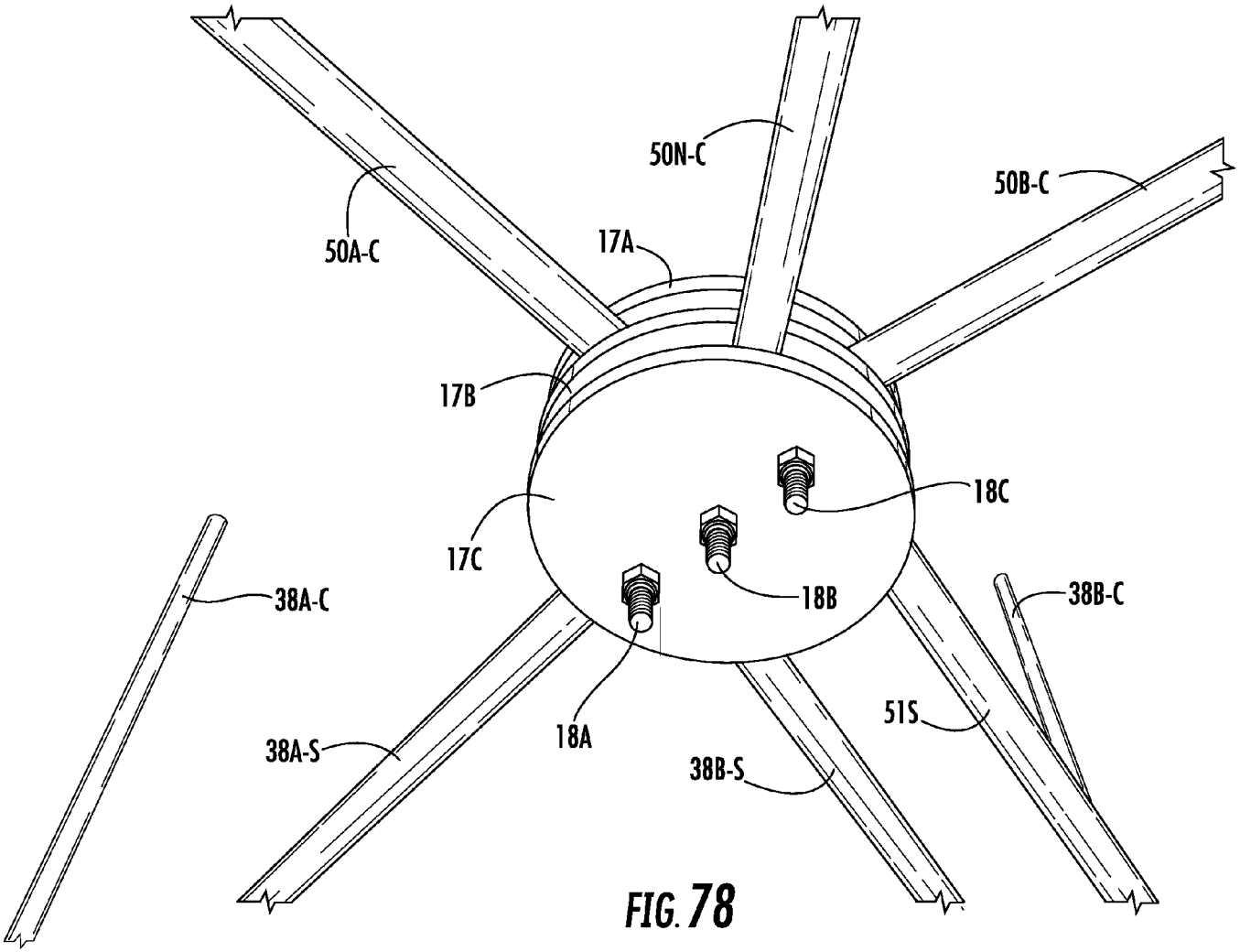
Figure 79:
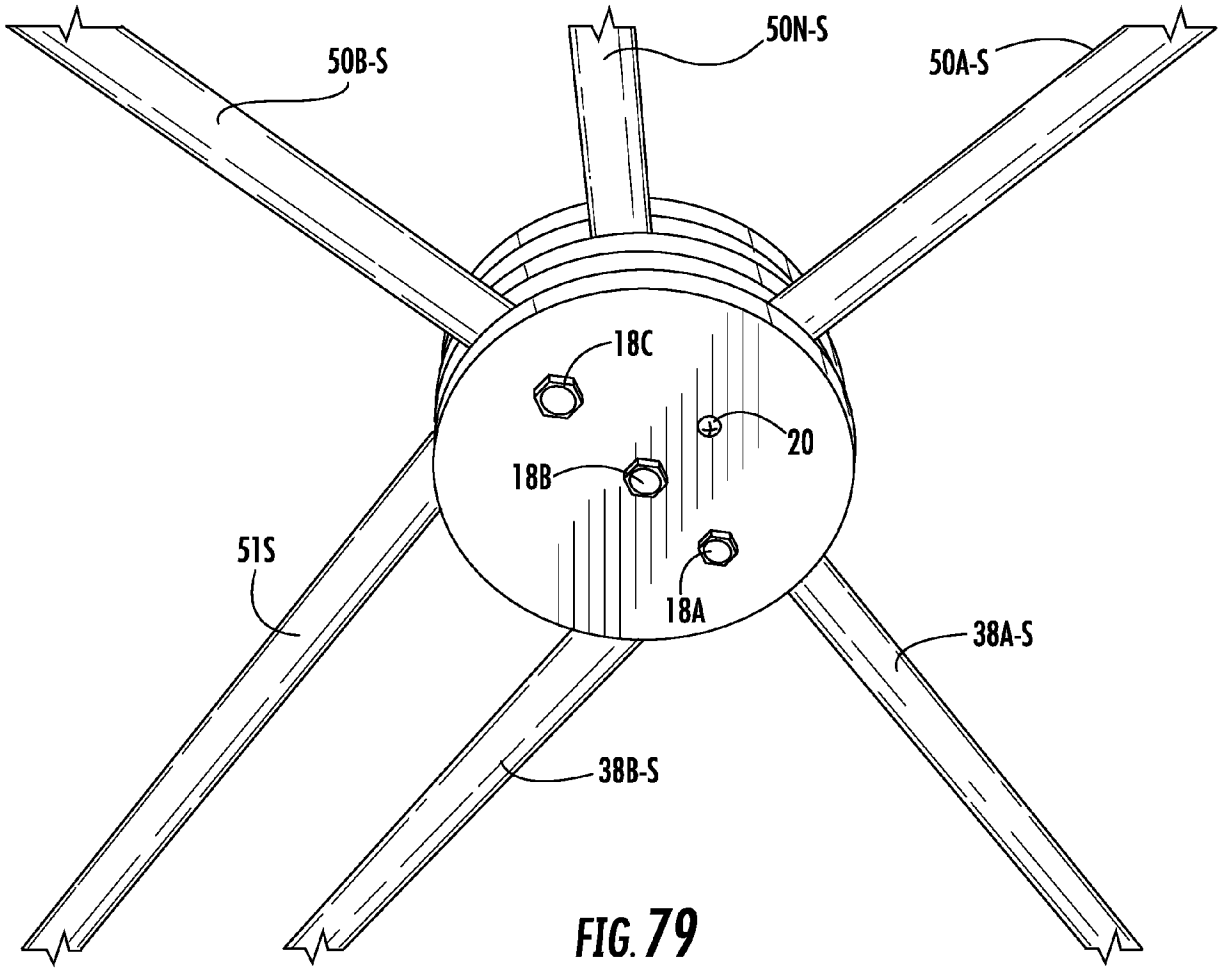
Figure 80:
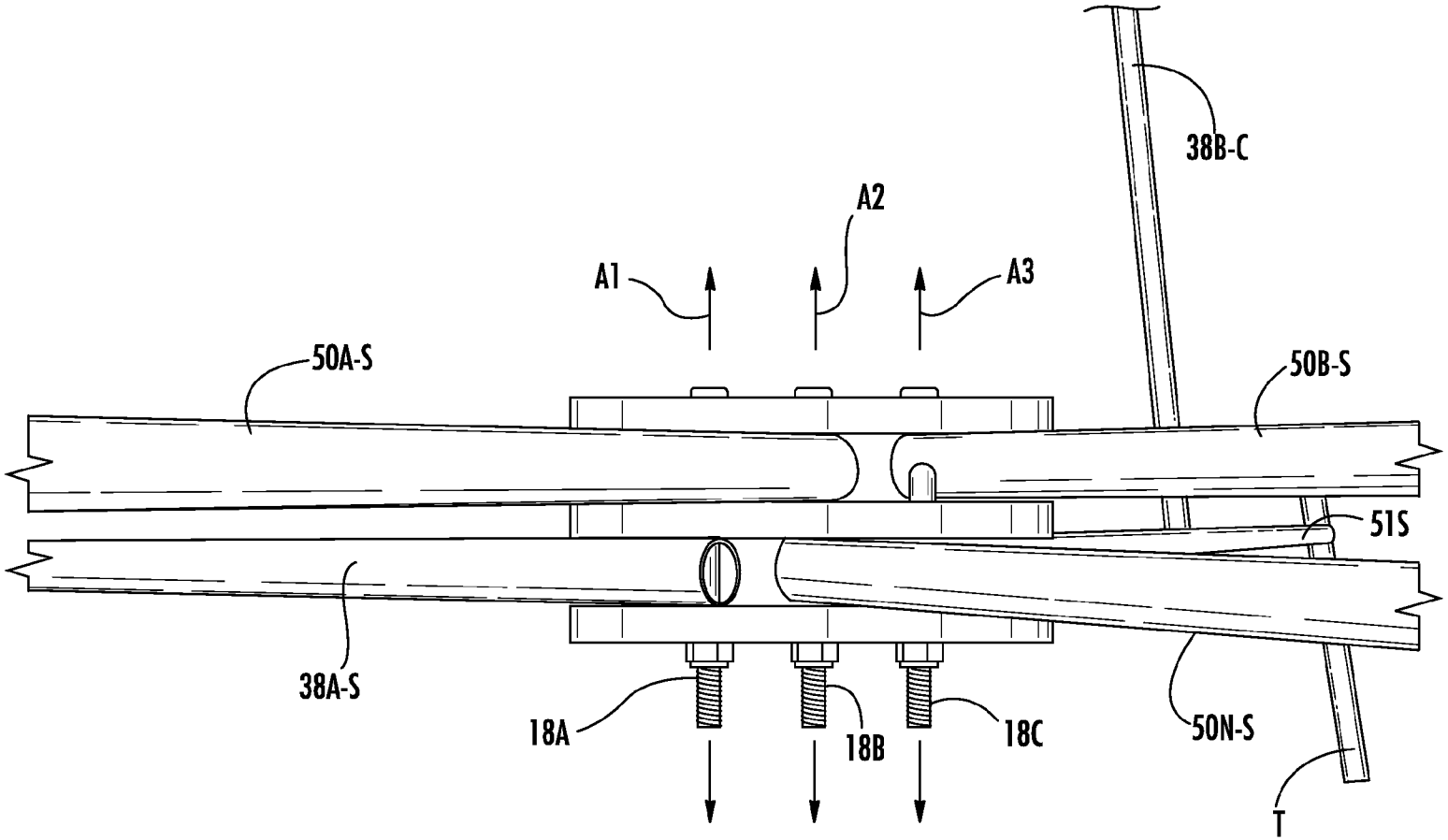

The legs 38A, 38B are each pivotably connected to the bolt 18A of the junction assembly 16 (See, e.g., FIGS. 78, 79, and 90.). During movement of the portable barrier 10 from its protection mode (see FIG. 1) to its storage mode (see FIG. 13), both legs 38A, 38B pivot about a line defined by the axis A1 (see FIGS. 5 and 80). It should be appreciated that the flooring 40 is attached to the legs 38A, 38B so that the extent of movement or distance between the leg 38A and the leg 38B is limited by the flooring. More specifically, the leg 38A is allowed to move in relation to the leg 38B from a collapsed arrangement of the pedestal assembly 12 shown in FIG. 18 to an expanded arrangement of the pedestal assembly shown in FIGS. 1-12 in which the legs 38A, 38B are separated by a maximum distance shown in FIGS. 1-12.

Figure 89:
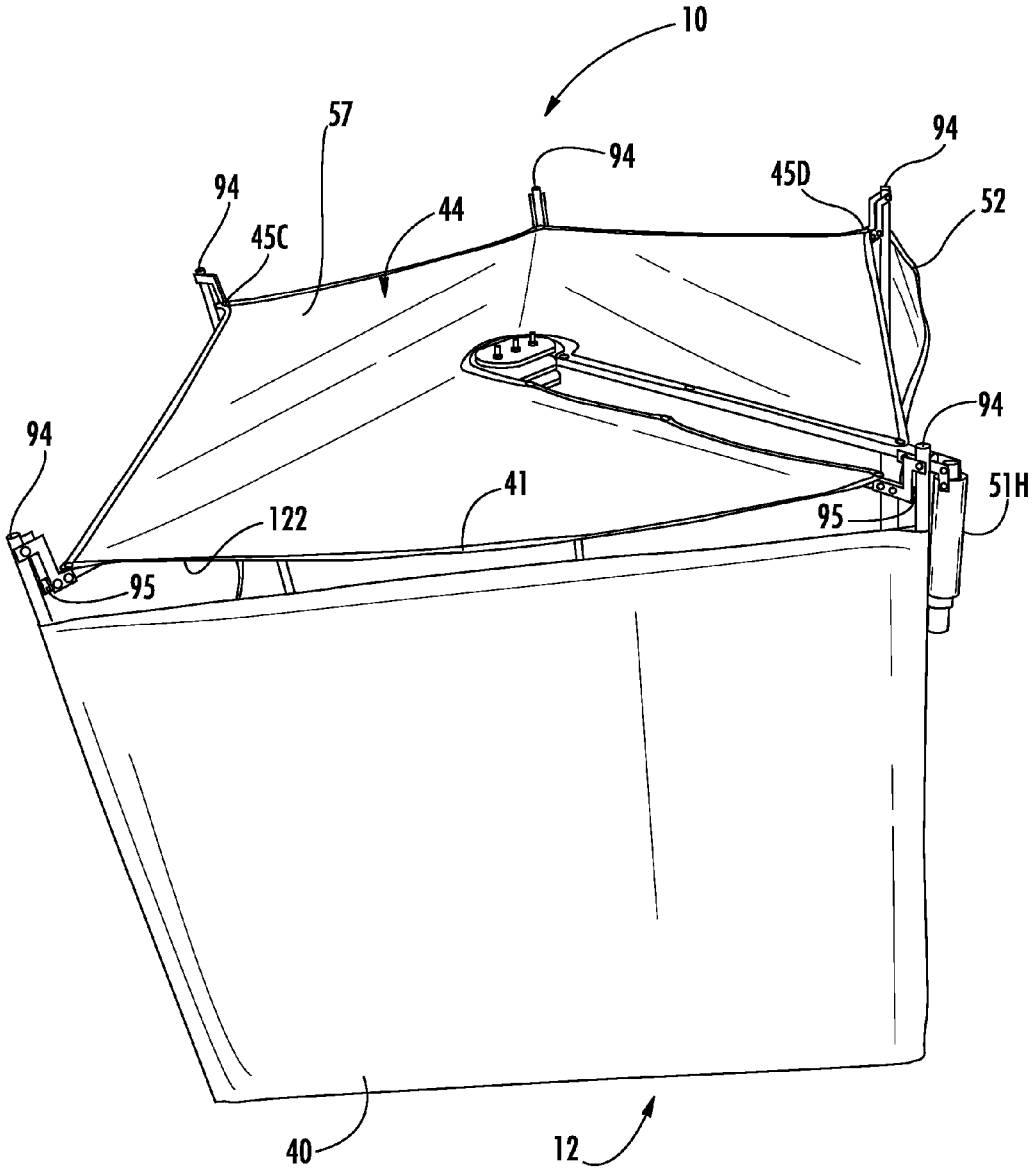

The pedestal assembly 12 further includes a back screen 44 that extends between the leg 38A and the leg 38B. The back screen 44 is attached to the legs 38A, 38B by fasteners 45 such as screws or rivets. The back screen 44 is made from a fabric material. As one example, the back screen is made from a 70 Denier Nylon Ripstop with Urethane Coat material that is treated for water resistance and flame resistance. It should be appreciated that the back screen 44 also is attached to the legs 38A, 38B so that the extent of movement or distance between the leg 38A and the leg 38B is limited by a portion 41 of the back screen 44 that extends between the fastener 45A and the fastener 45B. (See FIGS. 6, 88, and 89.)

The leg 38A includes (i) a strut portion 38A-S extending from the junction assembly 16, and (ii) a cantilevered or extension portion 38A-C pivotably coupled to the strut portion 38A-S. The cantilevered portion 38A-C terminates in an unsupported end 38A-E. Similarly, the leg 38B includes (i) a strut portion 38B-S extending from the junction assembly 16, and (ii) a cantilevered or extension portion 38B-C pivotably coupled to the strut portion 38B-S. The cantilevered portion 38B-C terminates in an unsupported end 38B-E.

As shown in FIG. 5, the leg 38A further includes a hinge joint 70. The cantilevered portion 38A-C is configured to pivot with respect to the strut portion 38A-S via the hinge joint 70. Similarly, the leg 38B further includes a hinge joint 72, and the cantilevered portion 38B-C is configured to pivot with respect to the strut portion 38B-S via the hinge joint 72.

Cover Assembly

The cover assembly 14 includes a plurality of arms 50A, 50B, 50N that are movable with respect to each other. The cover assembly 14 is configured to be moved from an expanded configuration as shown in FIGS. 1-12 to a collapsed configuration as shown in FIGS. 13, 15, and 16. As shown in FIG. 1-12, the cover assembly 14 is supported above the pedestal assembly 12 when both (i) the portable barrier 10 is positioned in the protection mode, and (ii) the pedestal assembly 10 is supported on a generally horizontal surface HS (see, e.g., FIG. 1) such as the ground adjacent to a sports field or a sandy surface at a beach.

The plurality of arms includes an arm 50A, an arm 50B, and an intermediate arm 50N interposed therebetween. Note that the portable barrier 10 also includes a supplemental arm or component 51 which is not part of the cover assembly 14, and will be discussed in more detail hereinafter. As shown in FIG. 1, the supplemental component 51 is positioned adjacent to the leg 38B when the portable barrier 10 is positioned in the protection mode. While the cover assembly 14 utilizes three arms in the embodiment(s) shown in the figures of the present disclosure, it should be appreciated that alternative embodiments of the cover assembly 14 may include more or less than three arms such as two, four, or five arms.

Figure 48:
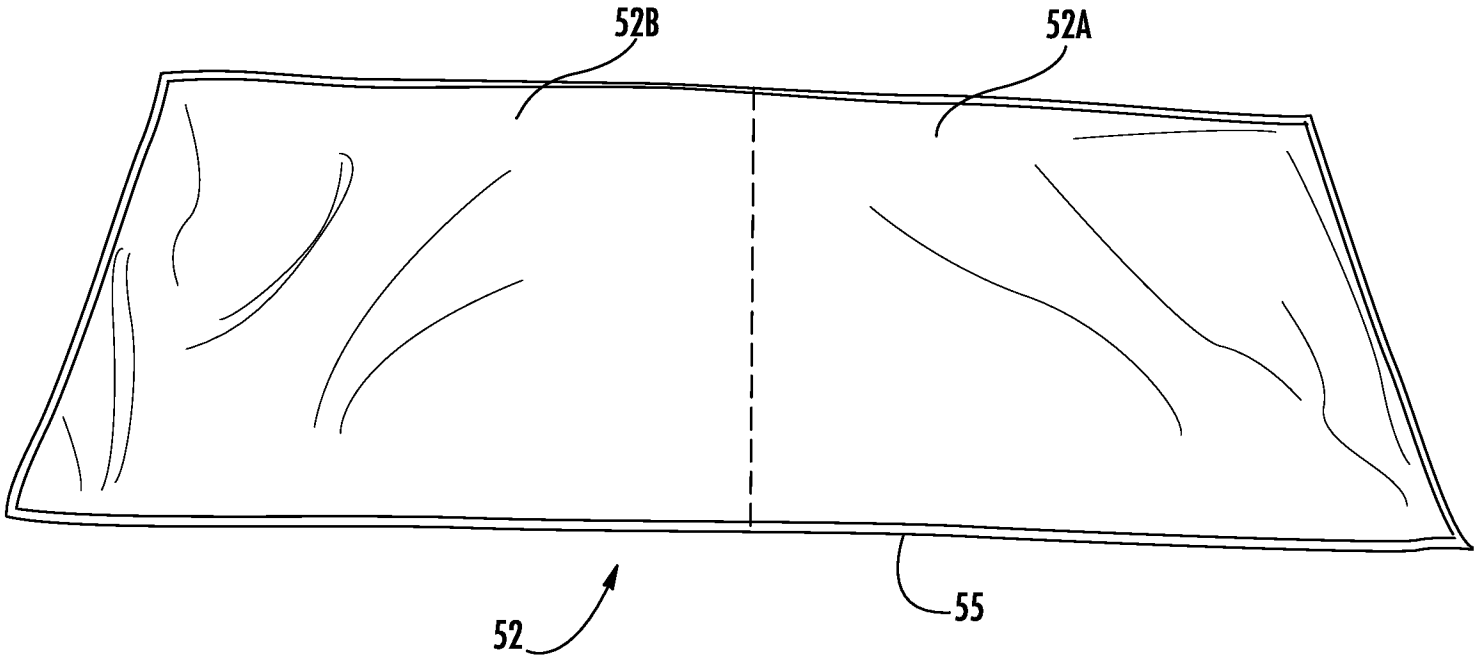
FIG. 48 is a perspective view of the covering of the portable barrier of FIG. 1.
Figure 86:
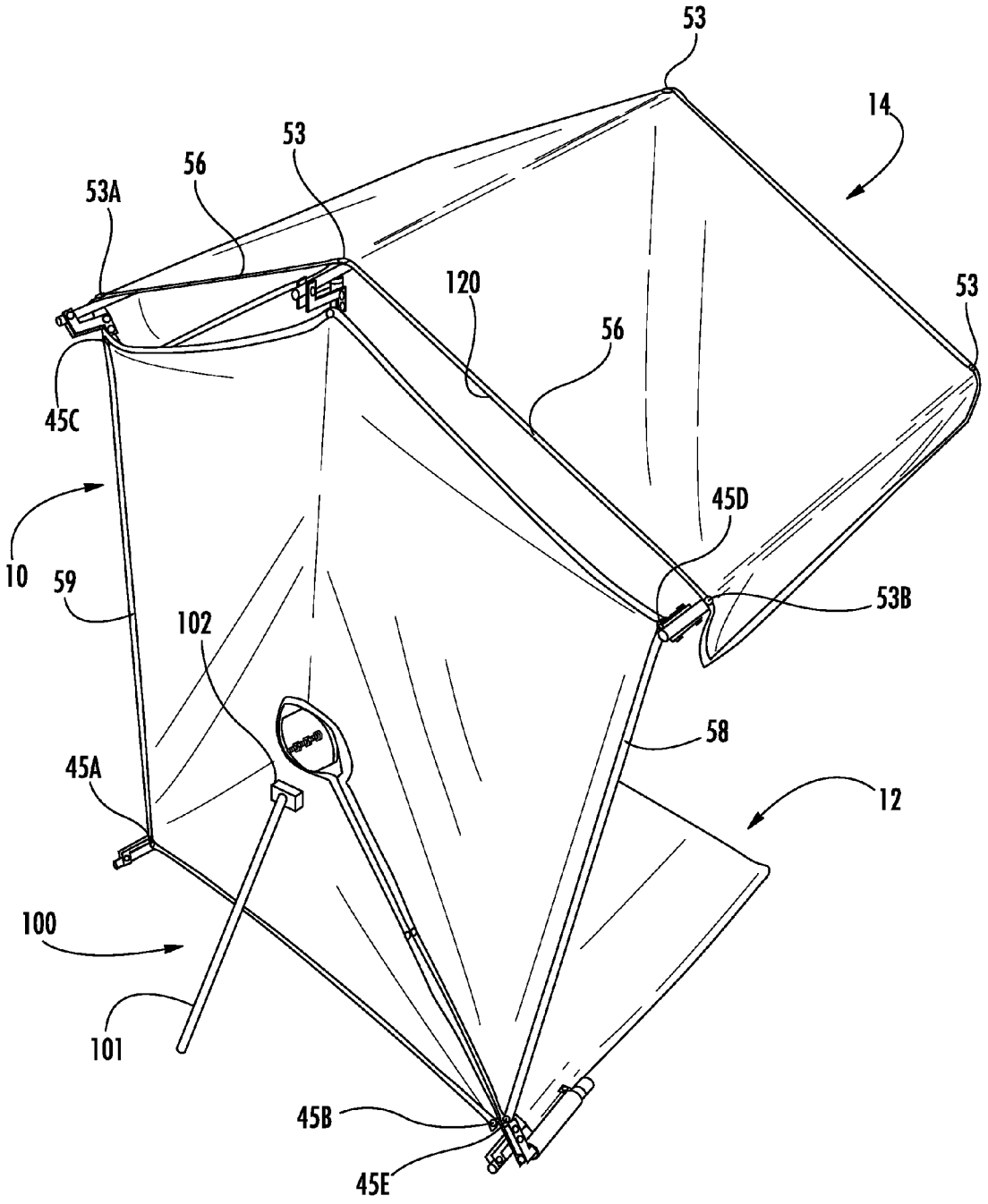
Figure 87:
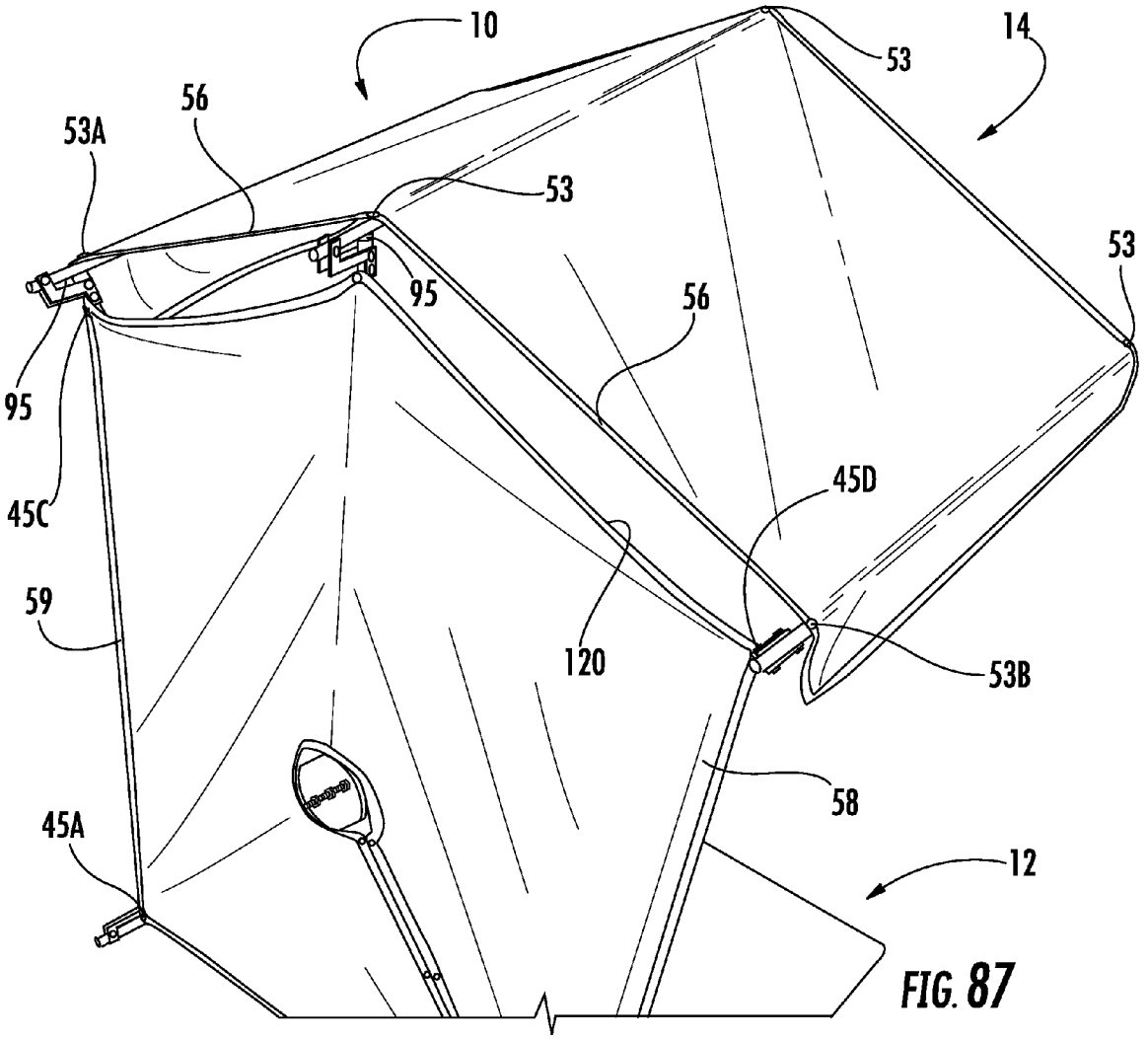

The cover assembly 12 further includes a covering 52 that includes a cover portion or segment 52A and a cover portion or segment 52B as shown in FIGS. 1 and 48. The cover segment 52A and the cover segment 52B are constructed integrally with one another so as to form the covering 52 as a single sheet as shown in FIG. 48. The covering 52 includes a border member or piping 55. The cover segment 52A extends between the arm 50A and the intermediate arm 50N, while the cover segment 52B extends between the intermediate arm 50N and the arm 50B. In addition, the covering 52 is connected to the arm 50A, the intermediate arm 50N, and the arm 50B. In particular, a plurality of fasteners 53, such as screws or rivets, is secured to the arms 50 to connect the covering 52 to the arms 50A, 50B, 50N. (See, e.g., FIGS. 4 and 86-87.) The same manner of securing the flooring 40 (and the back screen 44) to the legs 38 is used to secure the covering 52 to the arms 50 (i.e. with rivets or screws).

It should be appreciated that the covering 52 also is attached to the arms 50A, 50B so that the extent of movement or distance between the arm 50A and the arm 50B is limited by the portion 56 of the covering 52 that extends between the fastener 53A and the fastener 53B. (See FIGS. 6, 86, and 87.) In addition, a portion 57 of the back screen 44 serves a limiter. Specifically, the back screen is attached to the arms 50A, 50B so that the extent of movement or distance between the arm 50A and the arm 50B is limited by the portion 57 of the back screen 44 that extends between the fastener 45C and the fastener 45D. (See FIGS. 6, 86, and 87.)

The arms 50A, 50B, 50N are made of a rigid material such as a metal, for example, steel or aluminum. Alternatively, the arms 50 may be made of a somewhat flexible material such as fiberglass or plastic. The covering 52 is made from a fabric material. As one example, the covering is made from a 70 Denier Nylon Ripstop with Urethane Coat material that is treated for water resistance and flame resistance. The covering 52 may be made from the same material that is used to make the walls and ceilings of commercially available tents.

Figure 2:
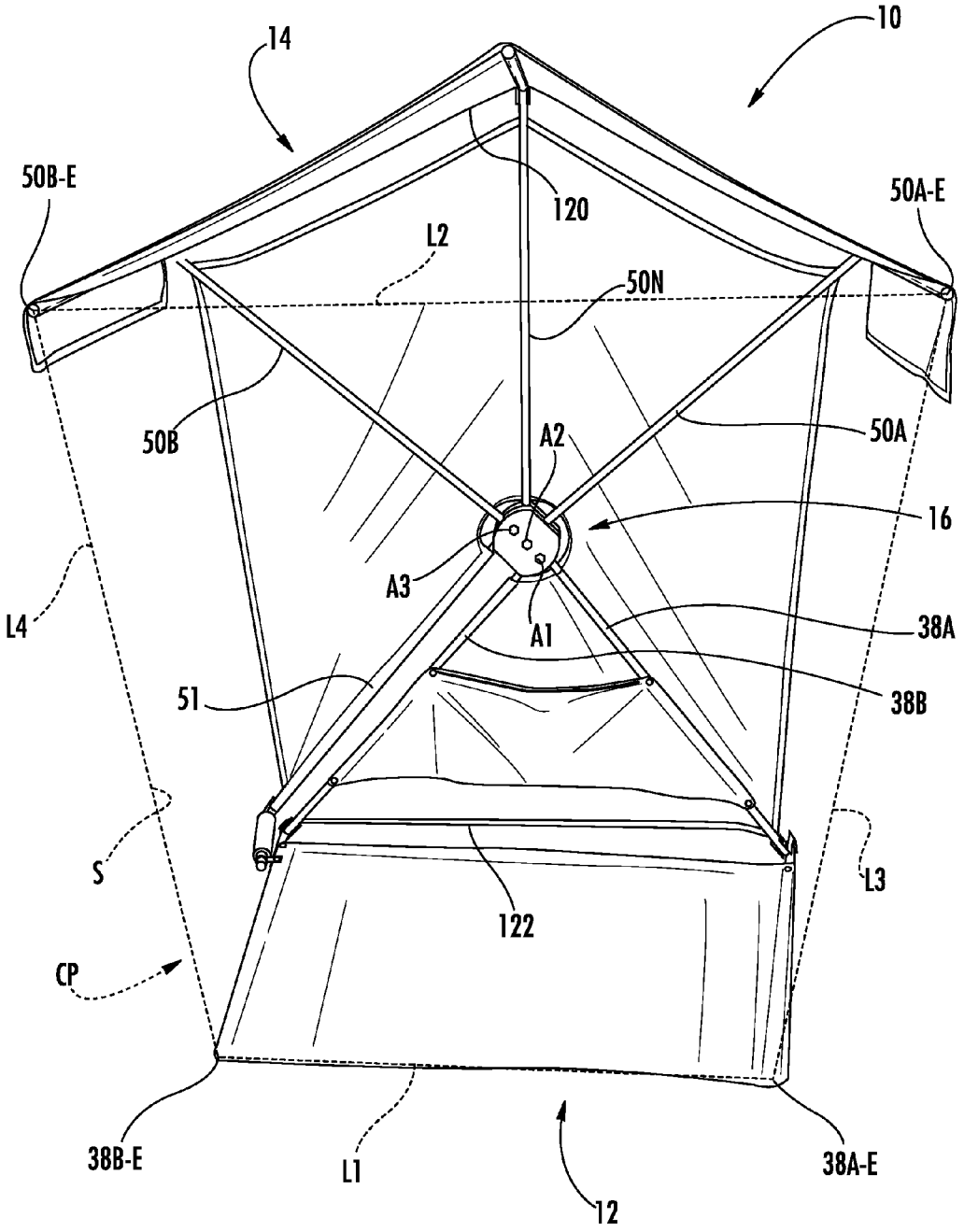
Figure 3:
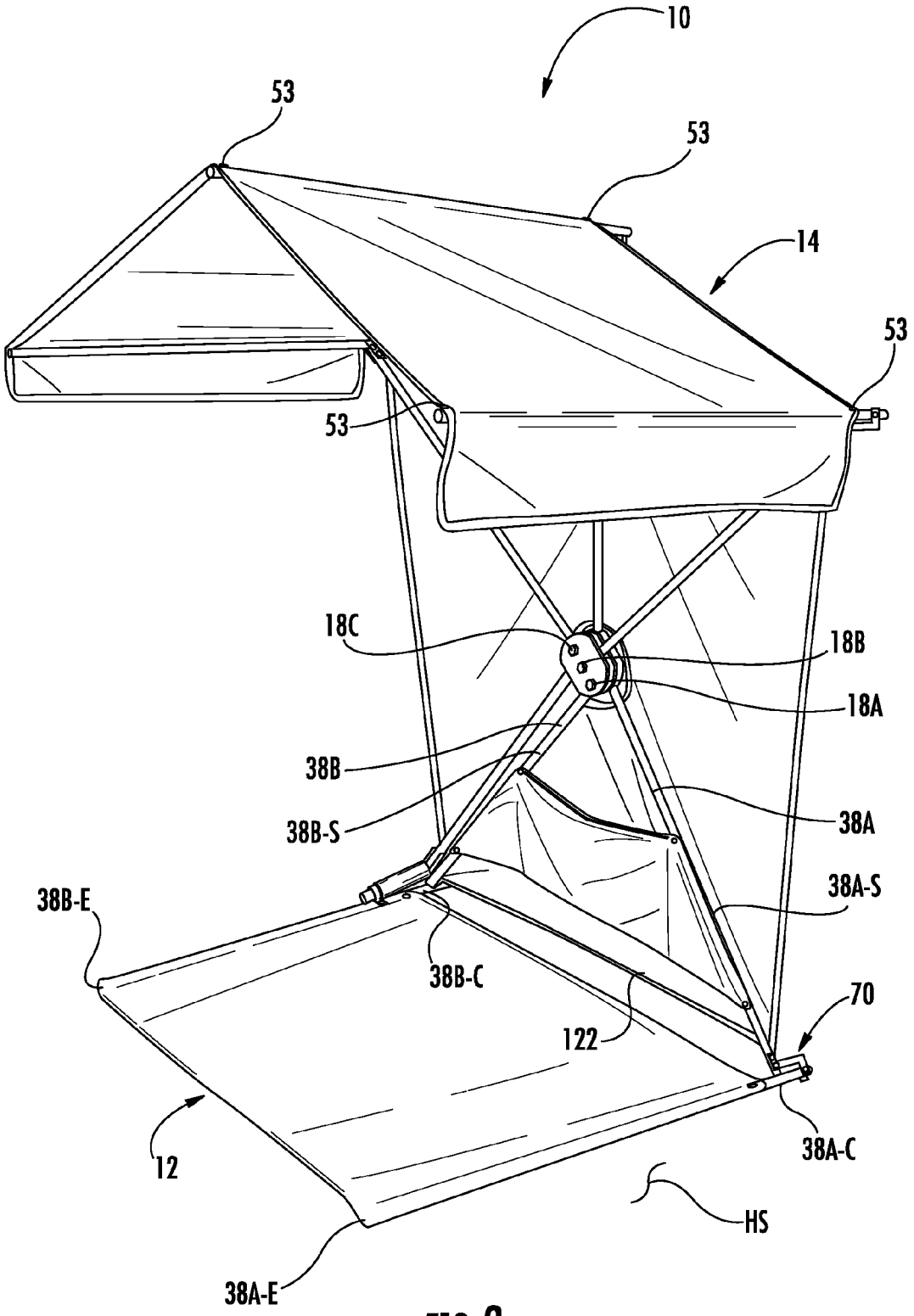

The arms 50A, 50B and the intermediate arm 50N and supplemental component 51 are each connected to the junction assembly 16 (see, e.g., FIG. 2). The arm 50B is pivotably connected to the bolt 18C of the junction assembly 16, while the arm 50N is pivotably connected to the bolt 18B. In contrast, the arm 50A is secured in fixed relation to the bolt 18A by the use of the set screw 20. Particularly, the set screw 20 extends through the plate 17A so as to threadingly engage the arm 50A so as to secure it in fixed relation to the plate 17A and bolt 18A. For at least some duration during movement of the portable barrier 10 from its protection mode (see FIG. 1) to its storage mode (see FIG. 13), the arm 50B pivots about a line defined by the axis A3. Similarly, for at least some duration during movement of the portable barrier 10 from its protection mode (see FIG. 1) to its storage mode (see FIG. 13), the arm 50N pivots about a line defined by the axis A2. Similarly, for at least some duration during movement of the portable barrier 10 from its protection mode (see FIG. 1) to its storage mode (see FIG. 13), all the arms 50A, 50B, 50N, and the supplemental component 51 pivot simultaneously about the line defined by the axis A1, as the plates 17A, 17B, 17C pivot about the line defined by the axis A1.

As shown in FIG. 81, the arm 50A includes (i) a strut portion 50A-S extending from the junction assembly 16, and (ii) a cantilevered or extension portion 50A-C pivotably coupled to the strut portion 50A-S. The cantilevered portion 50A-C terminates in an unsupported end 50A-E. Similarly, the arm 50B includes (i) a strut portion 50B-S extending from the junction assembly 16, and (ii) a cantilevered or extension portion 50B-C pivotably coupled to the strut portion 50B-S. The cantilevered portion 50B-C terminates in an unsupported end 50B-E. Further, the arm 50N includes (i) a strut portion 50N-S extending from the junction assembly 16, and (ii) a cantilevered or extension portion 50N-C pivotably coupled to the strut portion 50N-S. The cantilevered portion 50N-C terminates in an unsupported end 50N-E.

As shown in FIG. 5, the arm 50A further includes a hinge joint 74, and the cantilevered portion 50A-C is configured to pivot with respect to the strut portion 50A-S via the hinge joint 74. Similarly, the arm 50B further includes a hinge joint 78, and the cantilevered portion 78B-C is configured to pivot with respect to the strut portion 78B-S via the hinge joint 78. And the arm 50N further includes a hinge joint 76, and the cantilevered portion 50N-C is configured to pivot with respect to the strut portion 50N-S via the hinge joint 76.

As shown in FIG. 5, the leg 38A further includes a hinge joint 70, and the cantilevered portion 38A-C is configured to pivot with respect to the strut portion 38A-S via the hinge joint 70. Similarly, the leg 38B further includes a hinge joint 72, and the cantilevered portion 38B-C is configured to pivot with respect to the strut portion 38B-S via the hinge joint 72.

The supplemental component 51 is connected to the junction assembly 16 (see, e.g., FIG. 2). The supplemental component 51 is pivotably connected to the bolt 18C of the junction assembly 16. For at least some duration during movement of the portable barrier 10 from its protection mode (see FIG. 1) to its storage mode (see FIG. 13), the supplemental component pivots about a line defined by the axis A3. As shown in FIG. 81, the supplemental component 51 includes (i) a strut portion 51S extending from the junction assembly 16, and (ii) a handle portion 51H fixedly coupled to the strut portion 51S by use of a pair of brackets 60 and fasteners 61 such as rivets or screws. In particular, the brackets 60 are secured to the strut portion 51S with the fasteners 61, and the handle portion 51H is secured to the bracket 60 with the fasteners 61 thereby securing the handle portion 51H in fixed relation to the strut portion 51S. (See, e.g., FIGS. 25-29 and 61-63.)

Figure 24:
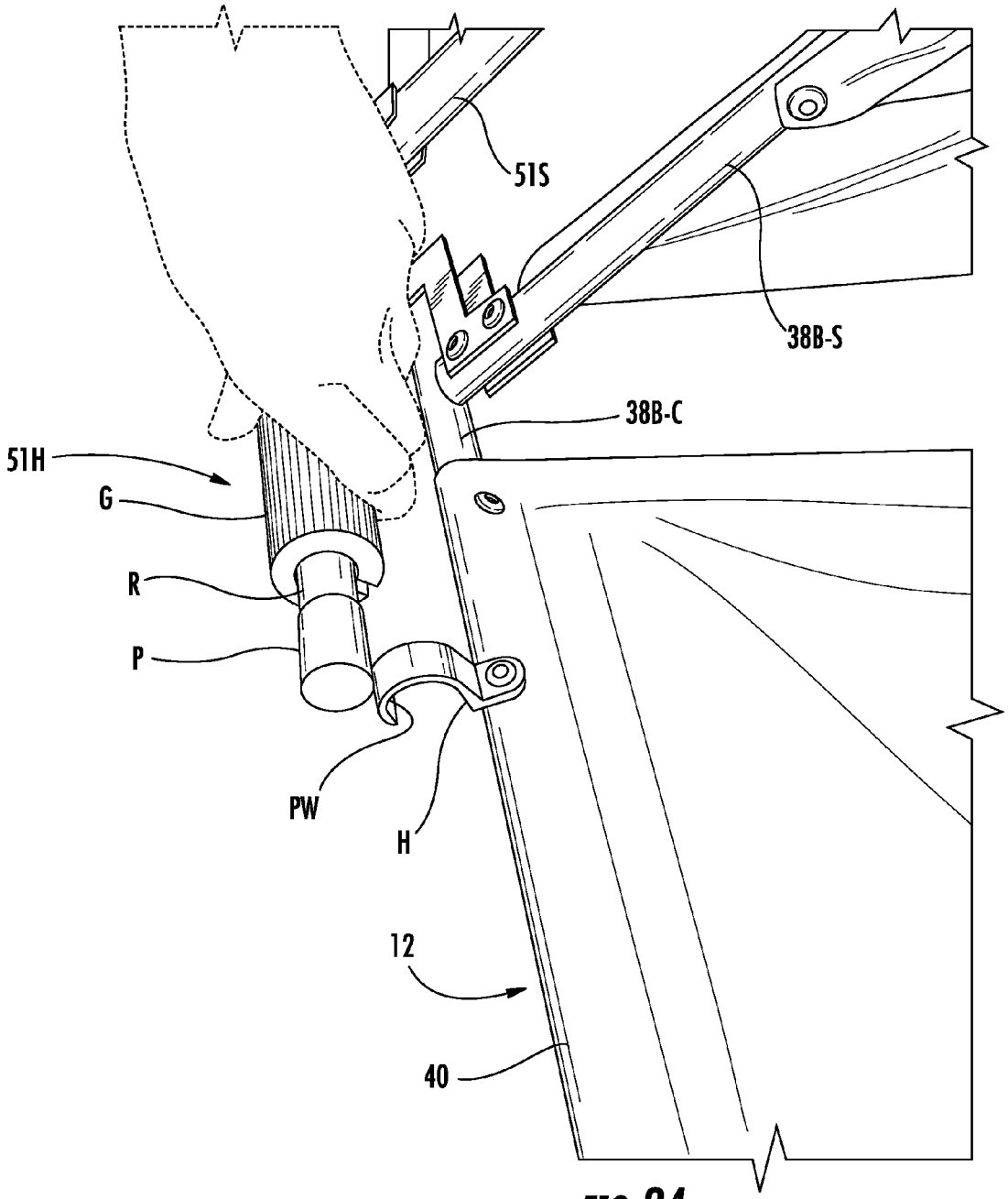
FIGS. 24-29 are perspective views of the portable barrier of FIG. 1 showing the handle portion of the supplemental component and the hook that is fixedly secured to one of the legs of the portable barrier, with FIGS. 24-25 showing the portable barrier right before being secured in the protection mode, and with FIGS. 26-29 showing the portable barrier immediately after being secured in the protection mode.
Figure 28:
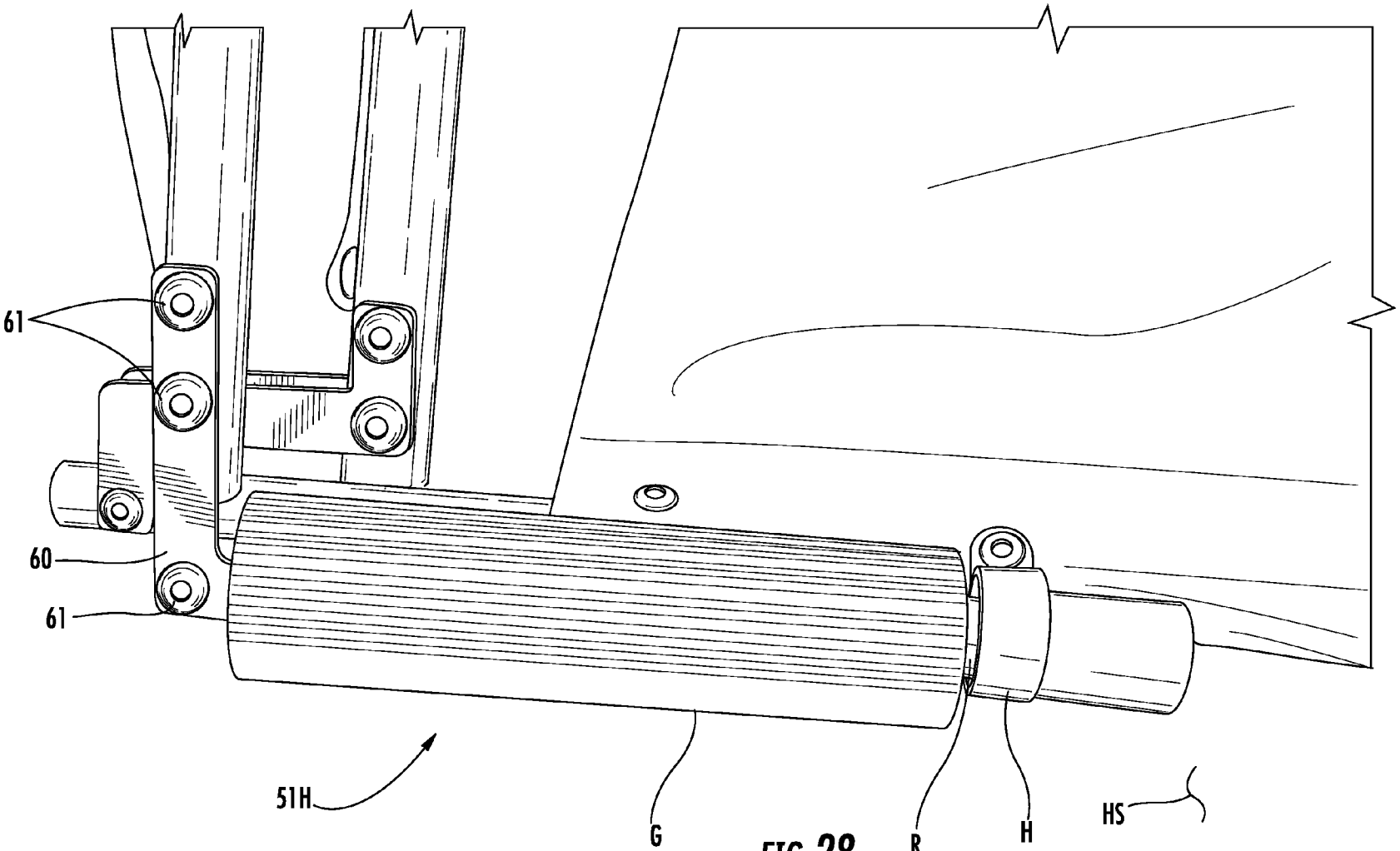
Figure 29:
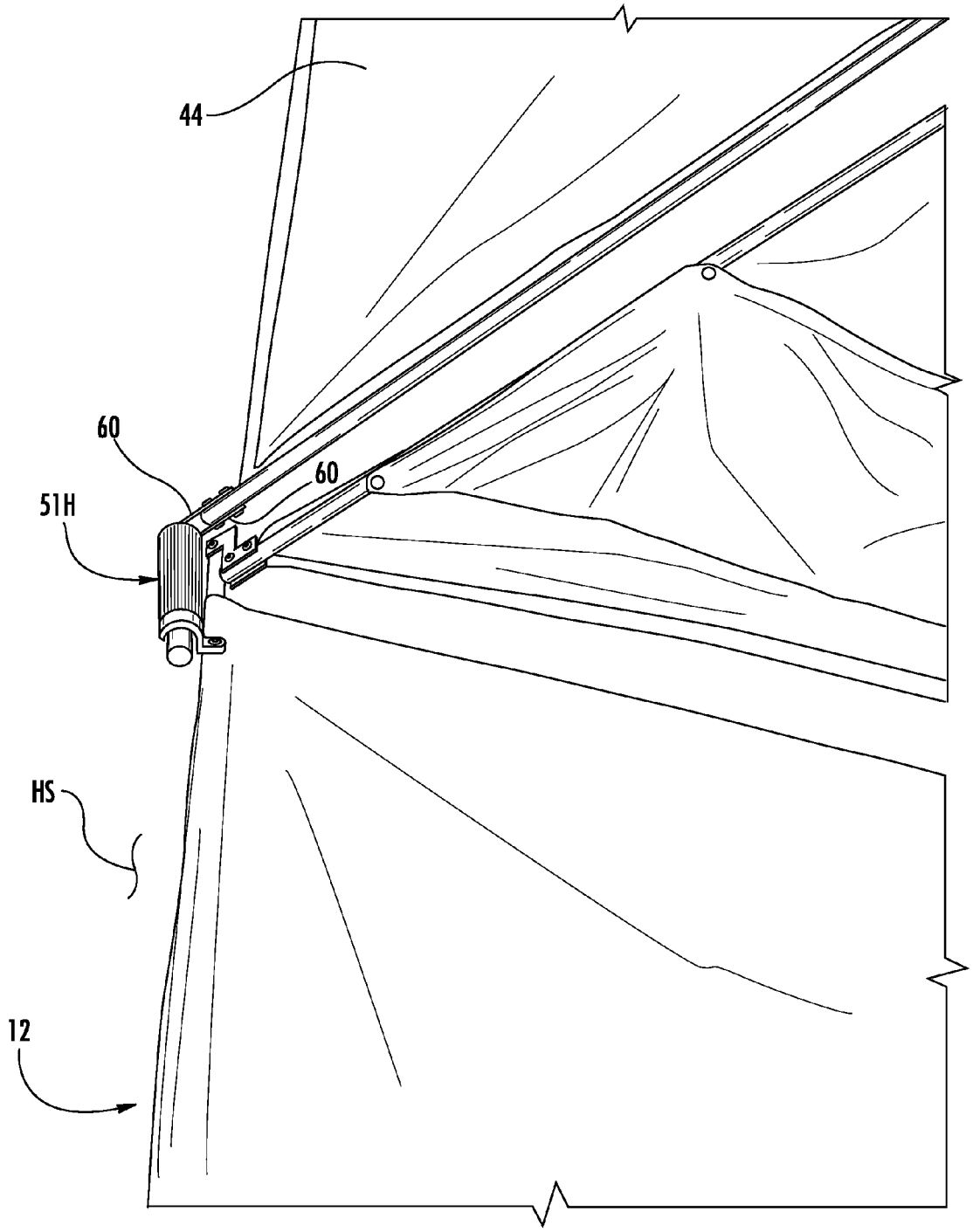

As shown in FIGS. 24-29 and 61-63, the handle portion 51H includes a tube segment T, a hand grip G positioned around the tube segment T, and an end cap 95 secured on an end portion of the tube segment T. The tube segment T is made of the same material as the arms 50A, 50B, 50N. The end portion of the tube segment T that extends out of the hand grip G defines a projection P having a circumferential recess R as shown in FIG. 24. The hand grip G is made from a cellular foam material and possess a plurality of longitudinal ribs as shown in FIG. 28. A hook H is secured in fixed relation to the leg 38B as shown in FIGS. 24-29. In order to lock the portable barrier 10 in its protection mode, the handle 51H is manipulated by a user (i.e. the eventual occupant 26) from its position shown in FIGS. 24-25 to its position shown in FIGS. 26-29 so that the hook H is located in the recess R.

Operation of Portable Barrier

Figure 17:
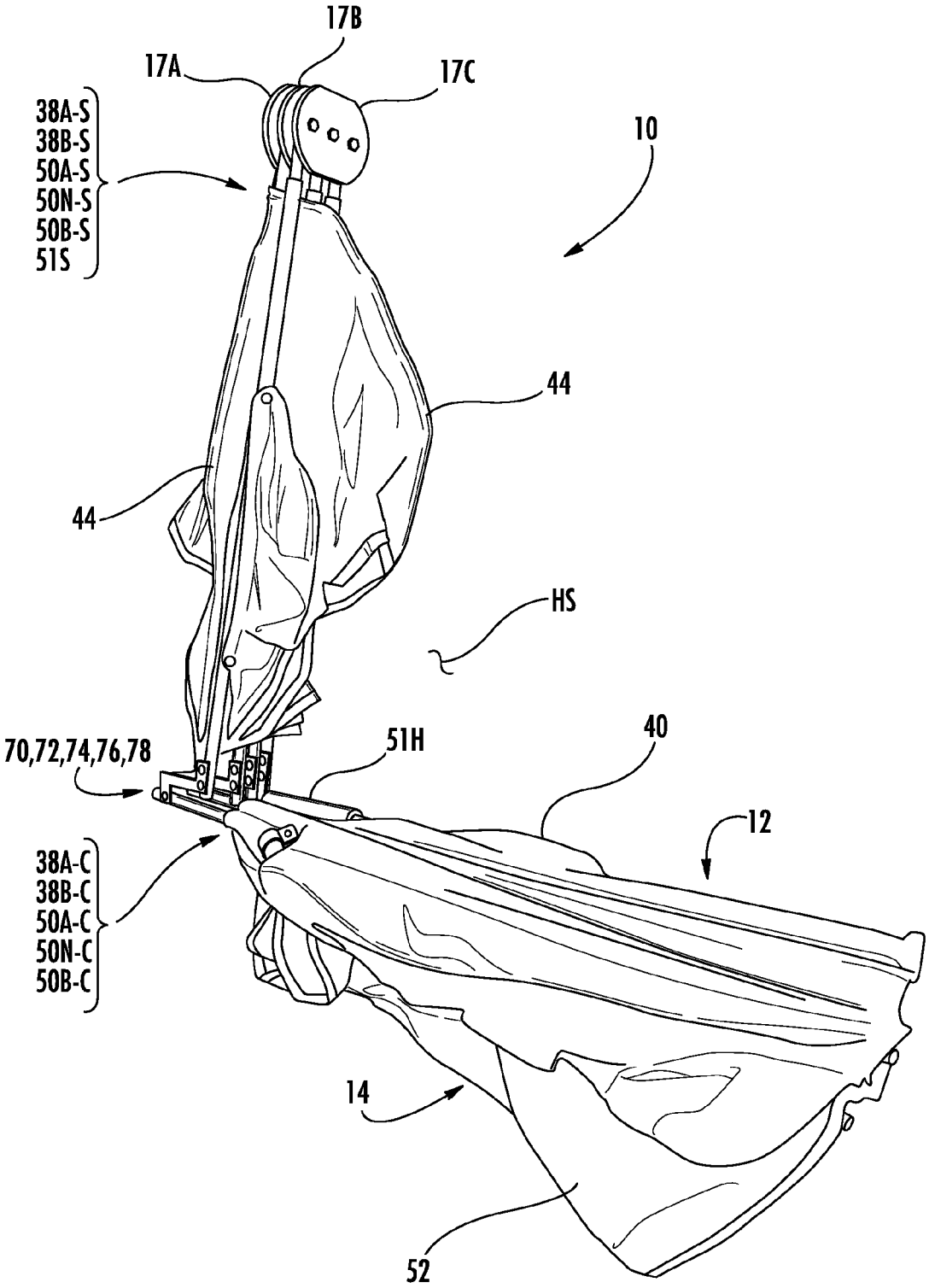
FIGS. 17-23 are perspective views of the portable barrier of FIG. 1 shown at various intermediate stages of being moved from its storage mode to its protection mode.

Operation of the portable barrier 10 will be discussed with reference to FIG. 13-29. In particular, a user (e.g. the eventual occupant 26) will carry the portable barrier 10 while it is positioned in its stowed configuration and located in the carrier bag 30 as shown in FIG. 15. Upon arriving at a use destination such as a sandy beach or near the sideline of a soccer field, the user removes the portable barrier 10 from the carrier bag 30 and places the portable barrier on a ground surface which is a substantially horizontal surface HS. FIG. 16 shows the portable barrier 10 partially removed from the carrier bag 30, while FIG. 13 shows the portable barrier completely removed the carrier bag, and FIG. 14 shows the carrier bag without the portable barrier therein. Thereafter, the cantilevered portions 38A-C, 38B-C, 50A-C, 50N-C, 50B-C are pivoted as a group relative to the strut portions 38A-S, 38B-S, 50A-S, 50N-S, 50B-S from their position in FIG. 13 to their position in FIG. 17 about their respective hinge joints 70, 72, 74, 76, 78. Then, the user repositions the portable barrier from its position shown in FIG. 17 to its position shown in FIG. 18 so that the junction assembly 16 is positioned above all the strut portions 38A-S, 38B-S, 50A-S, 50N-S, 50B-S, and the cantilevered portions 38A-C, 38B-C, 50A-C, 50N-C, 50B-C are positioned juxtaposed to and extend along the horizontal surface HS.

Figure 18:
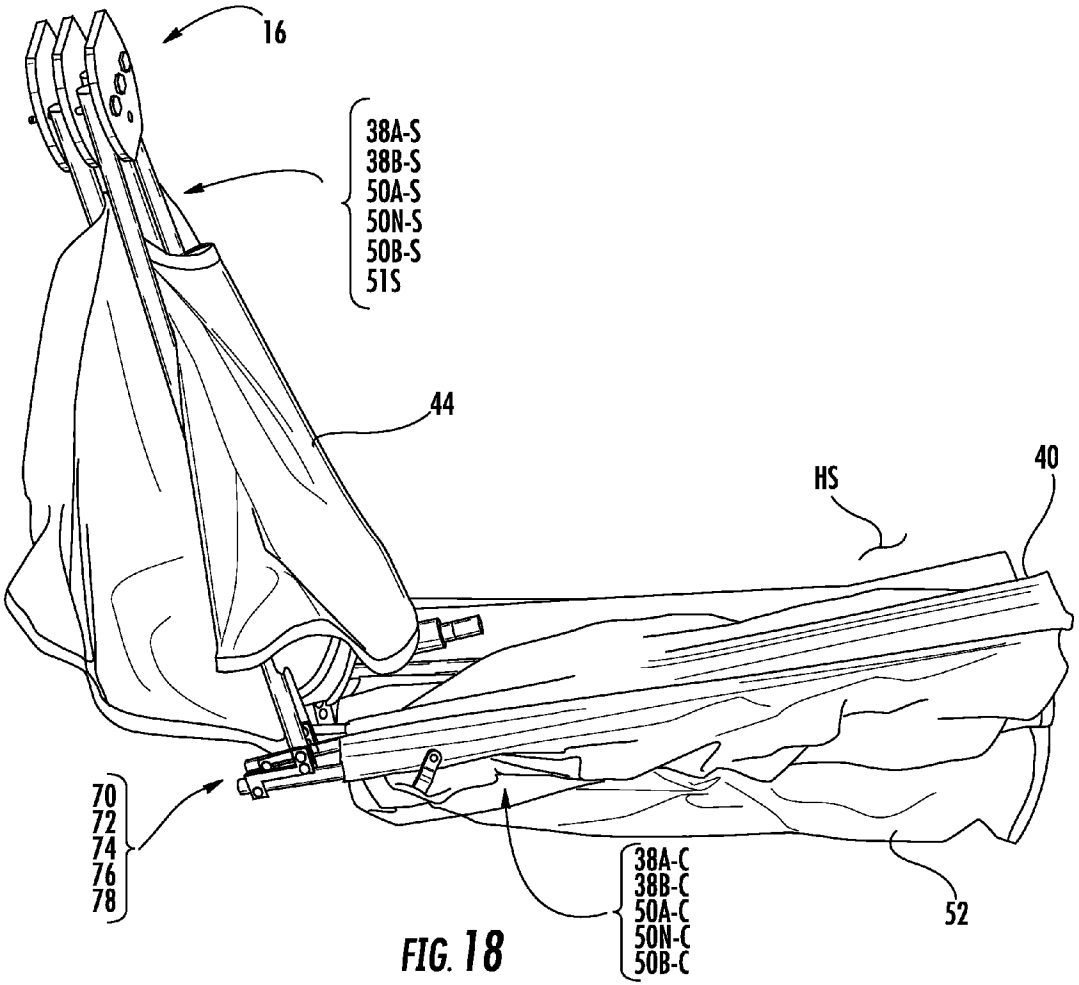
Figure 19:
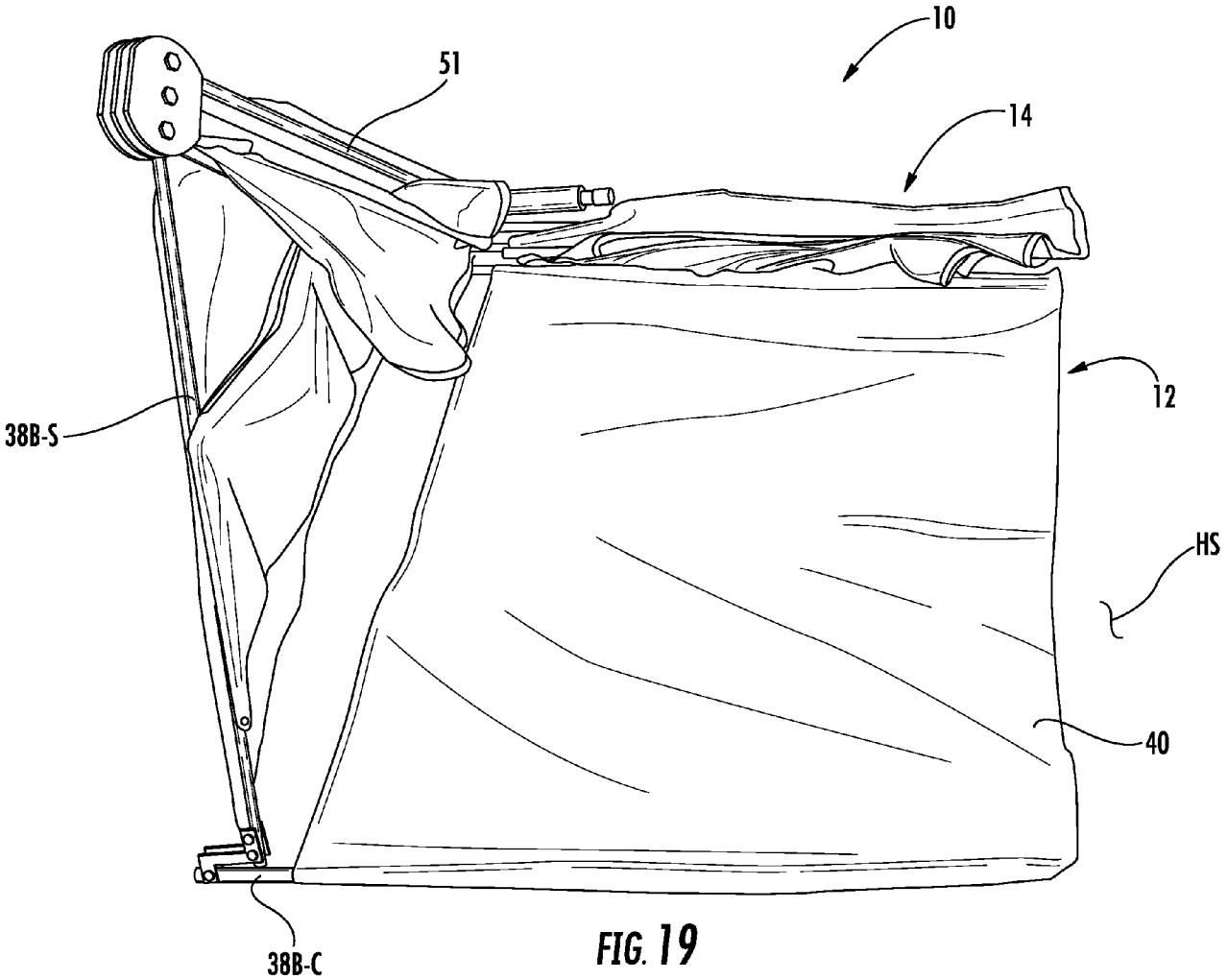
Figure 32:
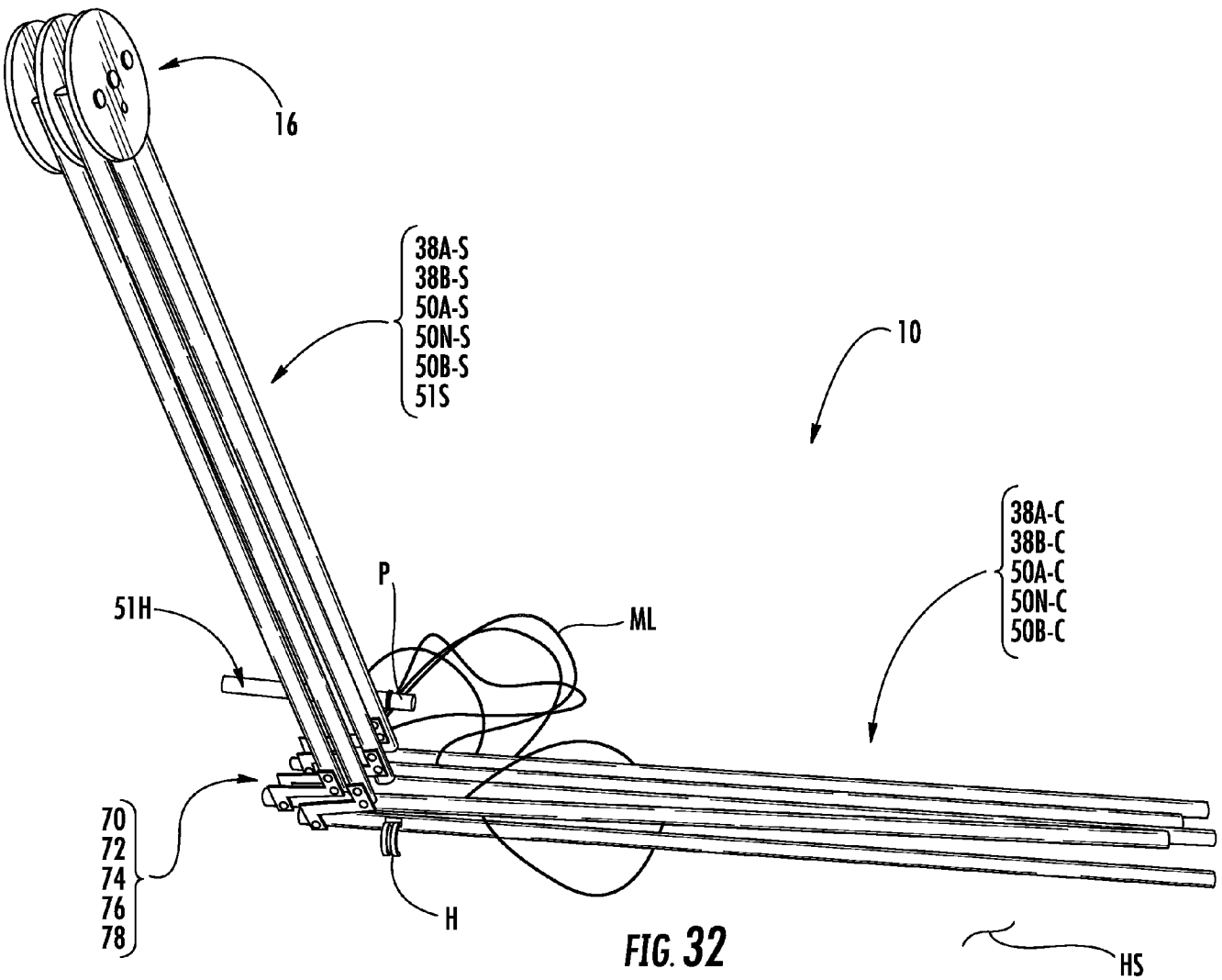
Figure 33:
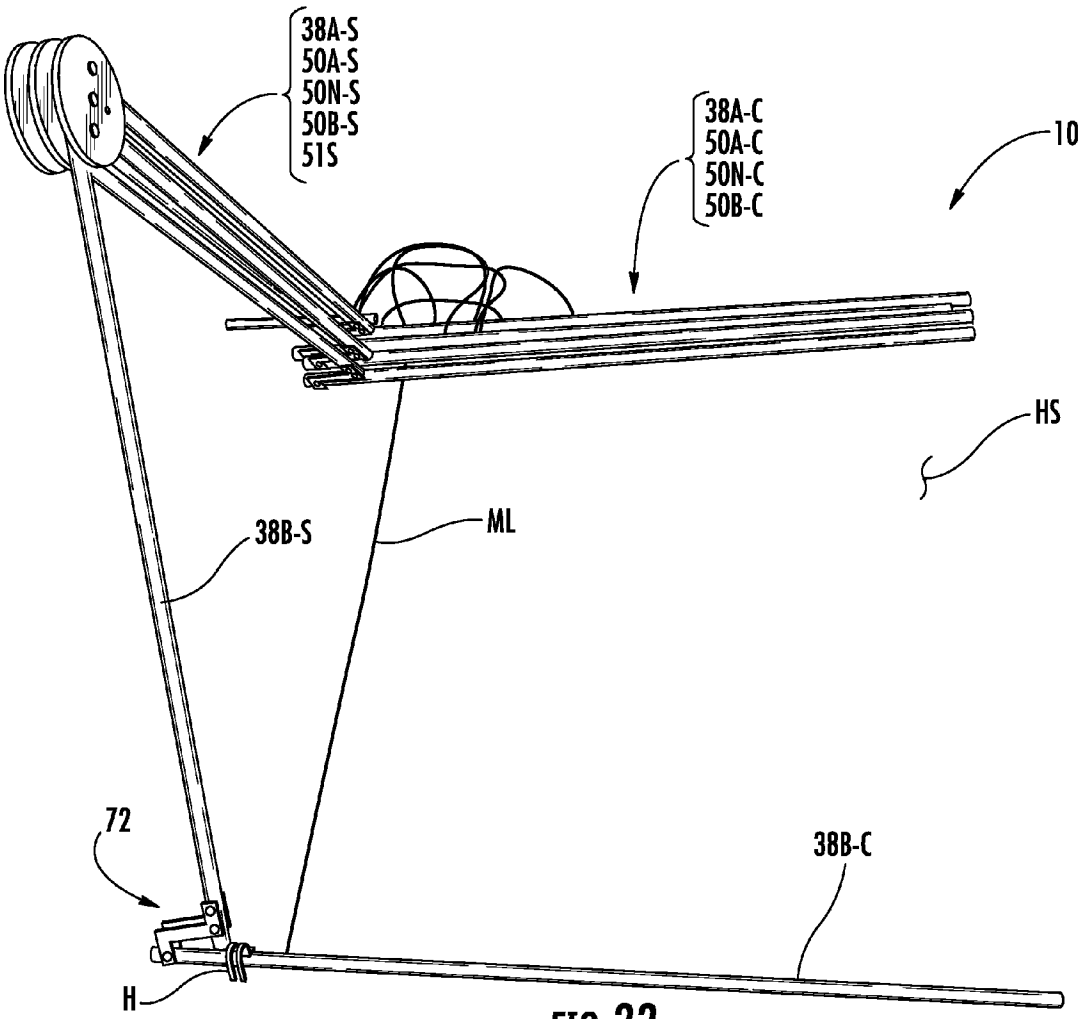

Thereafter, the legs 38A and 38B are moved away from each other from their relative position shown in FIG. 18 to their relative position shown in FIG. 19. (Note that FIGS. 32 and 33 show the relative position of the legs, the arms, and the supplemental component corresponding to the views of FIGS. 18 and 19 with the flooring, the back screen, and the covering removed for clarity of understanding.) In this position the pedestal assembly 12 is supported on the ground or horizontal surface HS as shown in FIG. 19. Moving of the legs 38A, 38B in such a manner causes the flooring 40 to be deployed. When deployed, the flooring 40 is positioned on the ground or horizontal surface so as to be supported thereby.

Figure 20:
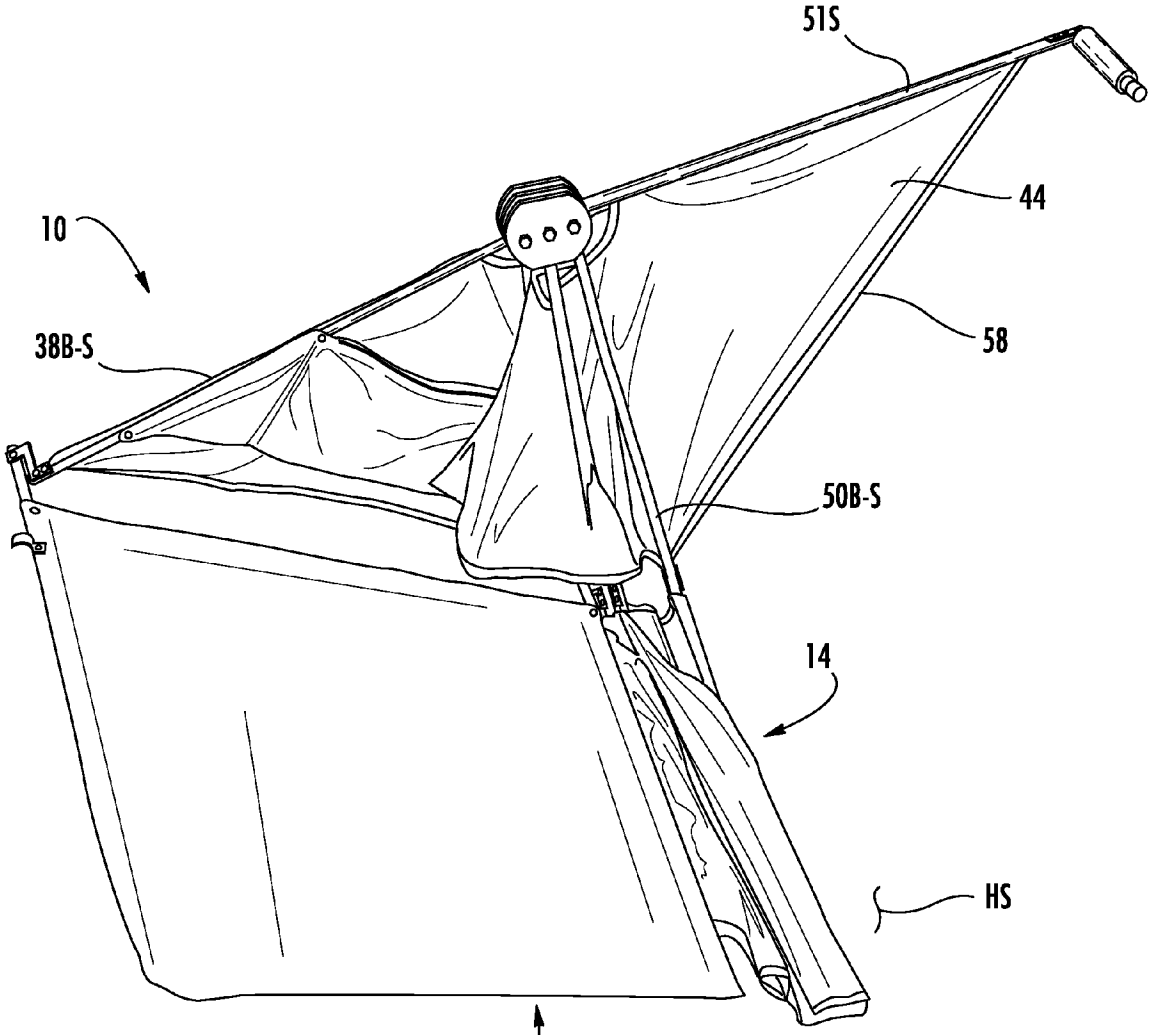
Figure 34:
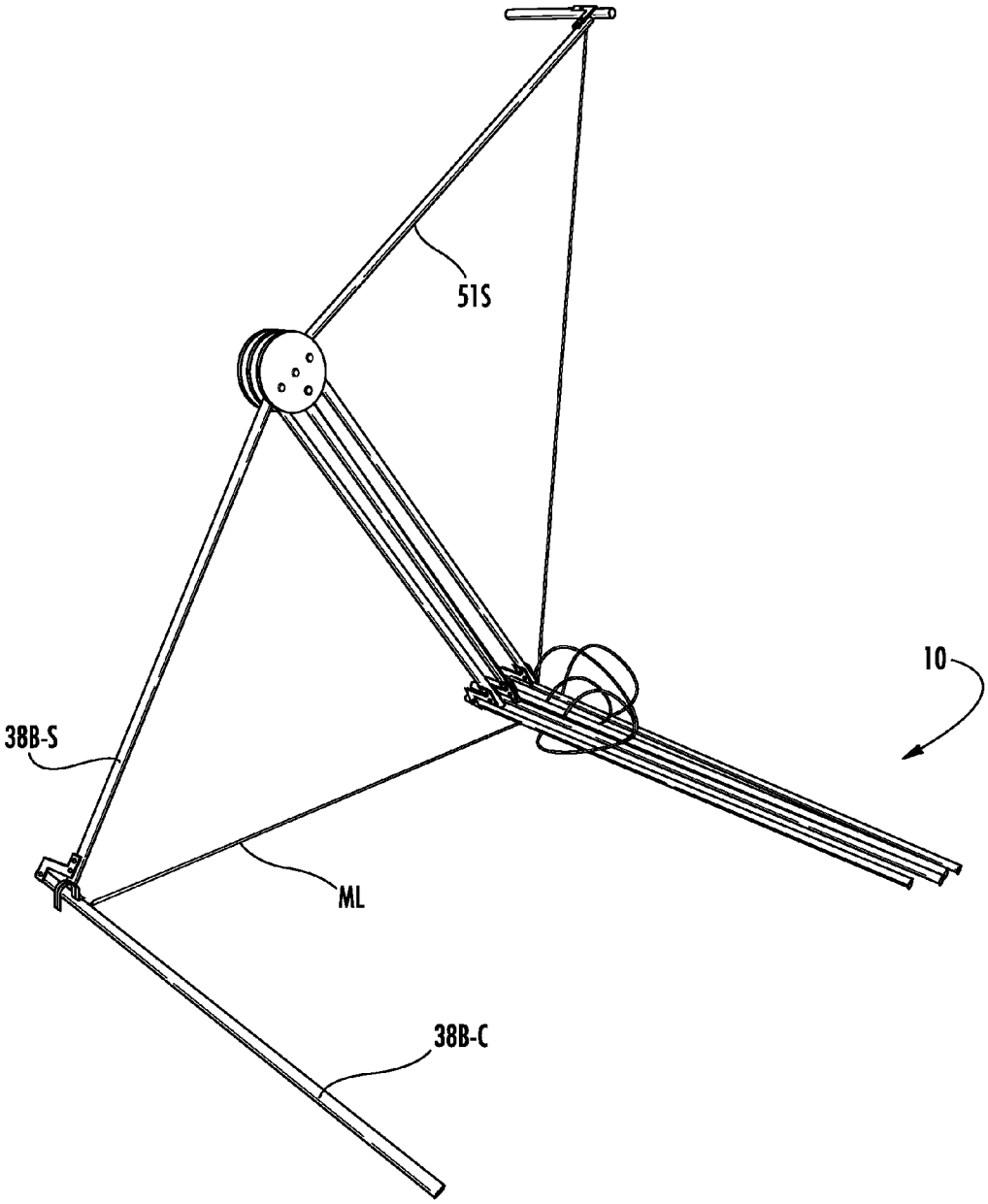

Then, the supplemental component 51 is moved from its position shown in FIG. 19 to its position shown in FIG. 20. (Note that FIG. 34 shows the position of the legs, the arms, and the supplemental component corresponding to the view of FIG. 20 with the flooring, the back screen, and the covering removed for clarity of understanding.) Moving of the supplemental component 51 in the manner described above causes the back screen 44 to be partially deployed. It should be appreciated that a portion 58 of the back screen 44 serves a limiter. Specifically, the back screen is attached to the supplemental component 51 and the arm 50B so that the extent of movement or distance between the supplemental component 51 and the arm 50B is limited by the portion 58 of the back screen 44 that extends between the fastener 45E and the fastener 45D. (See FIGS. 6, 86, and 87.)

Figure 21:
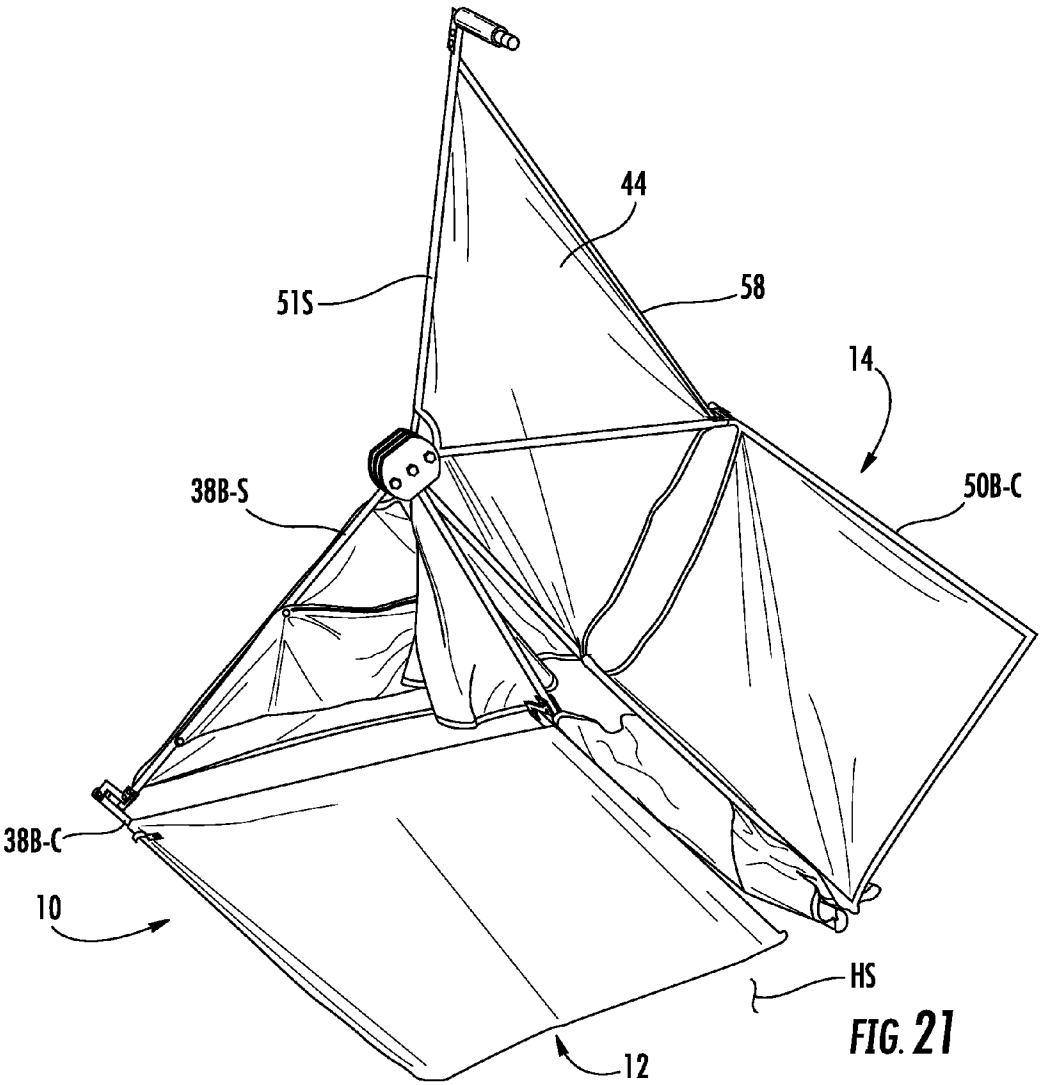
Figure 35:
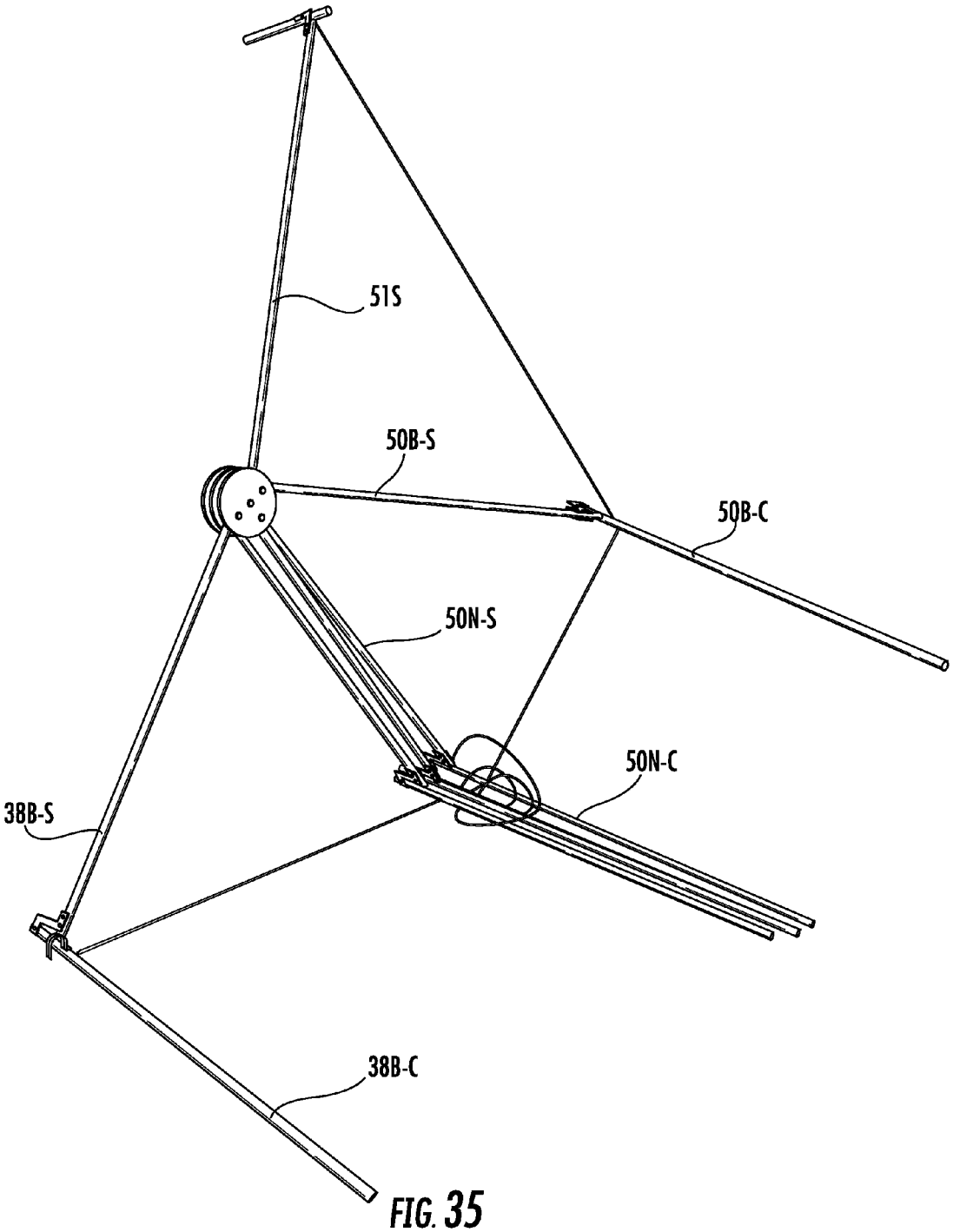

The supplemental component 51 and the arm 50B are then moved from their position in FIG. 20 to their position in FIG. 21. (Note that FIG. 35 shows the position of the legs, the arms, and the supplemental component corresponding to the view of FIG. 21 with the flooring, the back screen, and the covering removed for clarity of understanding.) Moving of the supplemental component 51 and arm 50B in such a manner causes the back screen 44 and the covering 52 to be partially deployed.

Figure 22:
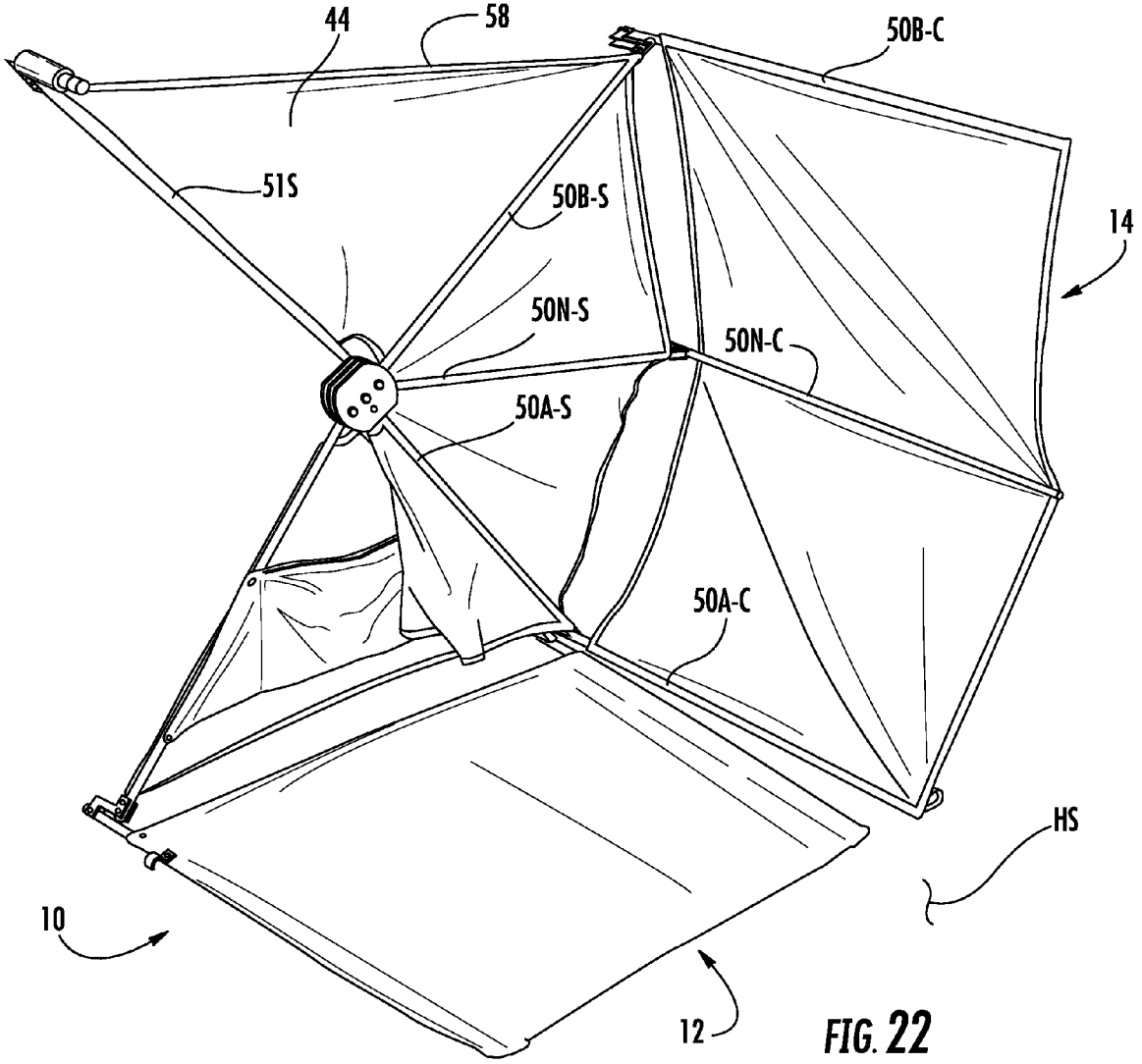
Figure 36:
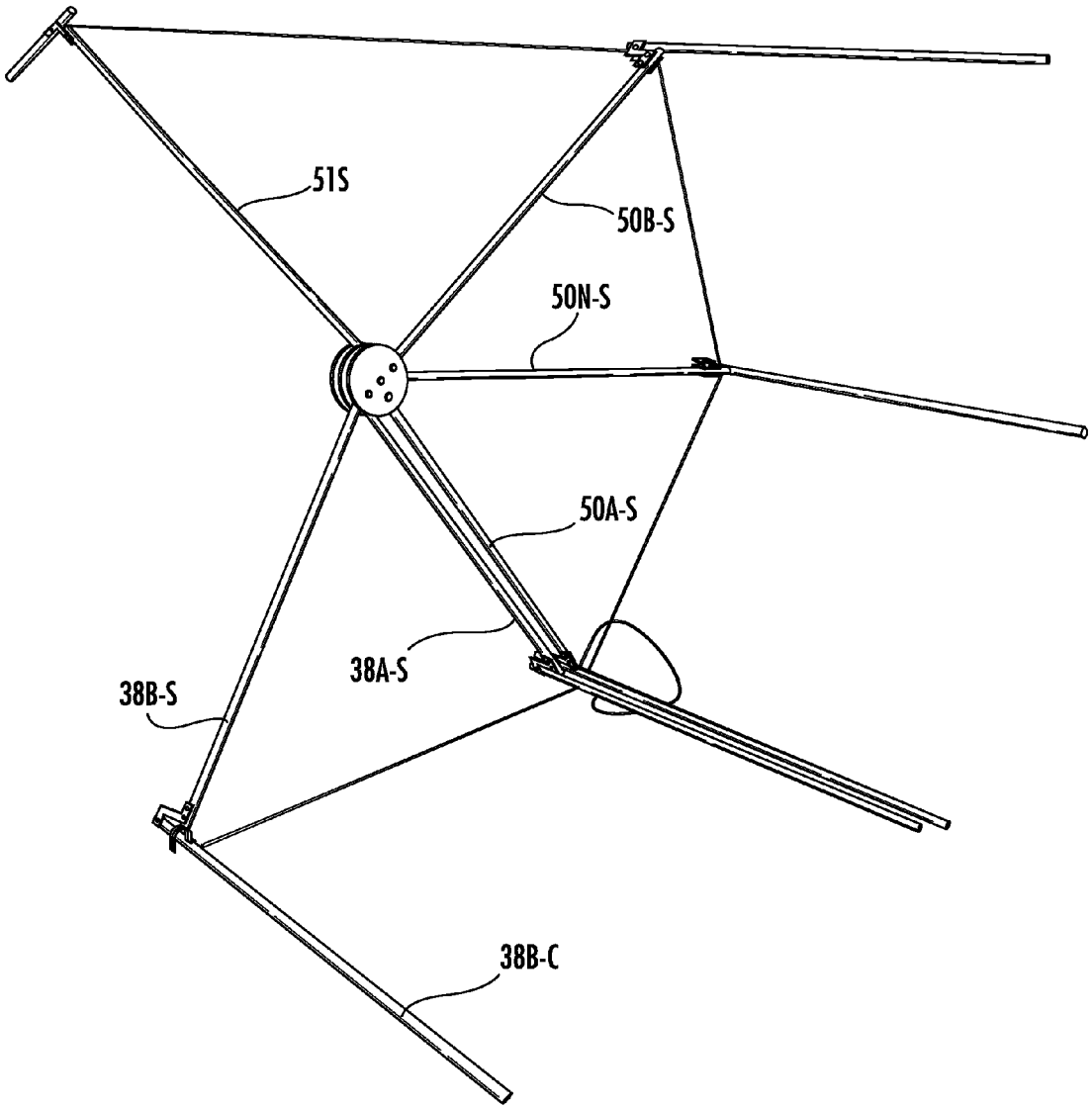

Thereafter, the supplemental component 51 and the arms 50B, 50N are moved from their position in FIG. 21 to their position in FIG. 22. (Note that FIG. 36 shows the position of the legs, the arms, and the supplemental component corresponding to the view of FIG. 22 with the flooring, the back screen, and the covering removed for clarity of understanding.) Moving of the supplemental component 51 and the arms 50B, 50N in the manner described above causes the back screen 44 and the covering 52 to be further partially deployed.

Figure 23:
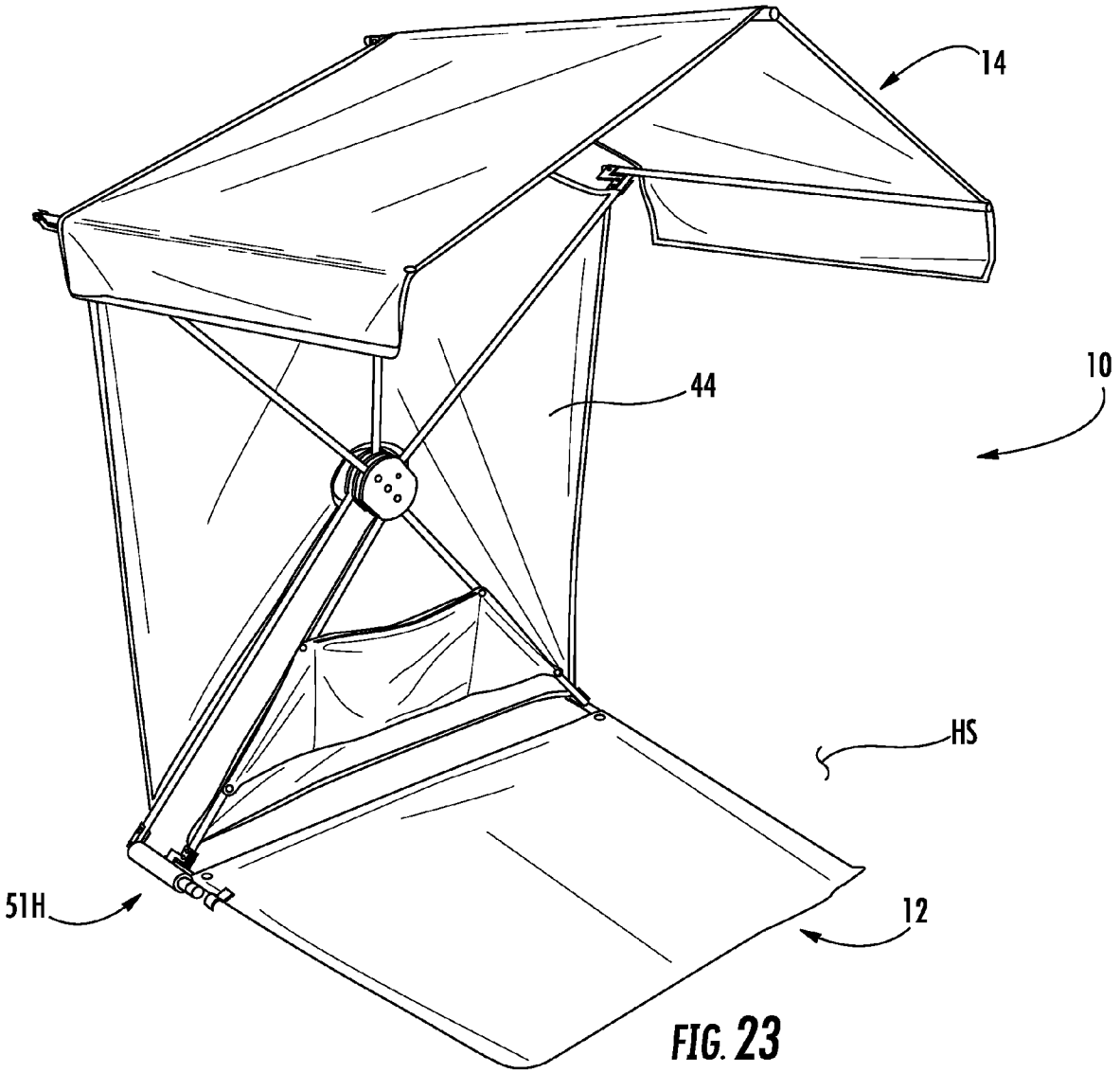
Figure 37:
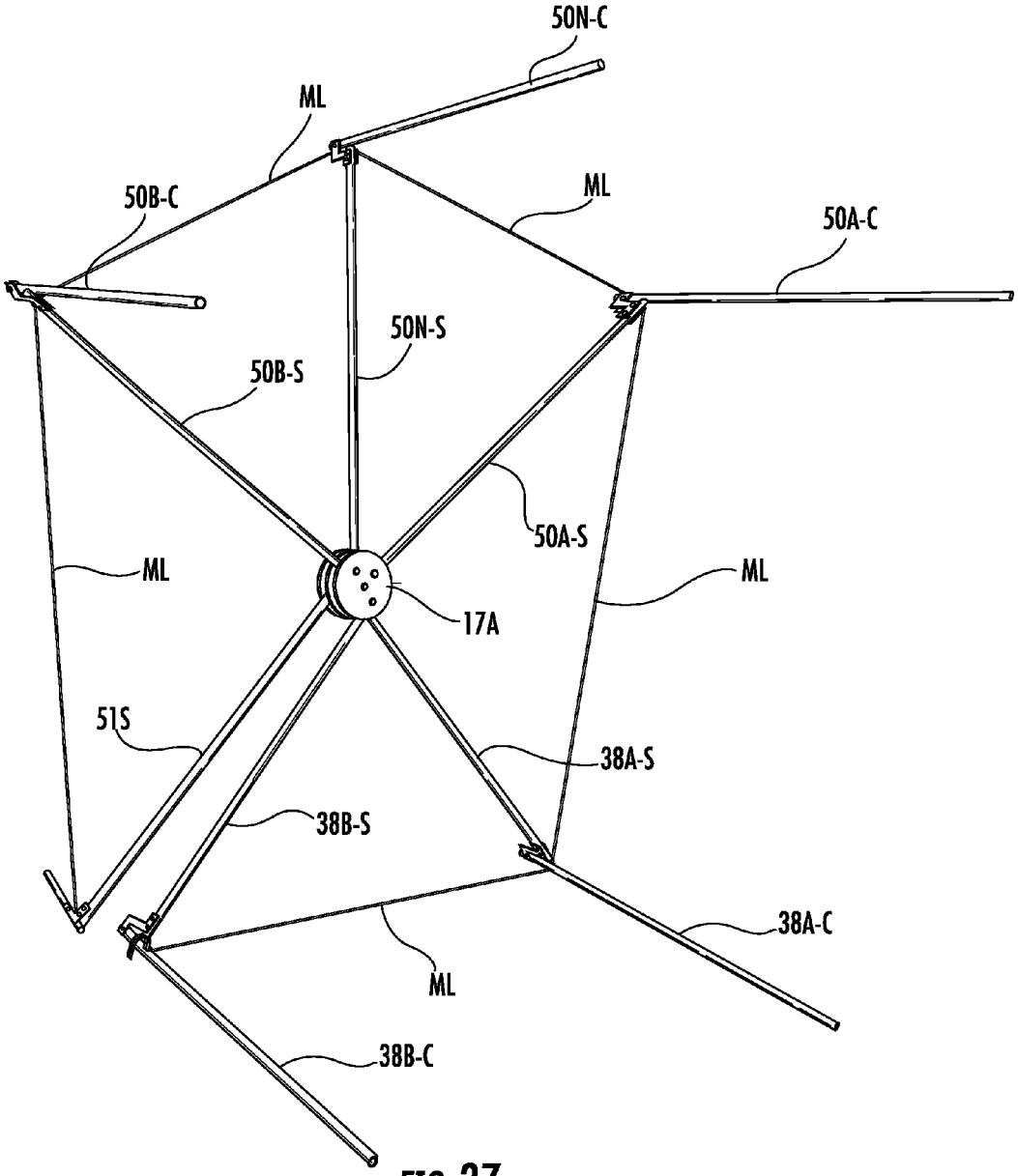

Then, the supplemental component 51 and the arms 50B, 50N, 50B are moved from their position in FIG. 22 to their position in FIG. 23. (Note that FIG. 37 shows the position of the legs, the arms, and the supplemental component corresponding to the view of FIG. 23 with the flooring, the back screen, and the covering removed for clarity of understanding.) Moving of the supplemental component 51 and the arms 50B, 50N, 50B in the manner described above causes the back screen 44 and the covering 52 to be fully deployed. When fully deployed, the covering 52 is supported above the flooring 40. It should be appreciated that a portion 59 of the back screen 44 also serves a limiter. Specifically, the back screen 44 is attached to the arm 50A (i.e. the strut portion 50A-S) and the leg 38A (i.e. the strut portion 38A-S) so that the extent of movement or distance between the arm 50A and the leg 38A is limited by a portion 59 of the back screen 44 that extends between the fastener 45A and the fastener 45C. (See FIGS. 6, 86, and 87.)

Figure 25:
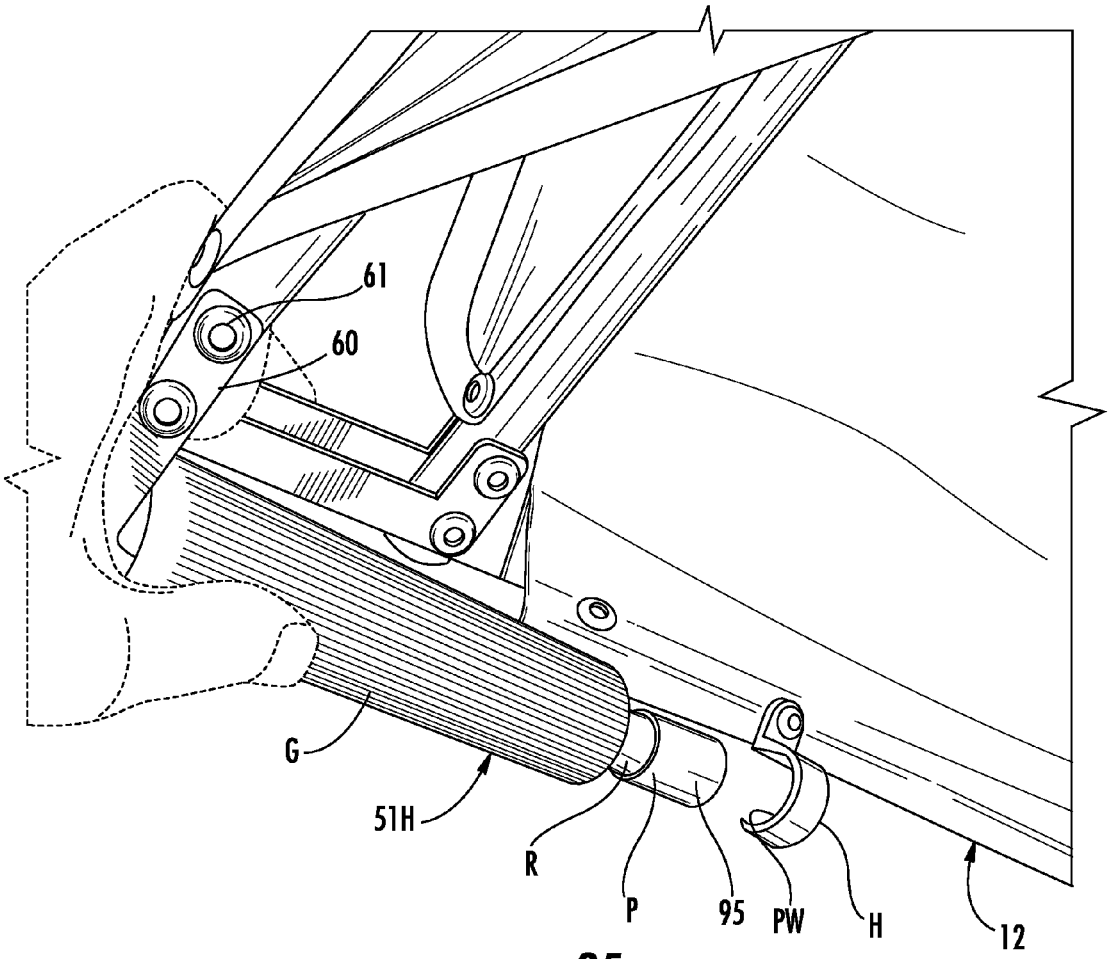
Figure 26:
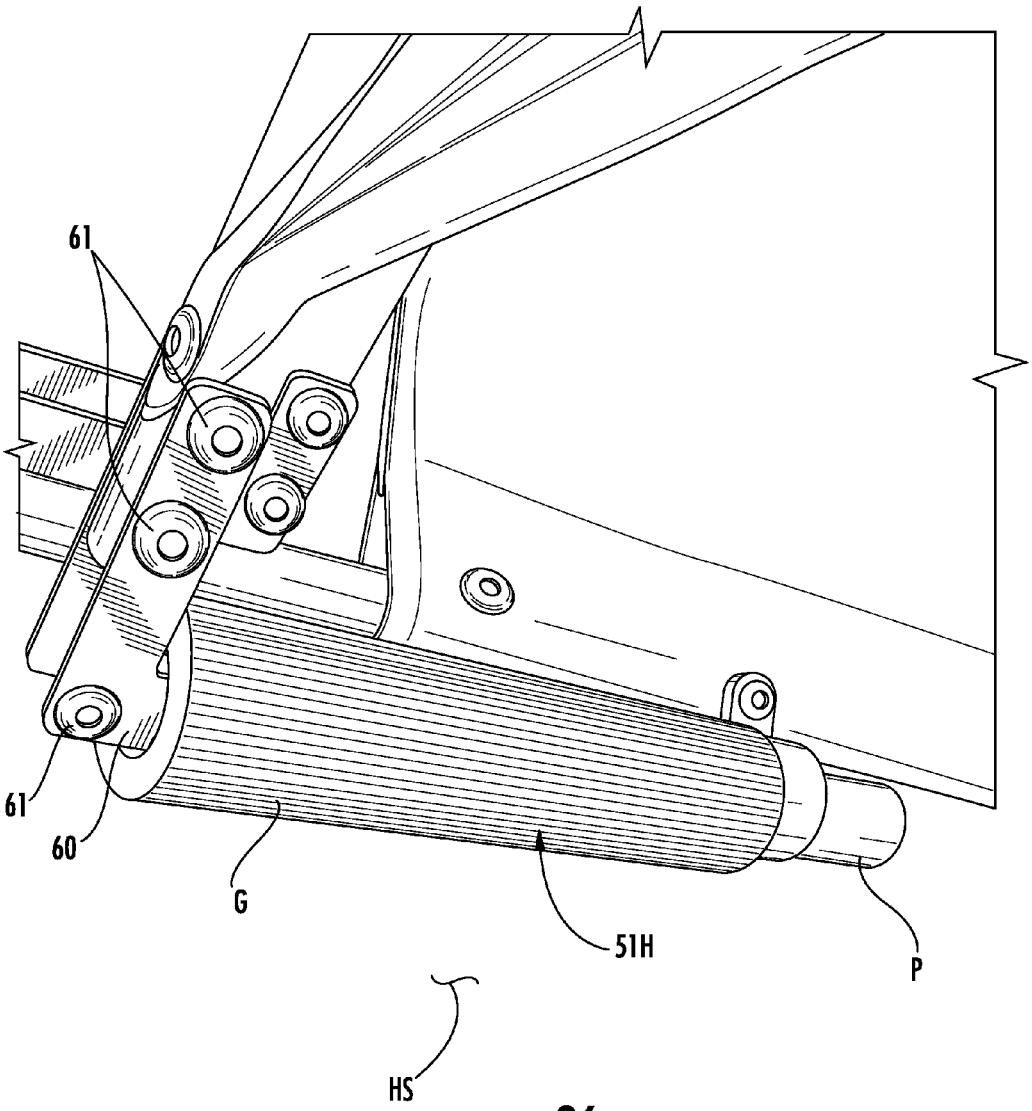
Figure 27:
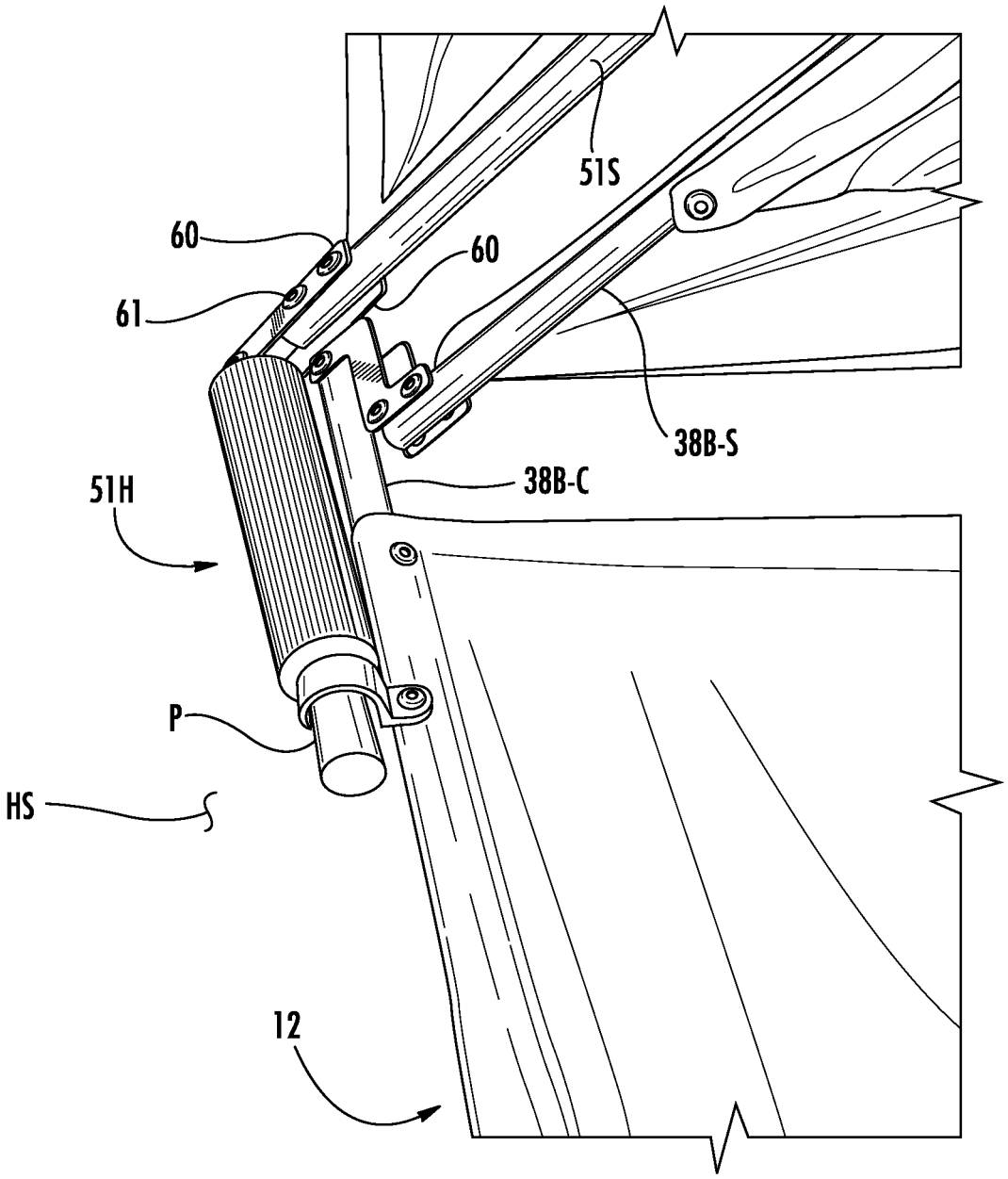

Then, the handle portion 51H is moved from its position shown in FIG. 24 to its position shown in FIG. 25 so as to align the projection P with a passageway PW defined by the hook H. Thereafter, the projection P is advanced from its position shown in FIG. 25 through the passageway PW of the hook H to its position shown in FIG. 26 (see also FIGS. 27-29) so as to secure the portable barrier 10 in its protection state.

In response to the portable barrier 10 being deployed in such a manner, the occupant space 28 is created. The chair 27 is then advanced into the occupant space 28 and situated so as to be supported on the flooring 40 as shown in FIG. 11. The occupant 26 then enters the occupant space 28 and sits in the chair 27 as shown in FIG. 12 so as to be protected from exposure to sun, wind, and/or rain by the portable barrier 10. Alternatively, after the occupant space 28 is created by deployment of the portable barrier 10 in the manner described above, a chair is not positioned in the occupant space, but rather an occupant enters the occupant space 28 and sits down, or alternatively, lays down directly on the flooring 40 whereby the occupant is protected from exposure to sun, wind, and/or rain by the portable barrier 10.

Operation of Portable Barrier (with Flooring, Back Screen, and Covering Removed)

Figure 39:
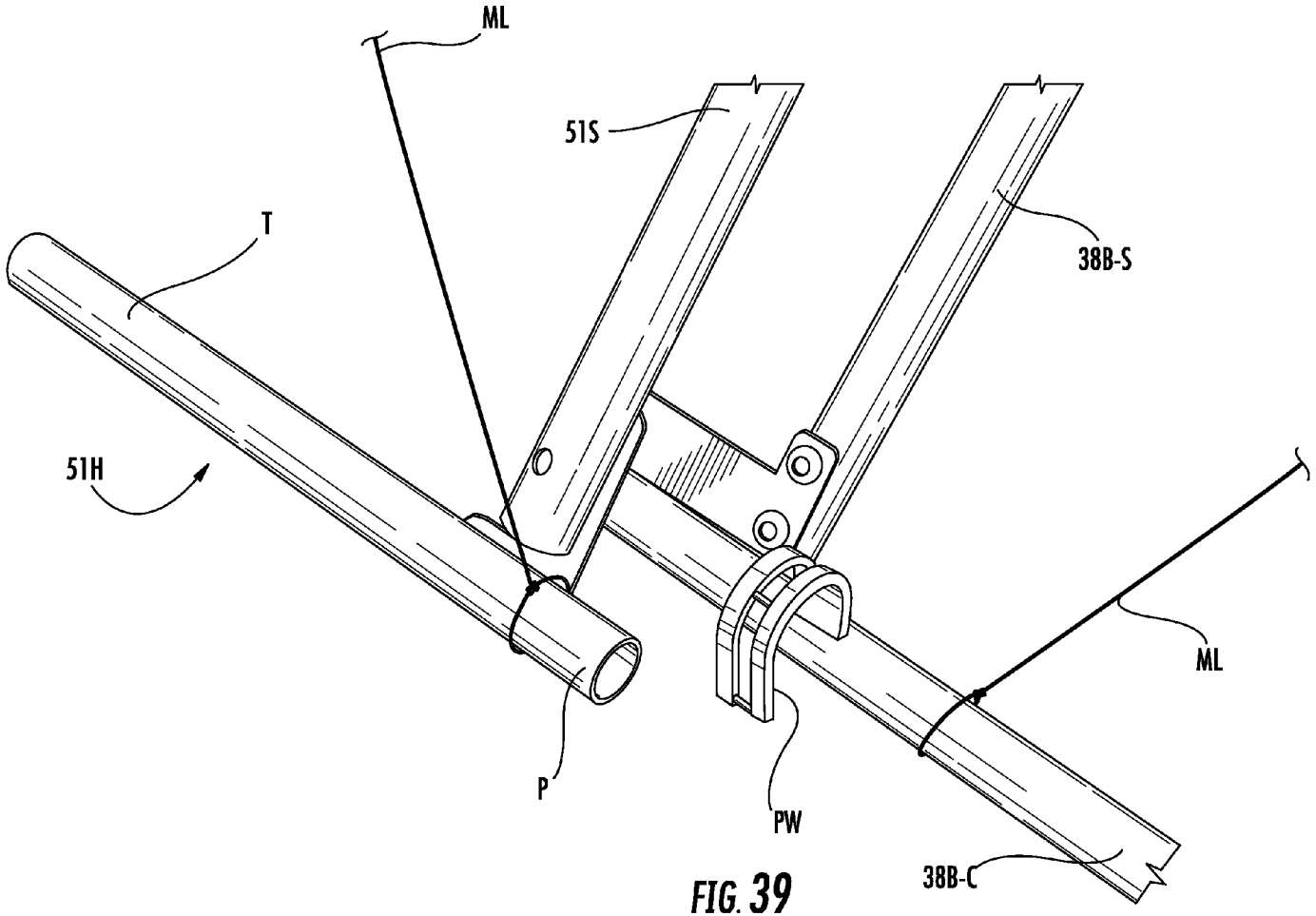
Figure 40:
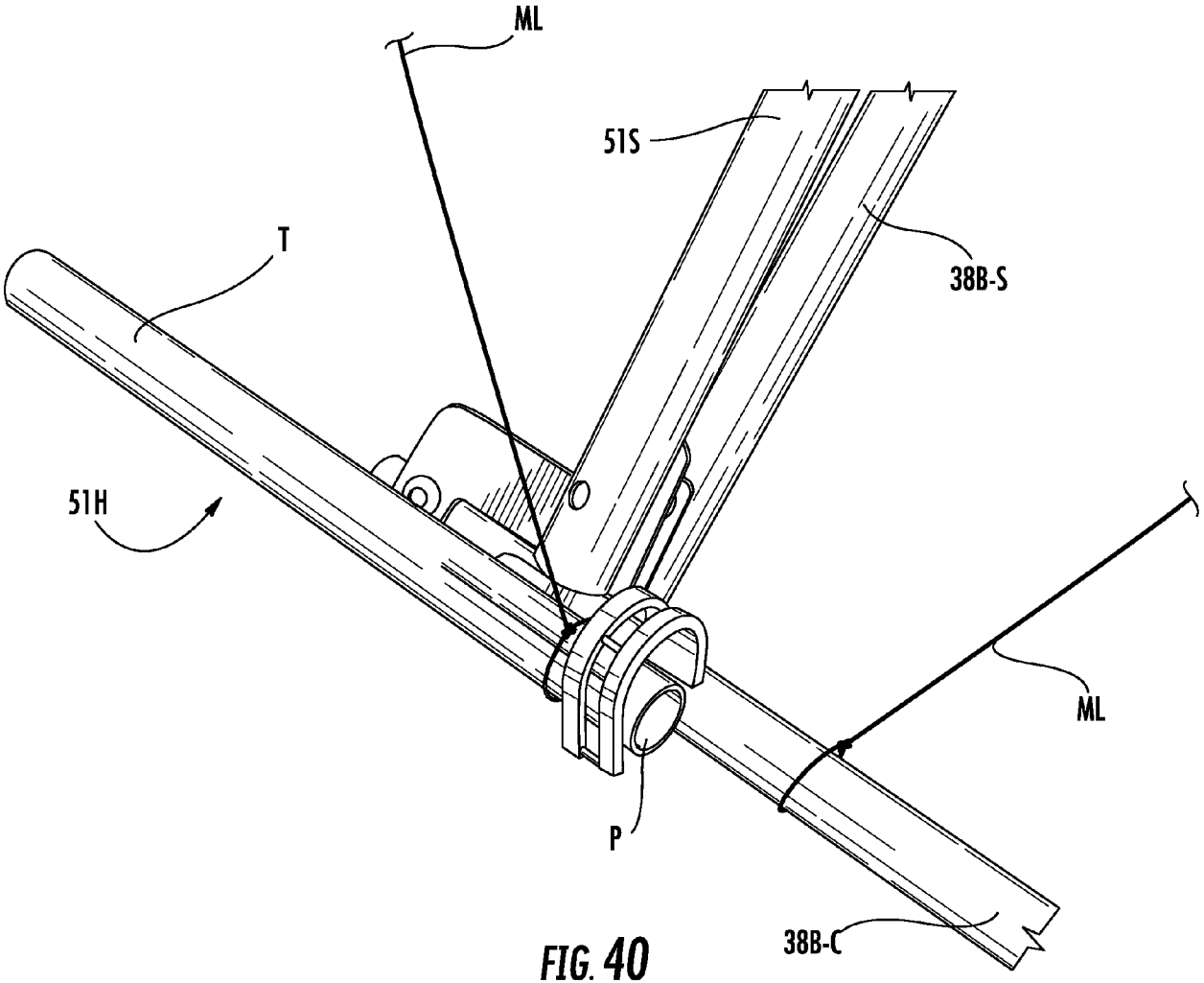

The operation of the portable barrier 10 will again be described, but with reference to FIGS. 30-45. In these figures, the flooring 40, back screen 44, and cover 52 are removed for clarity of understanding to show a framework of the portable barrier 10 that includes the legs 38A, 38B, the arms 50A, 50N, 50B, the supplemental component 51, and the junction assembly 16. Note that there are some differences between the legs 38A, 38B, the arms 50A, 50N, 50B, the supplemental component 51, and the junction assembly 16 of the embodiment of FIGS. 1-12 and the embodiment of FIGS. 30-45; however, the two embodiments are similar in the operation. One difference is the plates 17A, 17B, 17C are made of an aluminum material in the embodiment of FIGS. 1-12, while the plates 17A, 17B, 17C are made of a plastic material such as a high density polyethylene material in the embodiment of FIGS. 30-45. Another difference is the handle portion 51H of the supplemental component 51 possesses a different configuration in the embodiment of FIGS. 1-12 in comparison to the embodiment of FIGS. 30-45. Particularly, the tube segment T of the handle portion 51H is situated more rearwardly as shown in FIGS. 39-40 so as to provide a user standing behind the portable barrier 10 with ready access to the handle portion 51H.

Also note that in order to aid stability of the skeletal structure of the portable barrier 10 of FIGS. 30-45 (with the flooring 40, back screen 44, and cover 52 removed), segments of monofilament line ML (e.g. 50 lbs. fishing line) is used to retain the legs 38A, 38B and the arms 50A, 50N, 50 B, and the supplemental component 51 in their positions relative to each other. In other words, the segments of monofilament line function as the distance or movement limiters in the embodiment of FIGS. 30-45.

Figure 30:
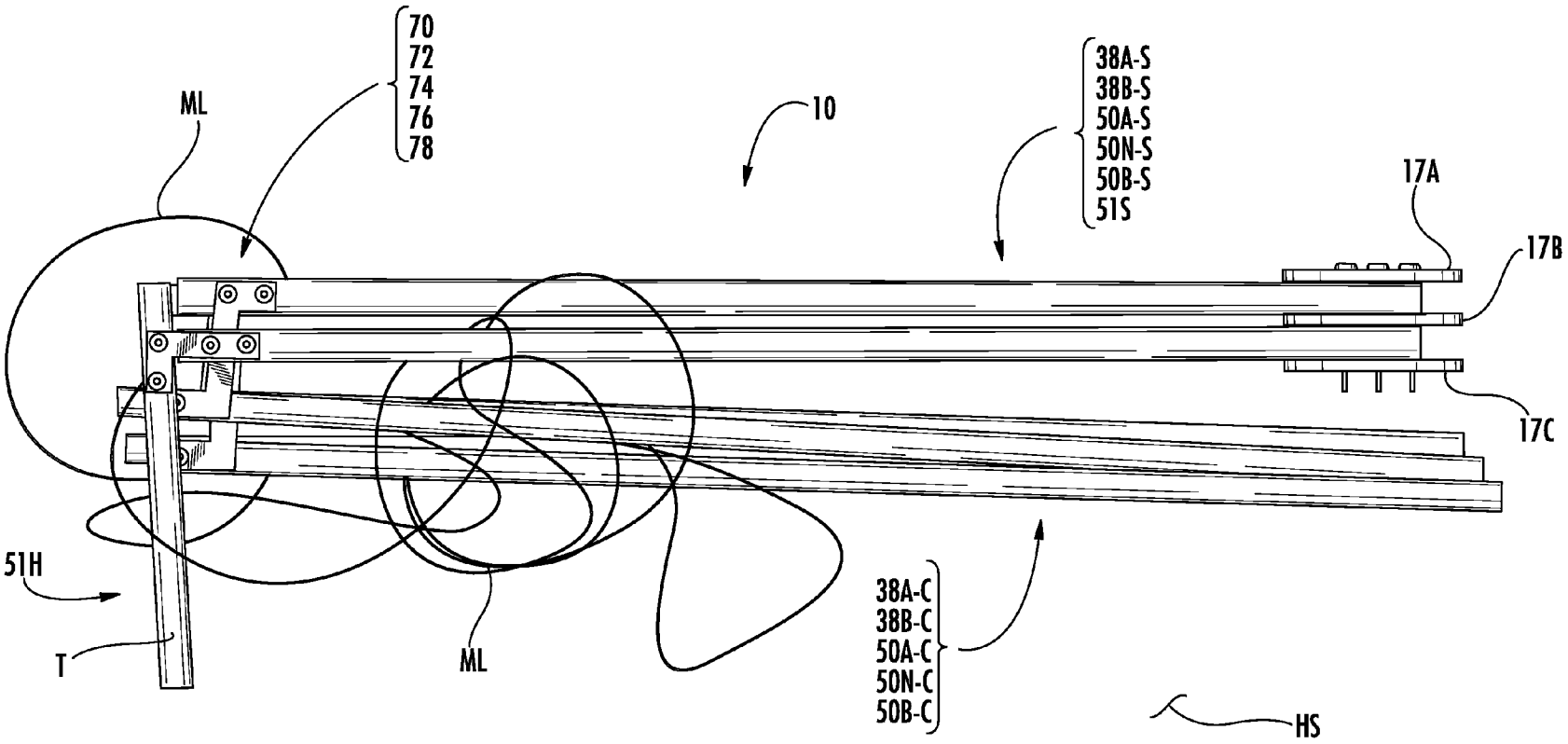
FIGS. 30-37 are perspective views of an alternative embodiment of a framework of the portable barrier of FIG. 1 shown at various intermediate stages of being moved from its storage mode to its protection mode.

Turning now to the operation of the portable barrier 10 of FIGS. 30-45, a user (e.g. the eventual occupant 26) will carry the portable barrier 10 while it is positioned in its stowed configuration and located in the carrier bag 30. Upon arriving at a use destination such as a sandy beach or near the sideline of a soccer field, the user removes the portable barrier 10 from the carrier bag 30 and places the portable barrier on a ground surface which is a substantially horizontal surface HS. FIG. 30 shows the portable barrier 10 completely removed the carrier bag and lying on the horizontal surface HS. Thereafter, the cantilevered portions 38A-C, 38B-C, 50A-C, 50N-C, 50B-C are pivoted as a group relative to the strut portions 38A-S, 38B-S, 50A-S, 50N-S, 50B-S from their position in FIG. 30 to their position in FIG. 31 about their respective hinge joints 70, 72, 74, 76, 78.

Figure 31:
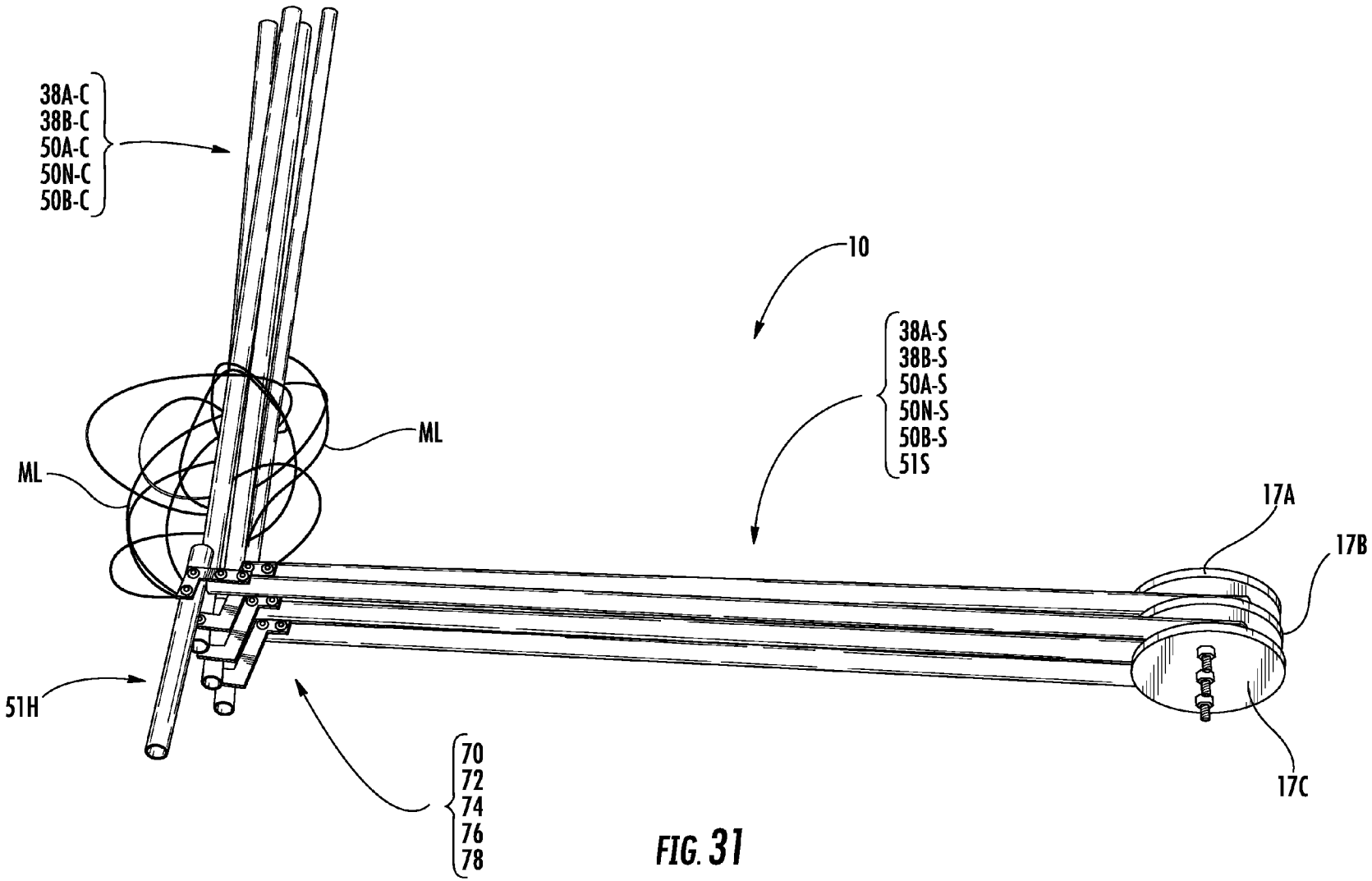

Then, the user repositions the portable barrier from its position shown in FIG. 31 to its position shown in FIG. 32 so that the junction assembly 16 is positioned above all the strut portions 38A-S, 38B-S, 50A-S, 50N-S, 50B-S, and the cantilevered portions 38A-C, 38B-C, 50A-C, 50N-C, 50B-C are positioned juxtaposed to and extend along the horizontal surface HS.

Thereafter, the legs 38A and 38B are moved away from each other from their relative position shown in FIG. 32 to their relative position shown in FIG. 33. (Note that FIGS. 18 and 19 show the relative position of the legs 38A, 38B corresponding to the views of FIGS. 32 and 33.) In this position the pedestal assembly 12 is supported on the ground or horizontal surface HS as shown in FIG. 32. Moving of the laterals legs 38A, 38B in such a manner causes the flooring (not shown) to be deployed. When deployed, the flooring (not shown) is positioned on the ground or horizontal surface so as to be supported thereby.

Then, the supplemental component 51 is moved from its position shown in FIG. 33 to its position shown in FIG. 34. (Note that FIG. 34 shows the position of the legs, arms, and supplemental component corresponding to the view of FIG. 20 with the flooring, the back screen, and the covering removed for clarity of understanding.) Moving of the supplemental component 51 in the manner described above causes the back screen (not shown) to be partially deployed. The supplemental component 51 and the arm 50B are then moved from their position in FIG. 34 to their position in FIG. 35. (Note that FIG. 35 shows the position of the legs, arms, and supplemental component corresponding to the view of FIG. 21 with the flooring, the back screen, and the covering removed for clarity of understanding.) Moving of the supplemental component 51 and arm 50B in such a manner causes the back screen (not shown) and the covering (not shown) to be partially deployed.

Thereafter, the supplemental component 51 and the arms 50B, 50N are moved from their position in FIG. 35 to their position in FIG. 36. (Note that FIG. 36 shows the position of the legs, the arms, and the supplemental component corresponding to the view of FIG. 22 with the flooring, the back screen, and the covering removed for clarity of understanding.) Moving of the supplemental component 51 and the arms 50B, 50N in the manner described above causes the back screen (not shown) and the covering (not shown) to be further partially deployed.

Then, the supplemental component 51 and the arms 50B, 50N, 50B are moved from their position in FIG. 36 to their position in FIG. 37. (Note that FIG. 37 shows the position of the legs, the arms, and the supplemental component corresponding to the view of FIG. 23 with the flooring, the back screen, and the covering removed for clarity of understanding.) Moving of the supplemental component 51 and the arms 50B, 50N, 50B in the manner described above causes the back screen (not shown) and the covering (not shown) to be essentially fully deployed. When fully deployed, the covering (not shown) is supported above the flooring (not shown) and the ground or horizontal surface HS.

Figure 6:
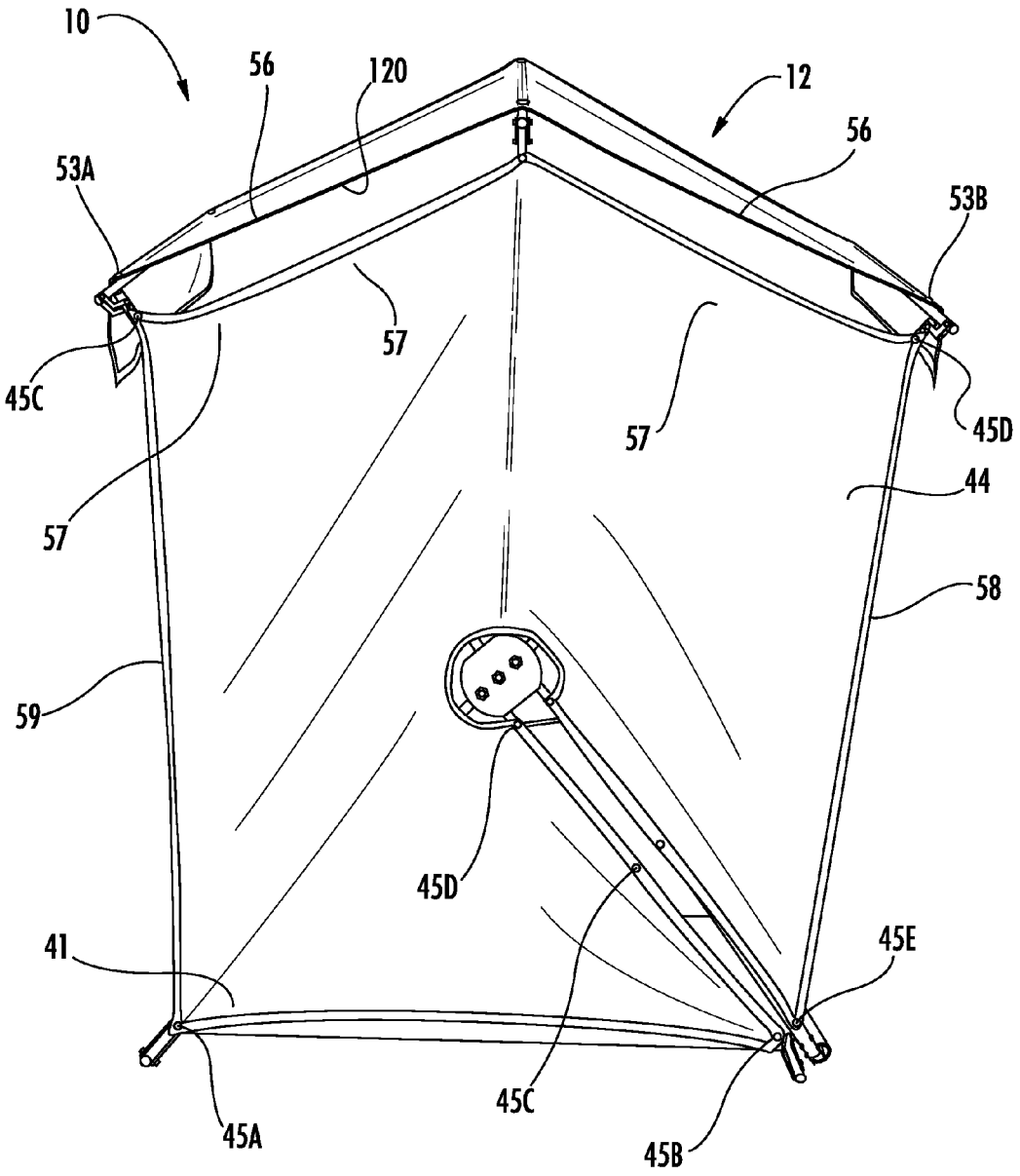
Figure 7:
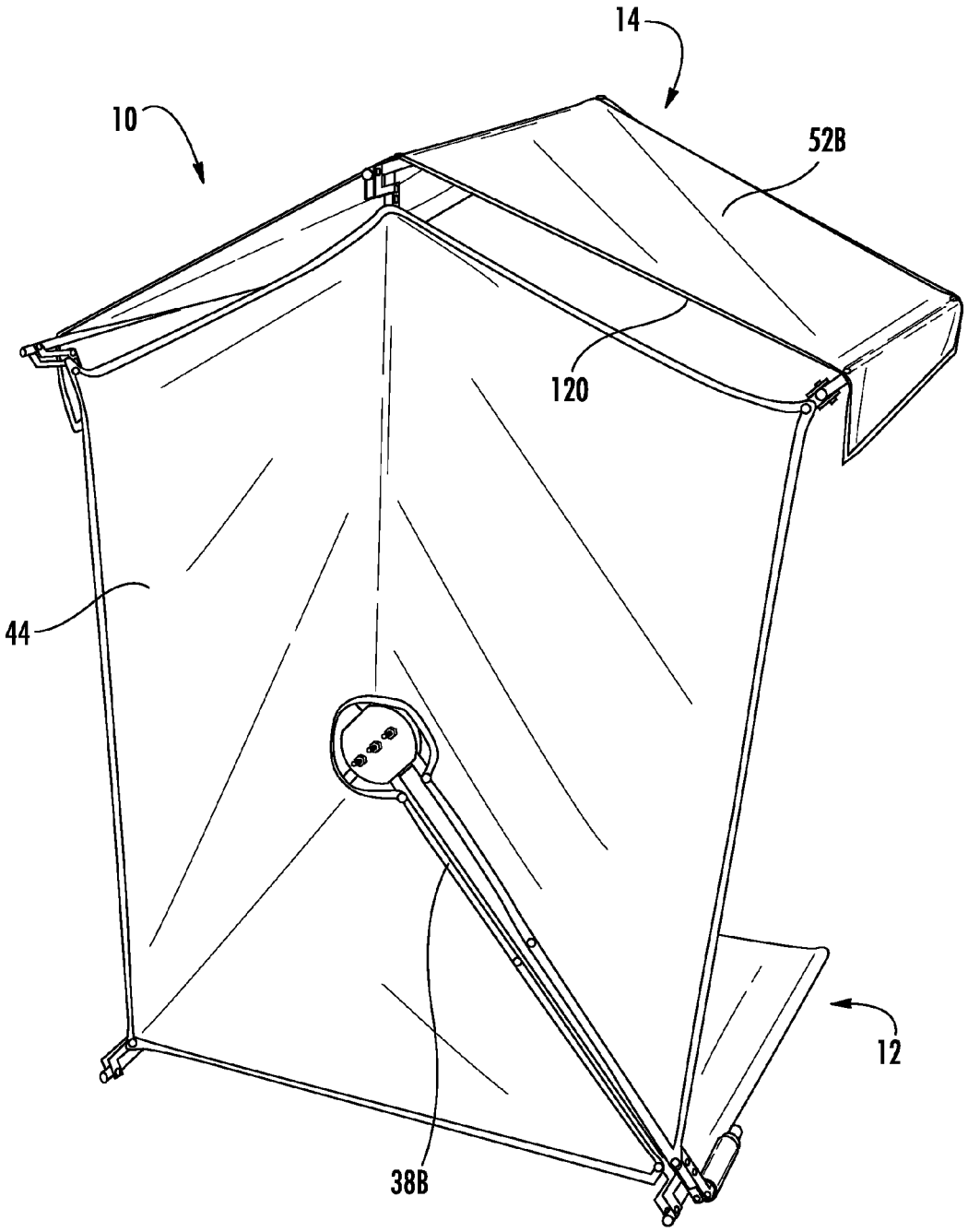
Figure 38:
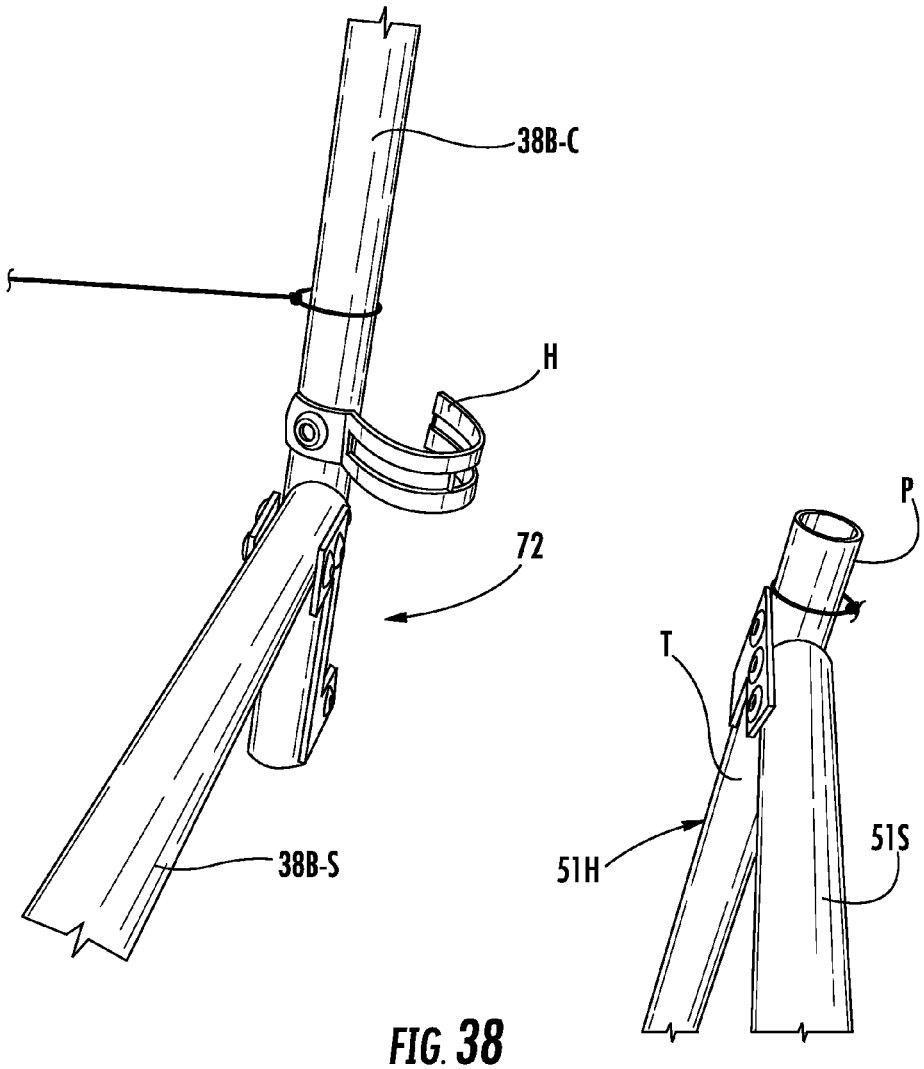
FIGS. 38-40 are perspective views of the handle portion of the framework of FIGS. 30-37.
Figure 42:
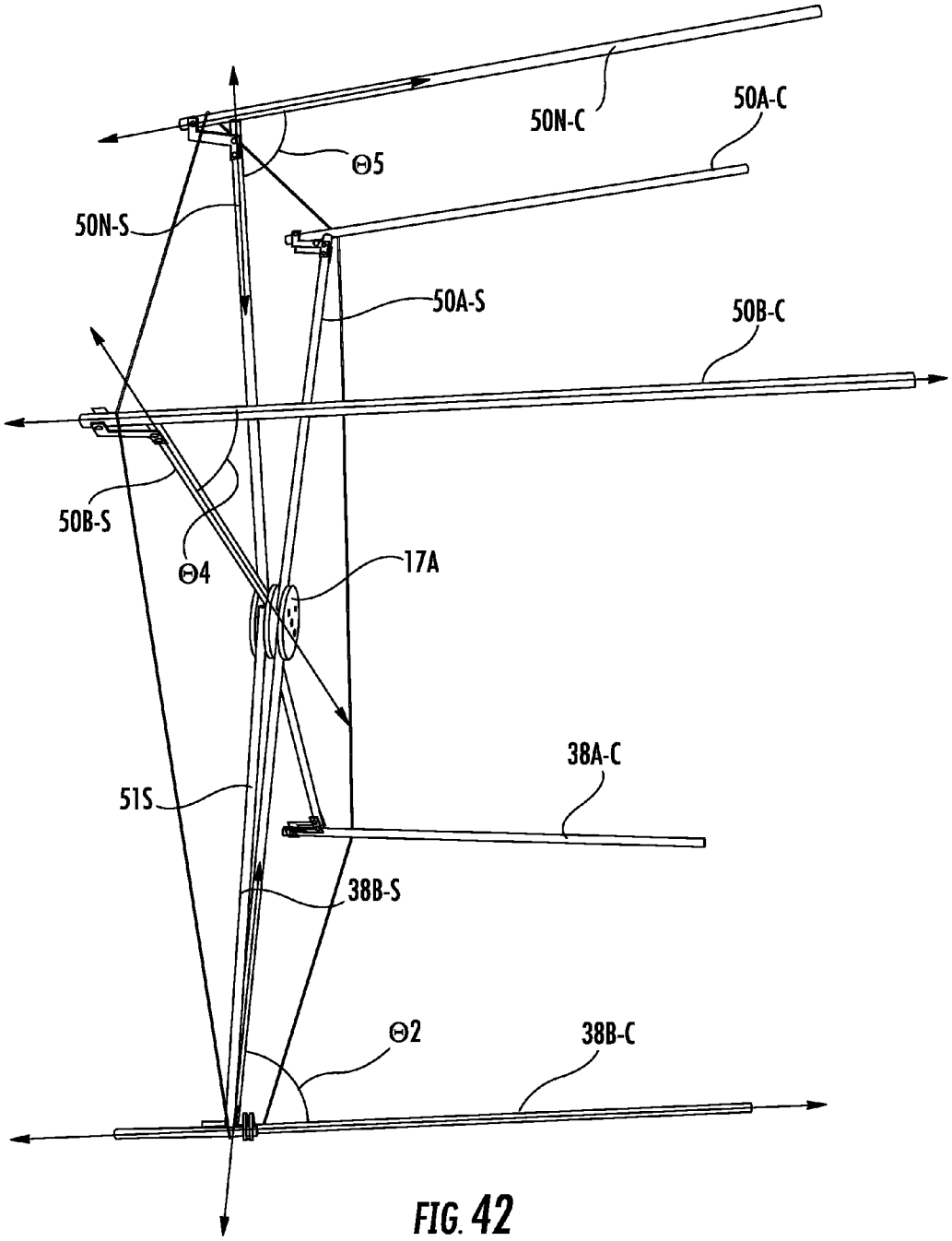
Figure 43:
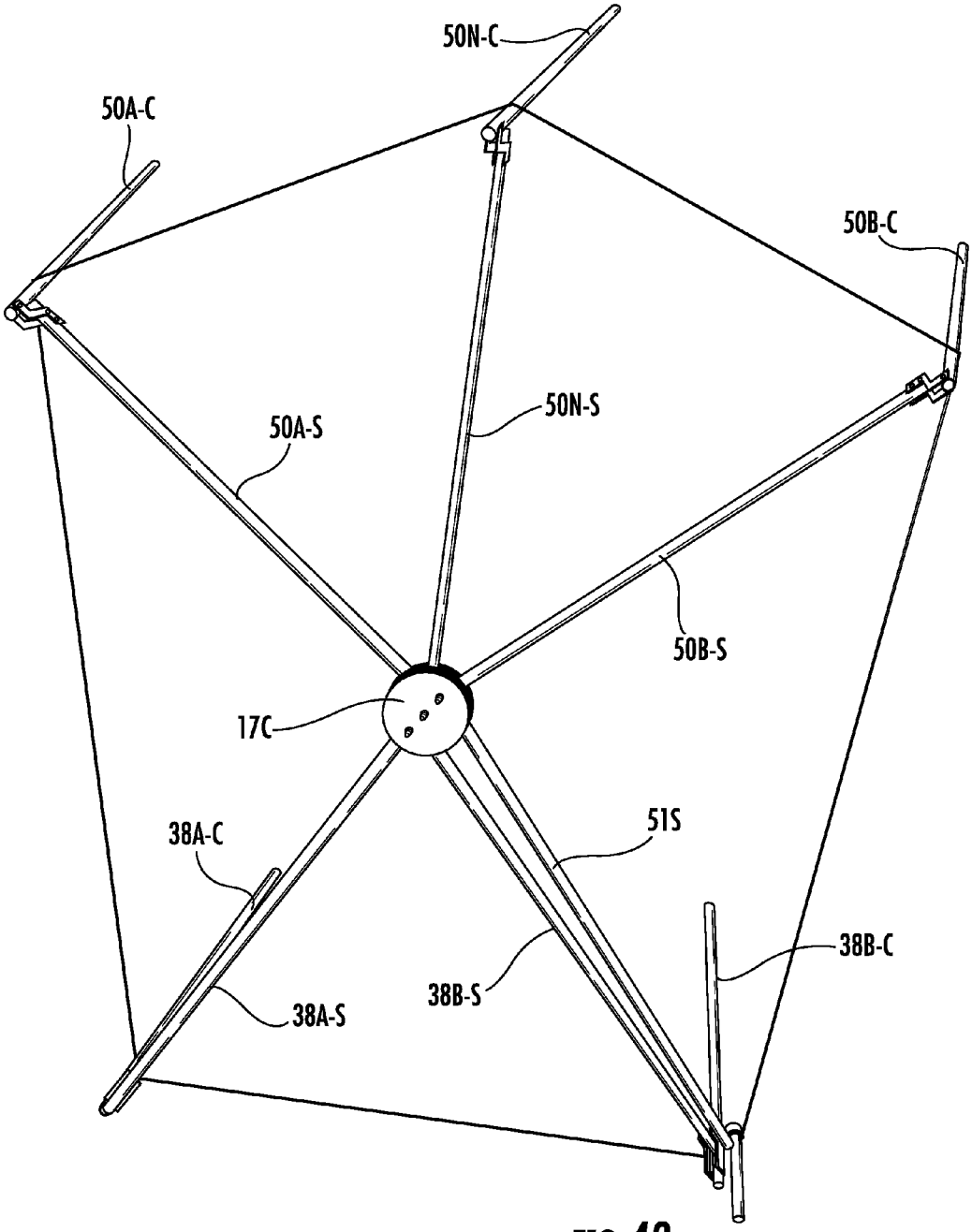
Figure 44:
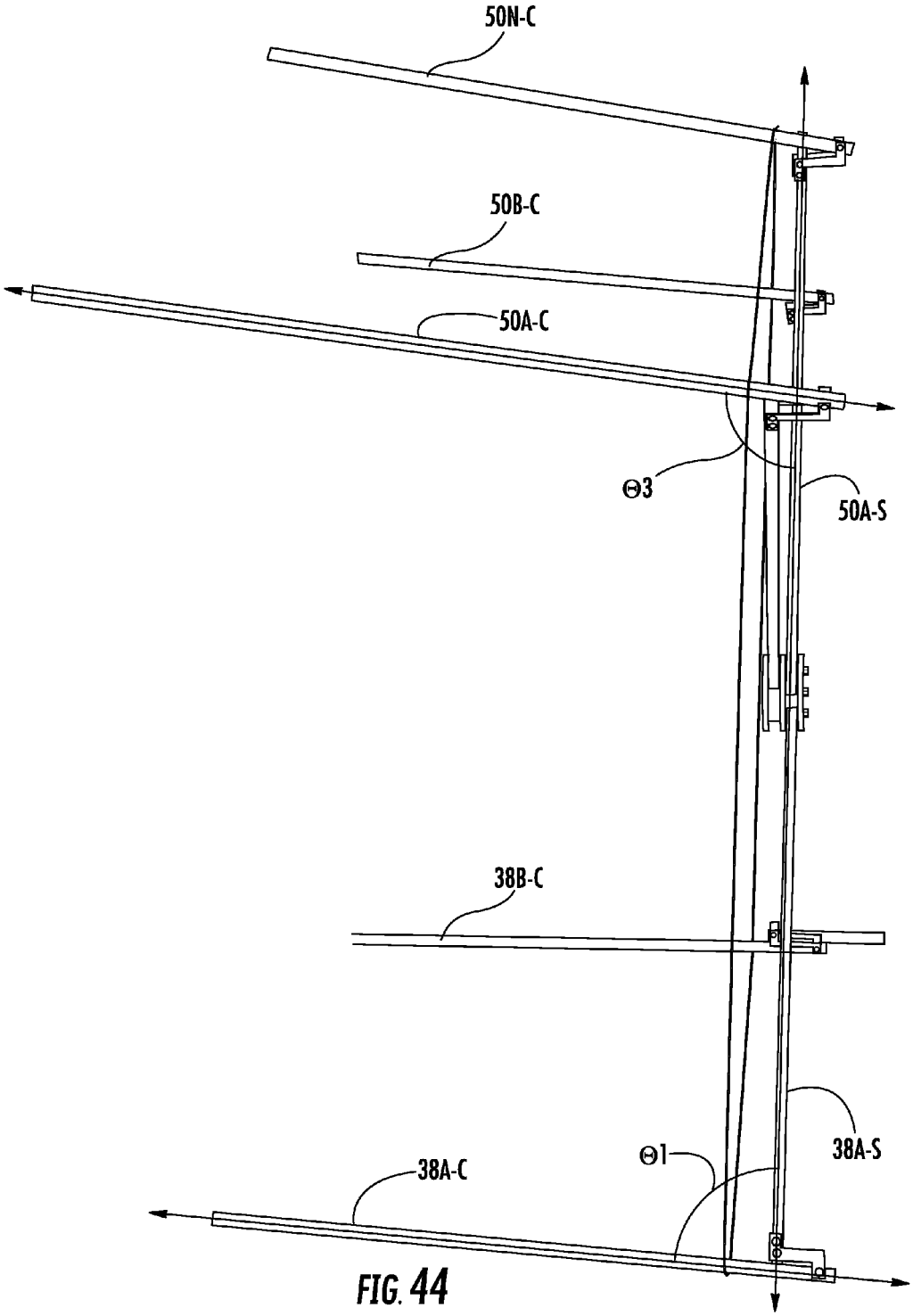

Then, the handle portion 51H is moved from its position shown in FIG. 38 to its position shown in FIG. 40 so as to locate the projection P within the passageway PW defined by the hook H thereby securing the portable barrier 10 in its protection state. FIGS. 41-45 show various views of the portable barrier in its protection mode of operation. Note that the following views of the embodiment of FIGS. 41-45 show the position of the legs, the arms, and the supplemental component corresponding to the following views of the embodiment of FIGS. 1-12 with the flooring, the back screen, and the covering removed for clarity of understanding: FIG. 41-FIG. 1; FIG. 42-FIG. 9; FIG. 43-FIG. 6; FIG. 44-FIG. 4; and FIG. 45-FIG. 2.

Hinge Joints

Figure 69:
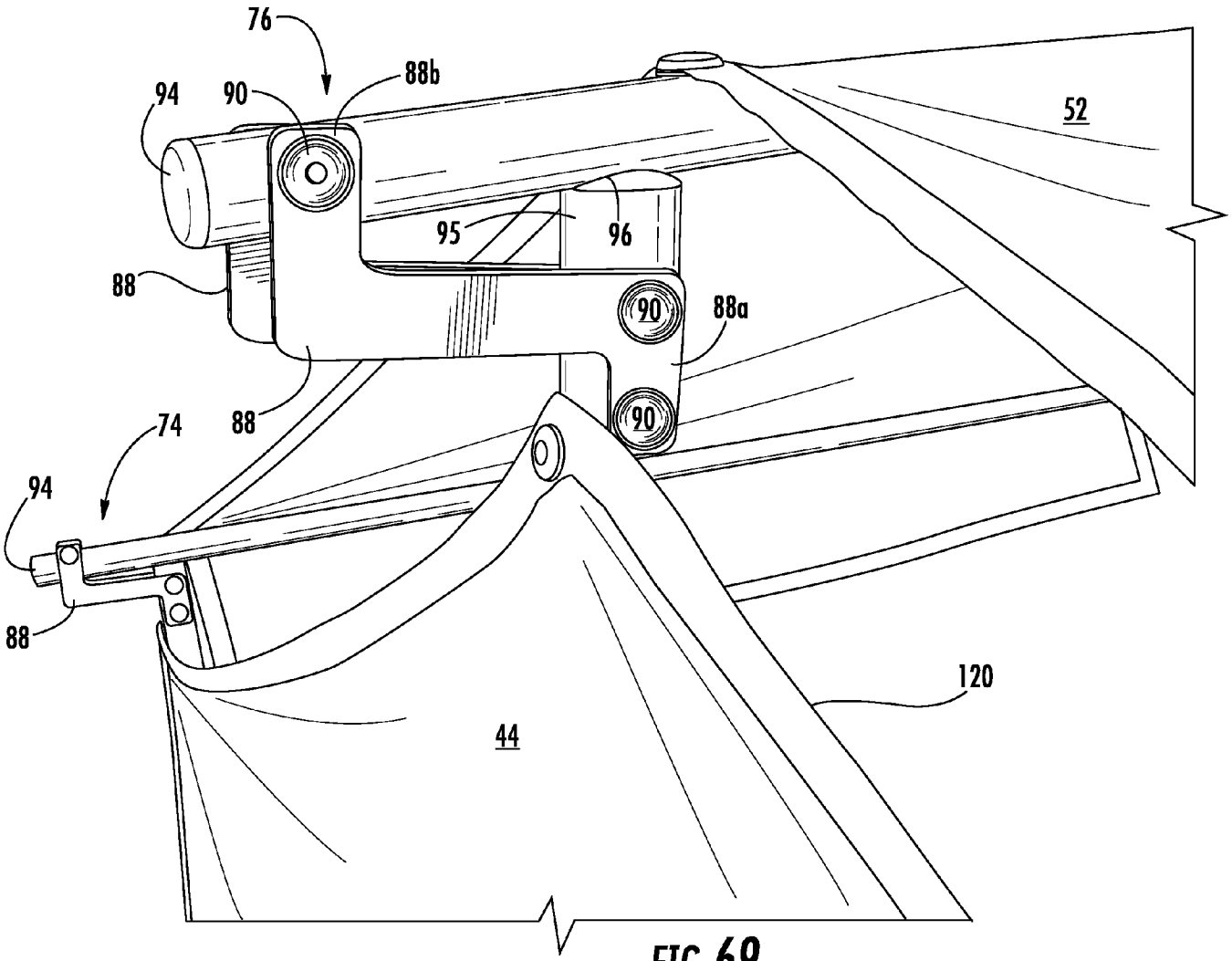
Figure 70:
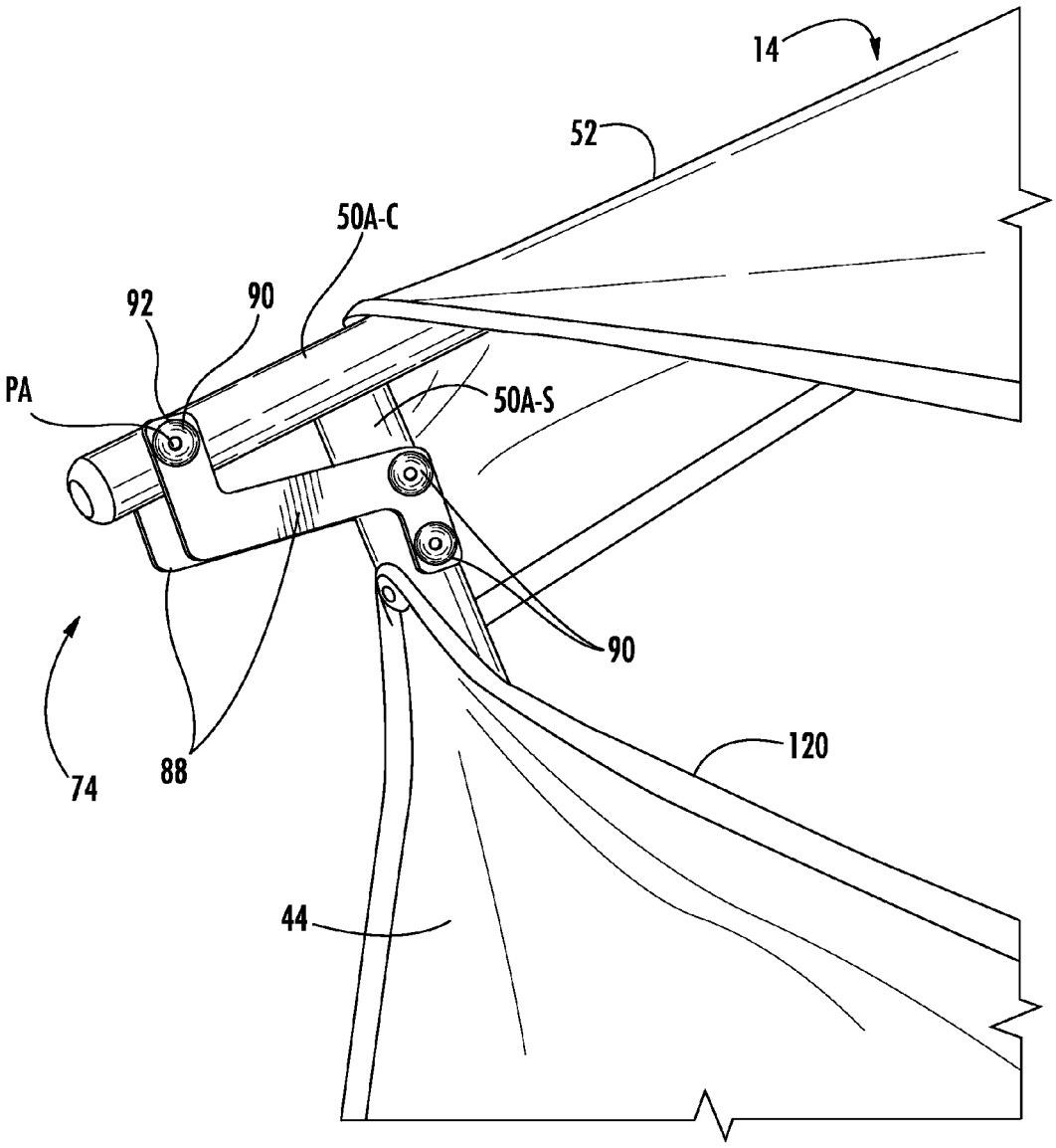
Figure 71:
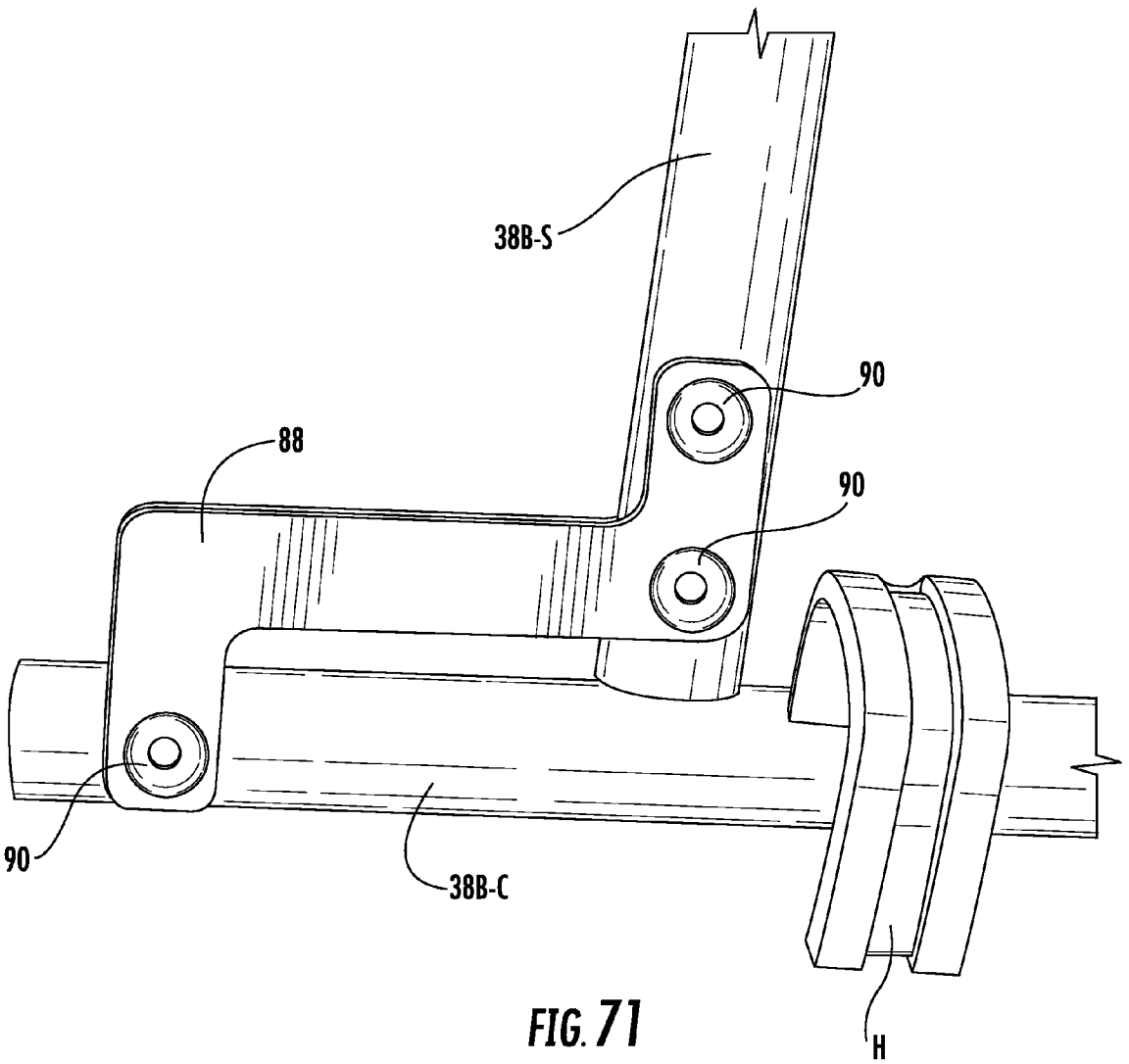
FIGS. 71-80 are perspective views of the framework of FIGS. 30-37 or portions of the framework of FIGS. 30-37, with the portable barrier positioned in its protection mode of operation.
Figure 72:
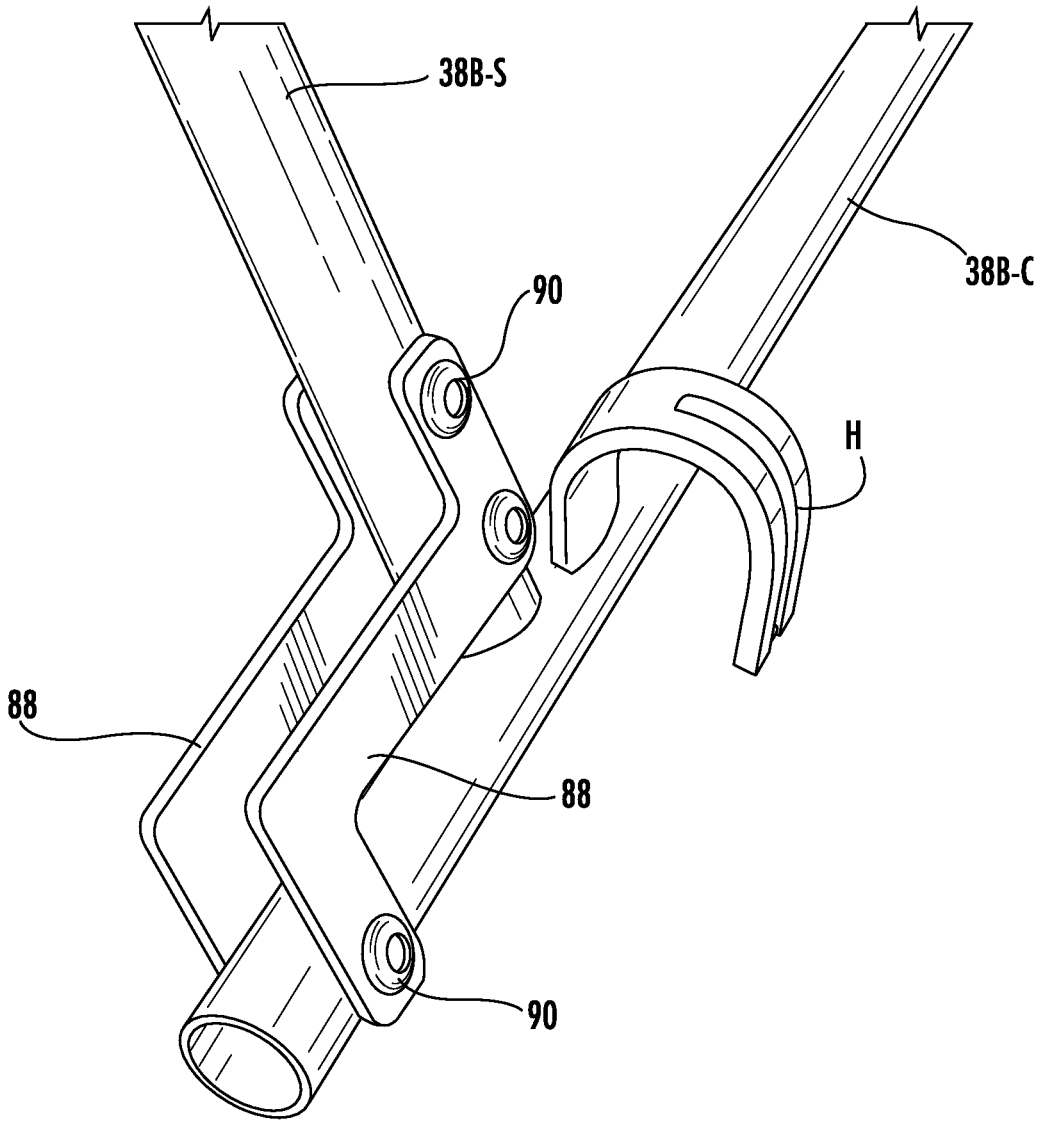
Figure 73:
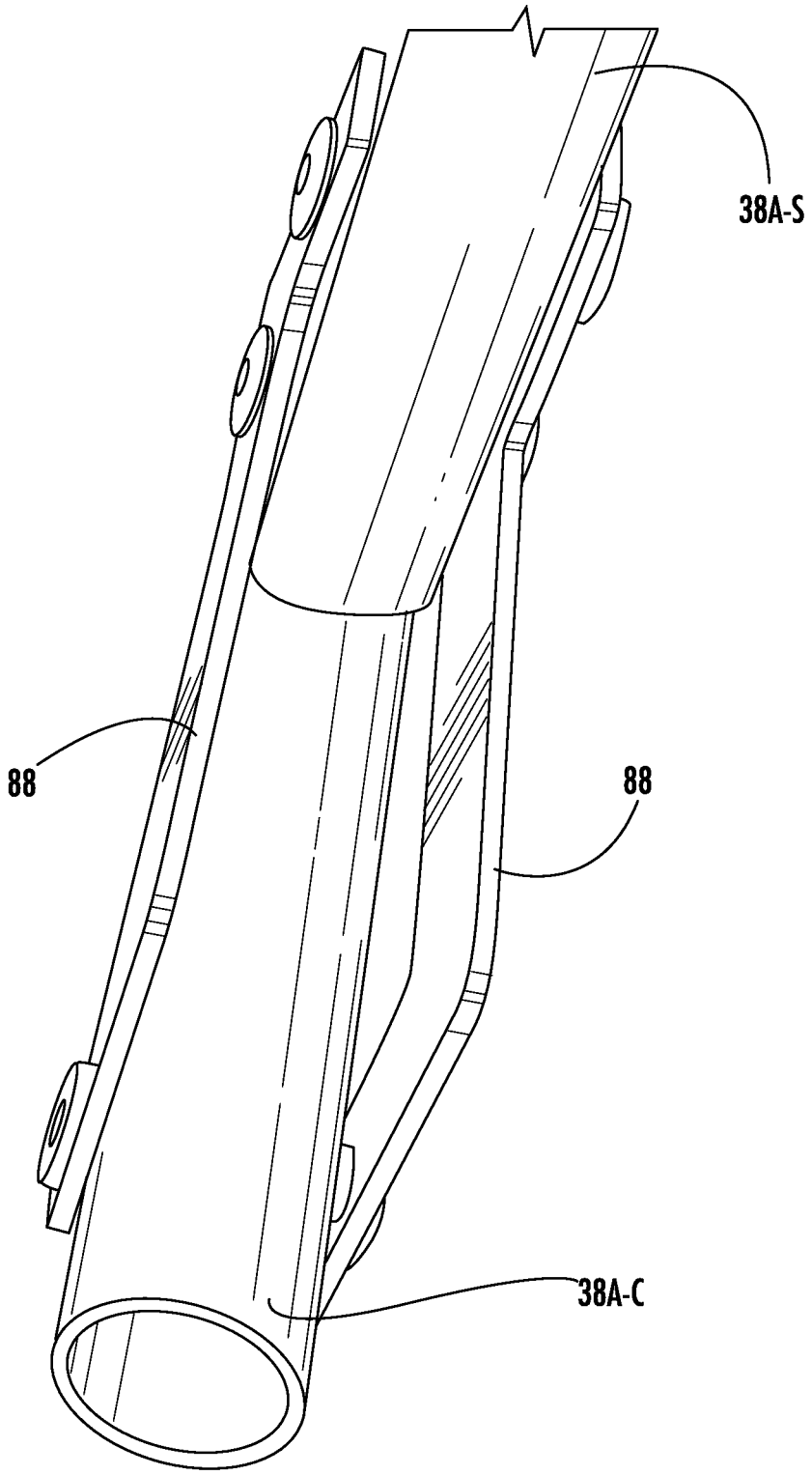
Figure 74:
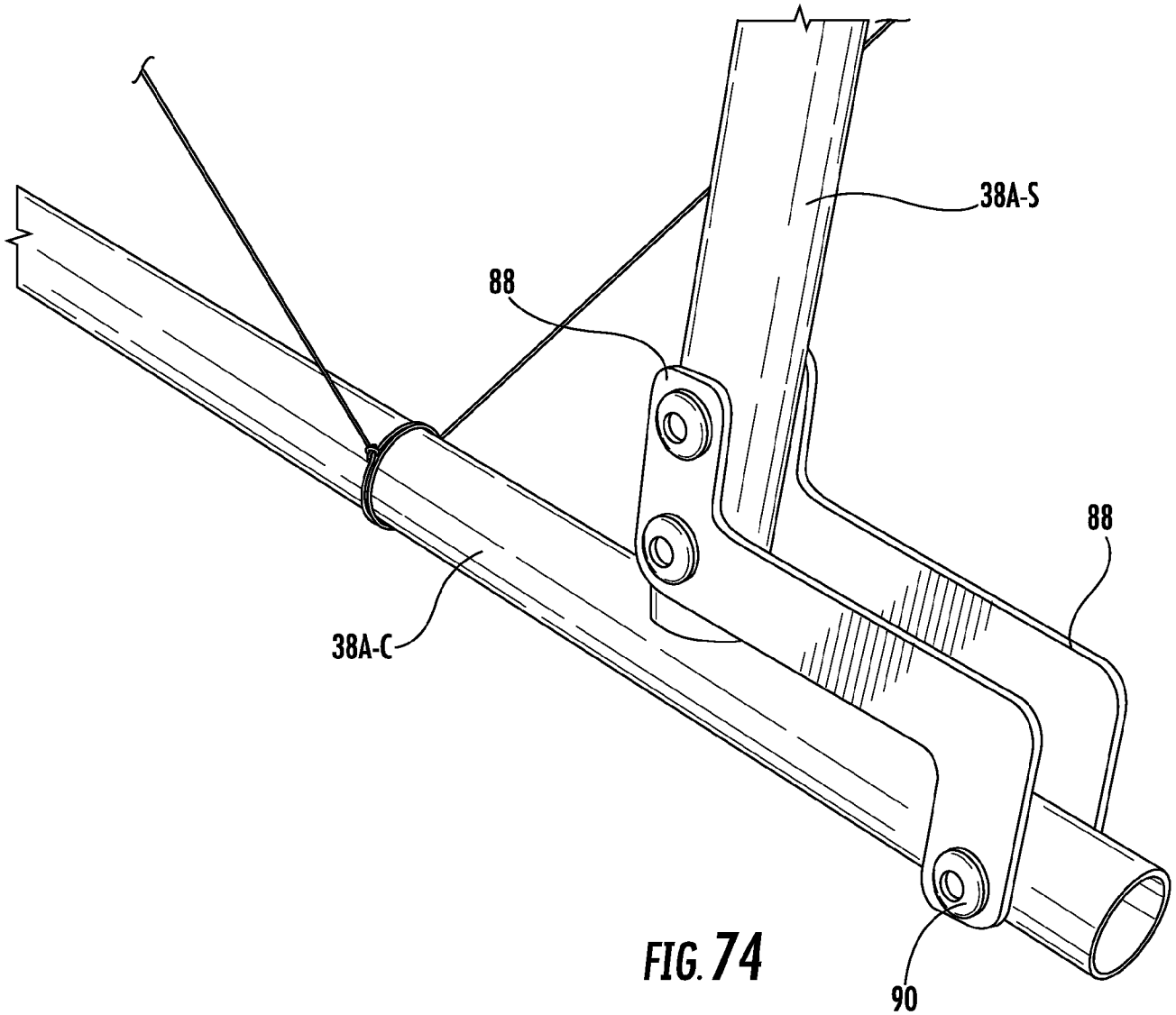
Figure 75:
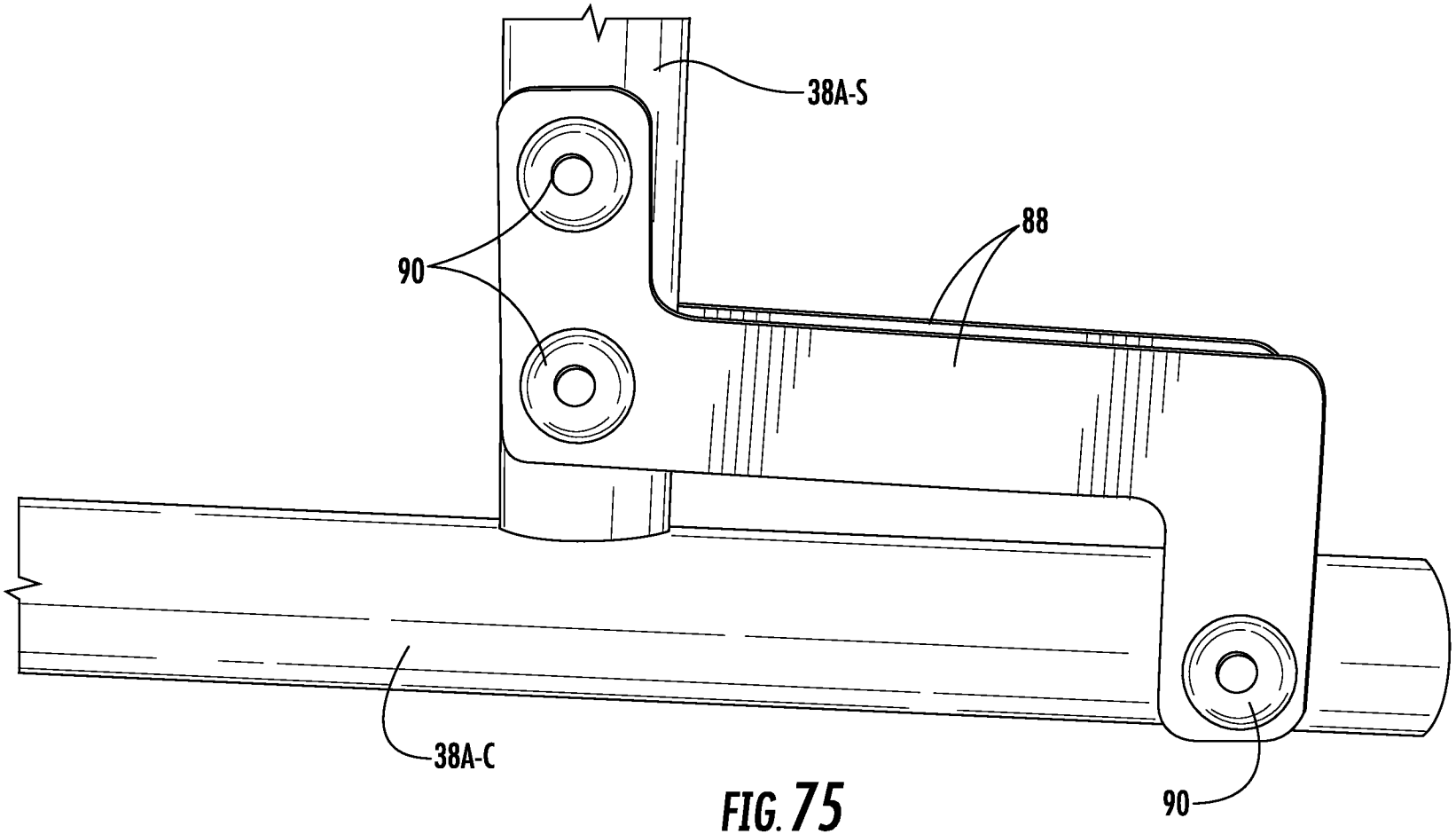
Figure 76:
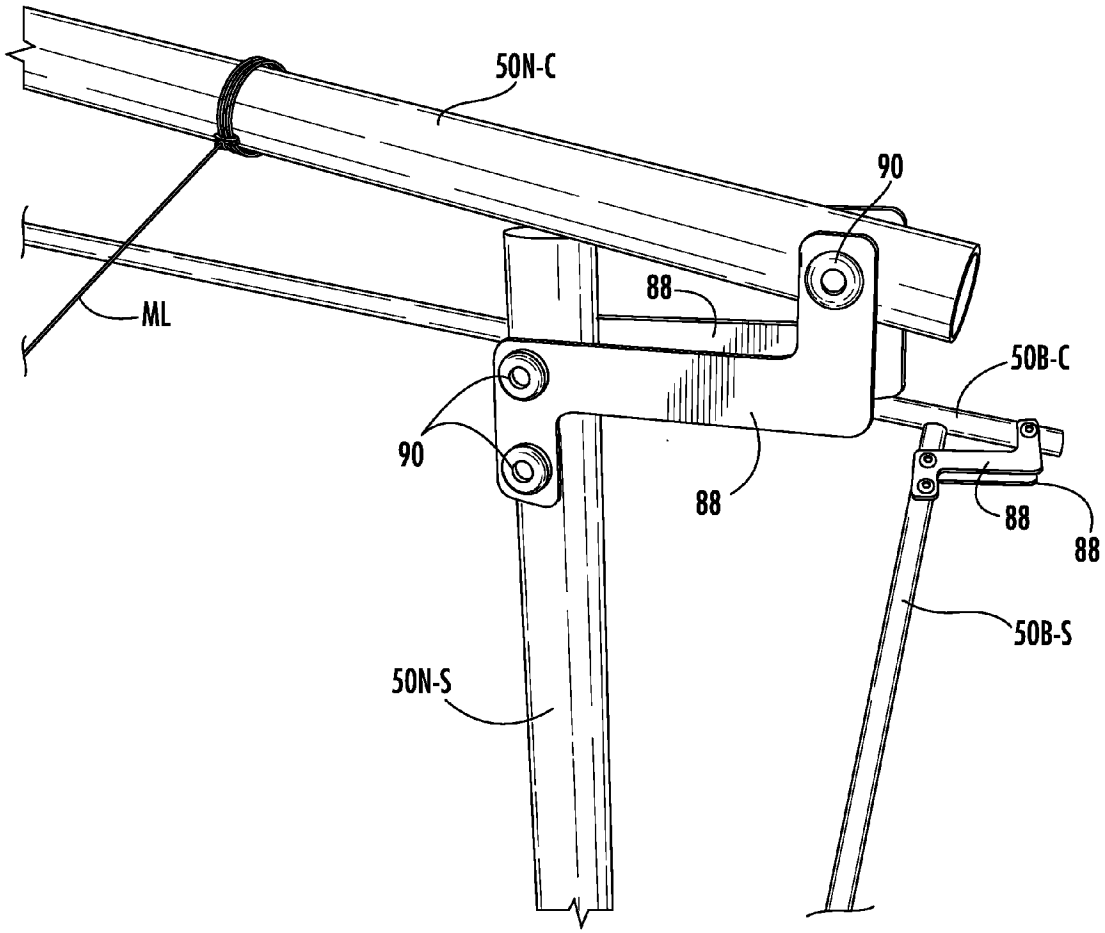
Figure 77:
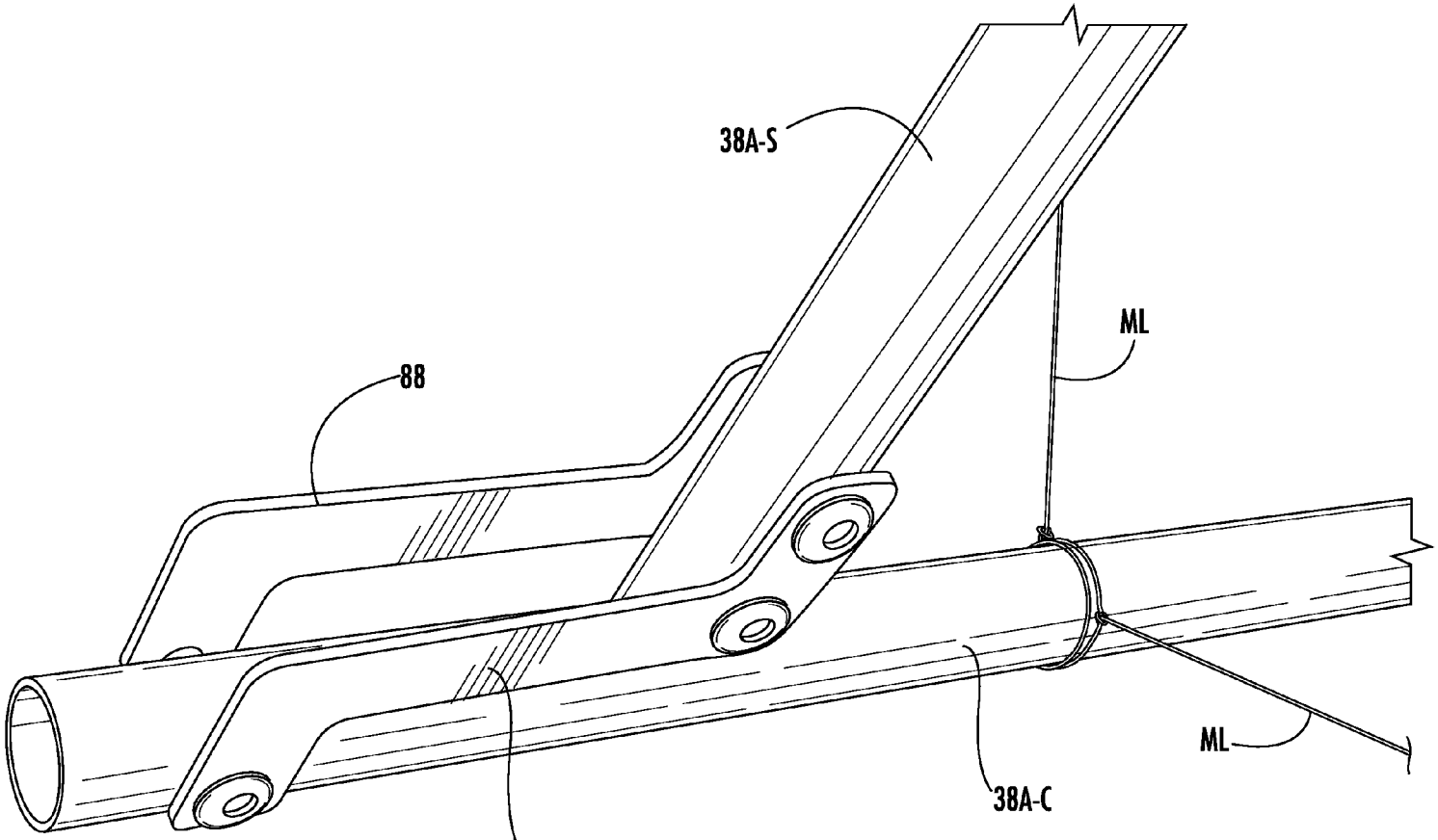

The portable barriers include five hinge joints 70, 72, 74, 76, 78. Each hinge joint possesses essentially the same configuration so only one hinge joint will be described in detail in this section. In particular, FIG. 70 shows the hinge joint 74 in detail. (See also FIG. 69 showing the hinge joint 76 in detail.) The hinge joint 74 includes two brackets 88 that are spaced apart from each other as shown in FIG. 70. The lower part of the bracket 88*a* is fastened with rivets 90 to the strut portion 50A-S, while the upper part of the bracket 88*b* is fastened to the cantilevered portion 50A-C as shown in FIG. 70. With the arm 50A so assembled, the cantilevered portion 50A-C is configured to pivot in relation to the strut portion 50A-S about a pivot axis PA defined the rivet 90. (See, e.g., FIG. 70.) In contrast, the brackets 88 are secured in fixed relation to the strut portion 50A-S by the use of two rivets 90.

Components and Subassemblies

Figure 46:
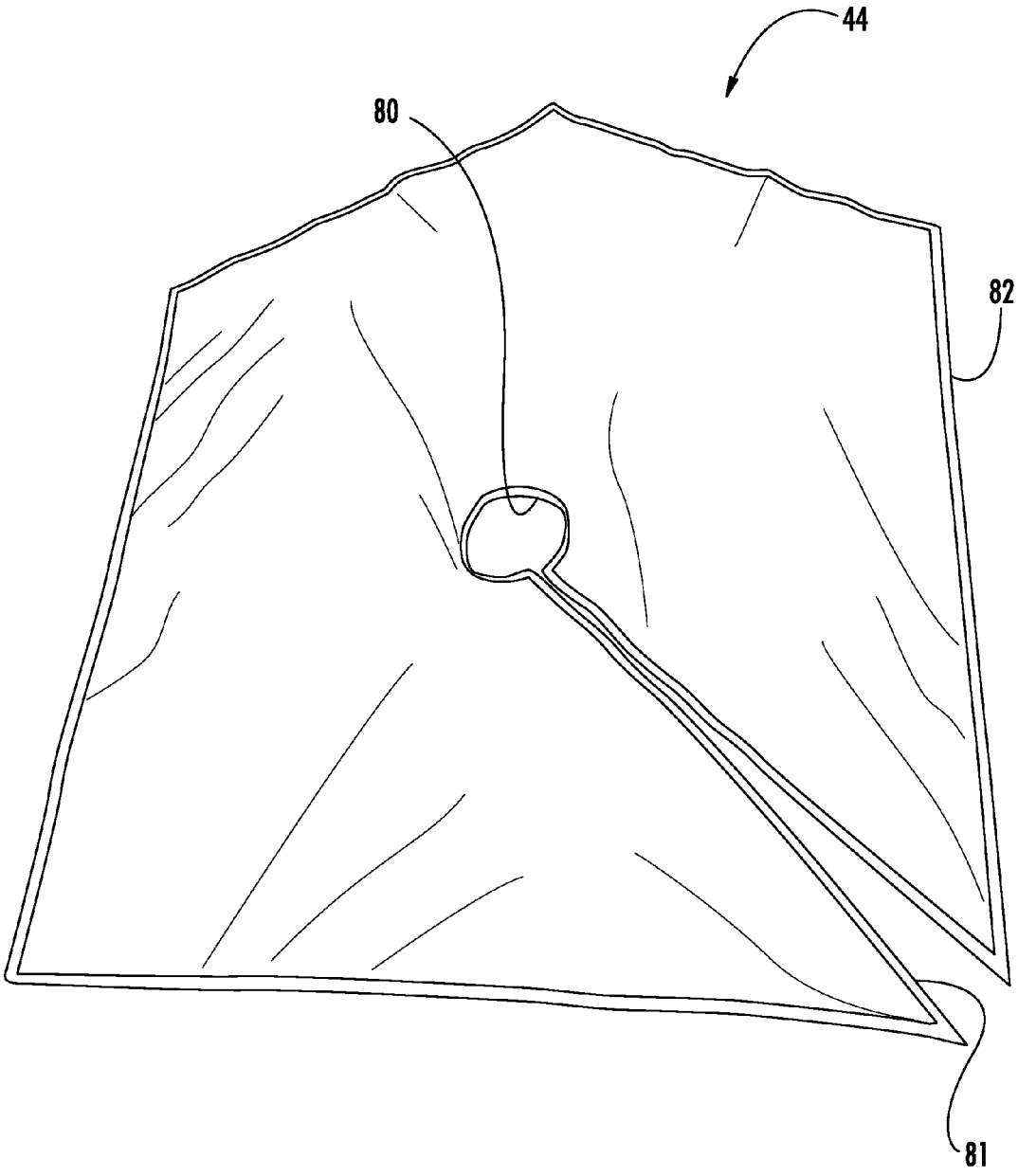
FIGS. 46-47 are perspective views of the back screen of the portable barrier of FIG. 1.
Figure 47:
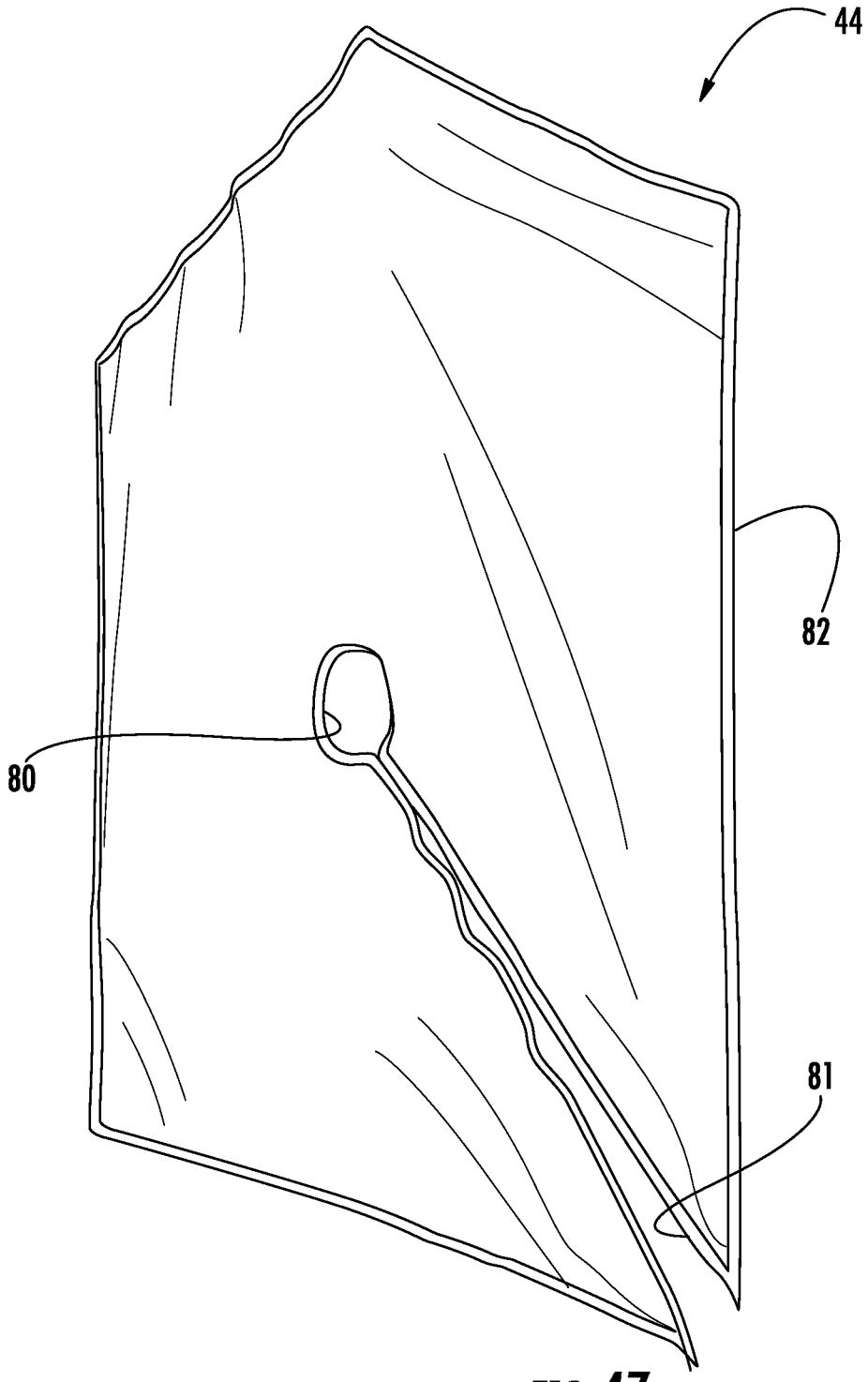

FIGS. 46-47 show views of the cover assembly 44. The back screen 44 is generally pentagonal shaped and defines an opening 80 and a slot 81. The back screen 44 further includes a border member or piping 82. FIG. 48 shows the covering 52. The covering 52 is generally rectangular shaped. The cover 52 also includes a border member or piping 55. The covering defines a first cover segment or portion 52A and a second cover segment or portion 52B. The cover segment 52A and the cover segment 52B are formed integrally with one another as a single sheet as shown in FIG. 48.

Figure 49:
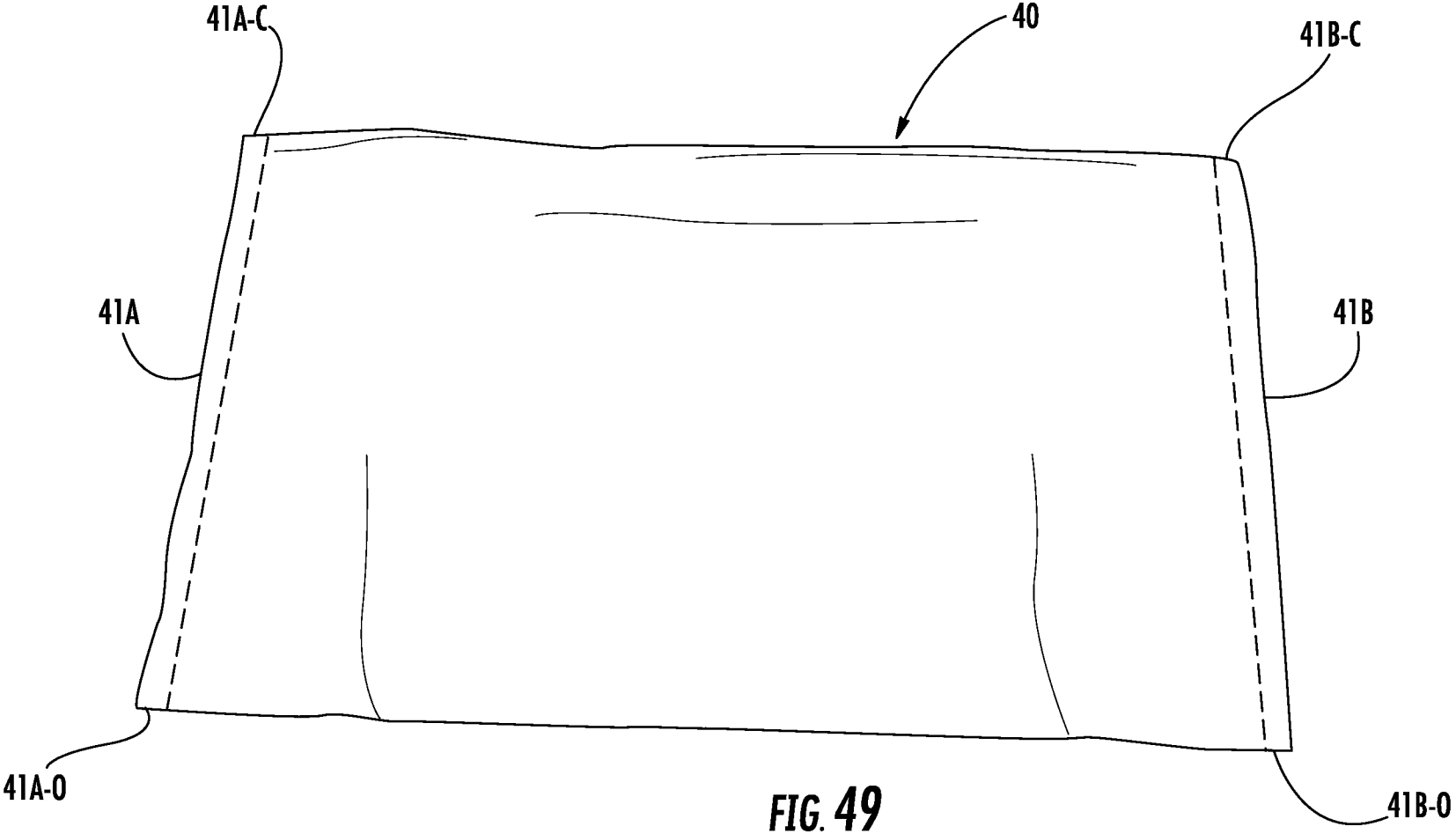
FIG. 49 is a perspective view of the flooring of the portable barrier of FIG. 1.
Figure 50:
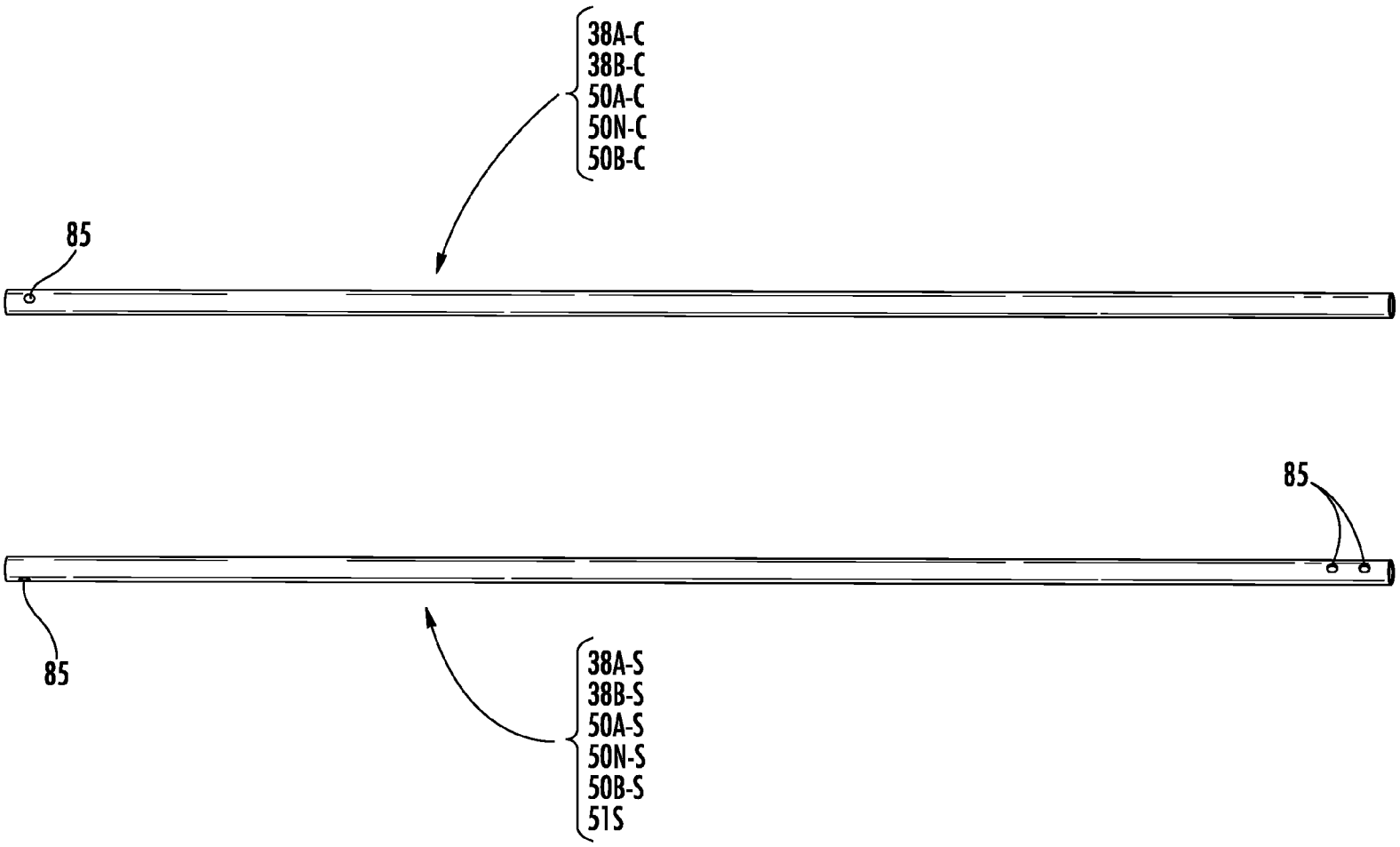
FIGS. 50-52 are perspective views of the strut portions and cantilevered portions of the portable barrier of FIG. 1.
Figure 51:
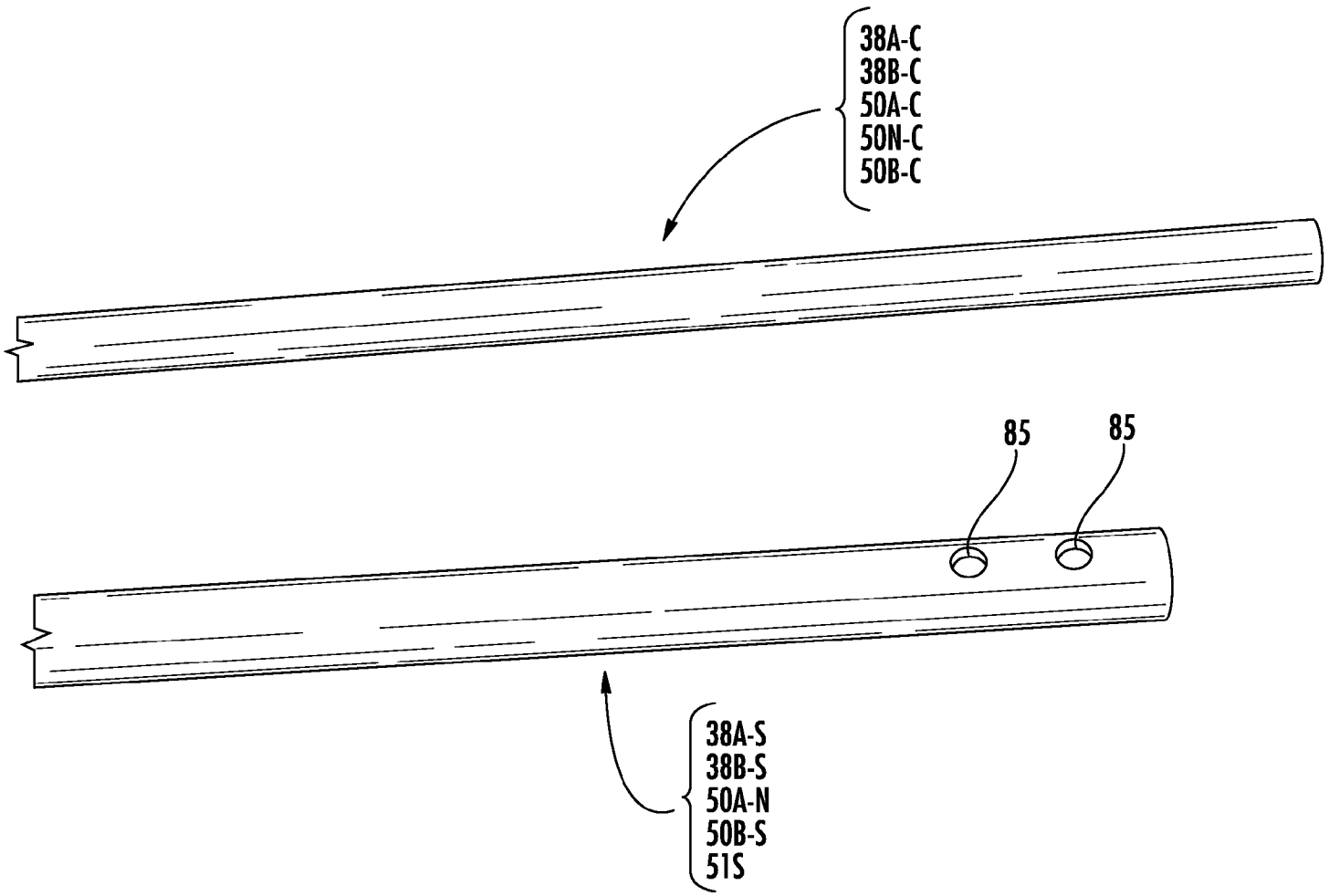
Figure 52:
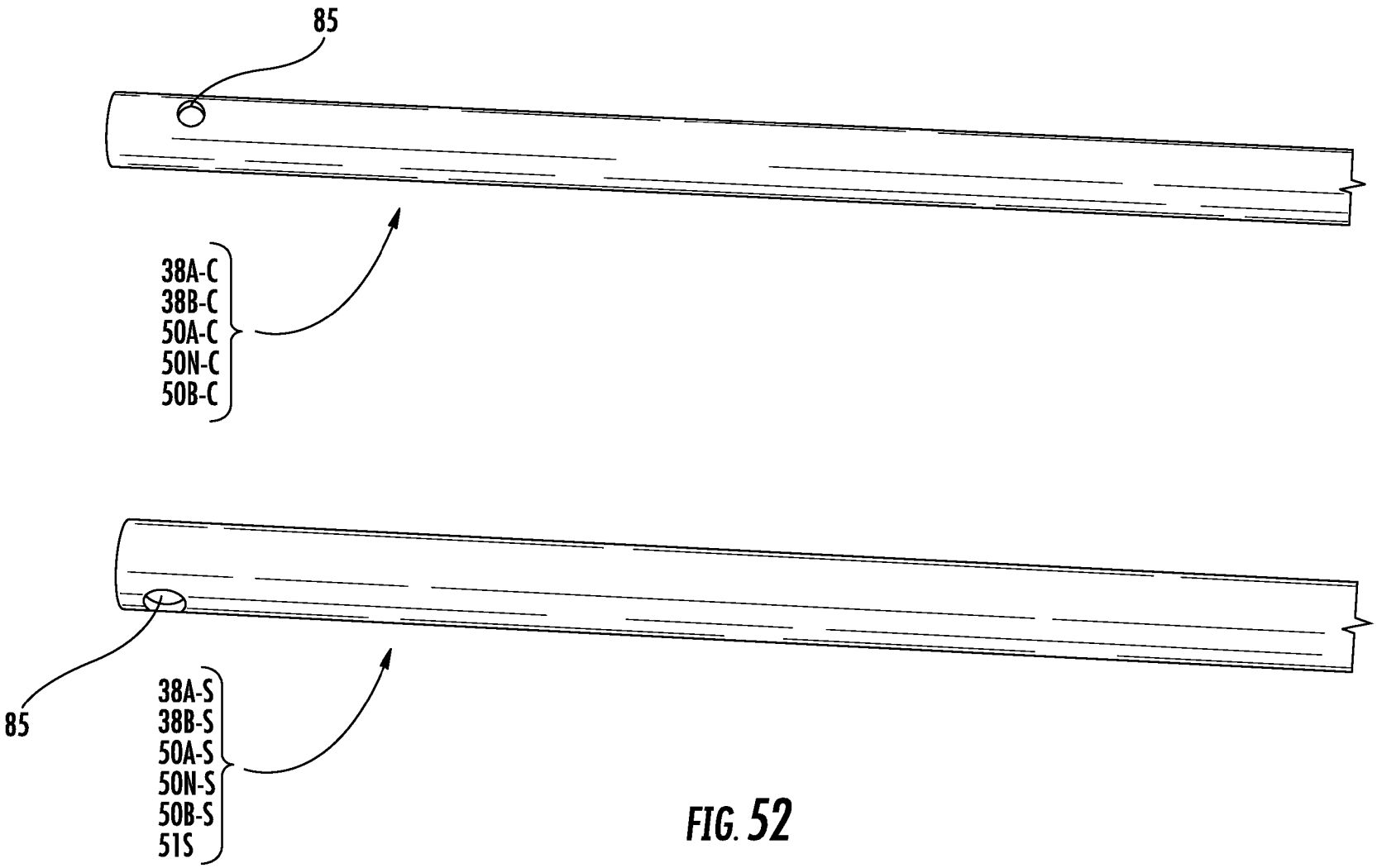

The flooring 40 is shown in FIG. 49. The flooring 40 defines a pocket structure 41A which is configured to receive the leg 38A therein, and another pocket structure 41B which is configured to receive the leg 38A. The pocket structure 41A includes an opening end 41A-O and a closed end 41A-C. Similarly, the pocket structure 41B includes an opening end 41B-O and a closed end 41B-C. FIG. 50 shows the strut portions 38A-S, 38B-S, 50A-S, 50N-S, 50B-S, 51S, as well as the cantilevered portions 38A-C, 38B-C, 50A-C, 50N-C, 50B-C. The strut portions are ⅝" diameter aluminum tubes (e.g. aluminum tubes) that extend for a distance of 30 inches, while the cantilevered portions are ⅝" diameter tubes (e.g. aluminum tubes) that extend for a distance of 33.5 inches. Each of the strut portions and the cantilevered portions has a number of fastener openings 85 defined therein which are configured to receive rivets therethrough. FIG. 51 shows the right side of the strut portions and the cantilevered portions in relation to FIG. 50, while FIG. 52 shows the left side of the strut portions and the cantilevered portions in relation to FIG. 50.

Figure 53:
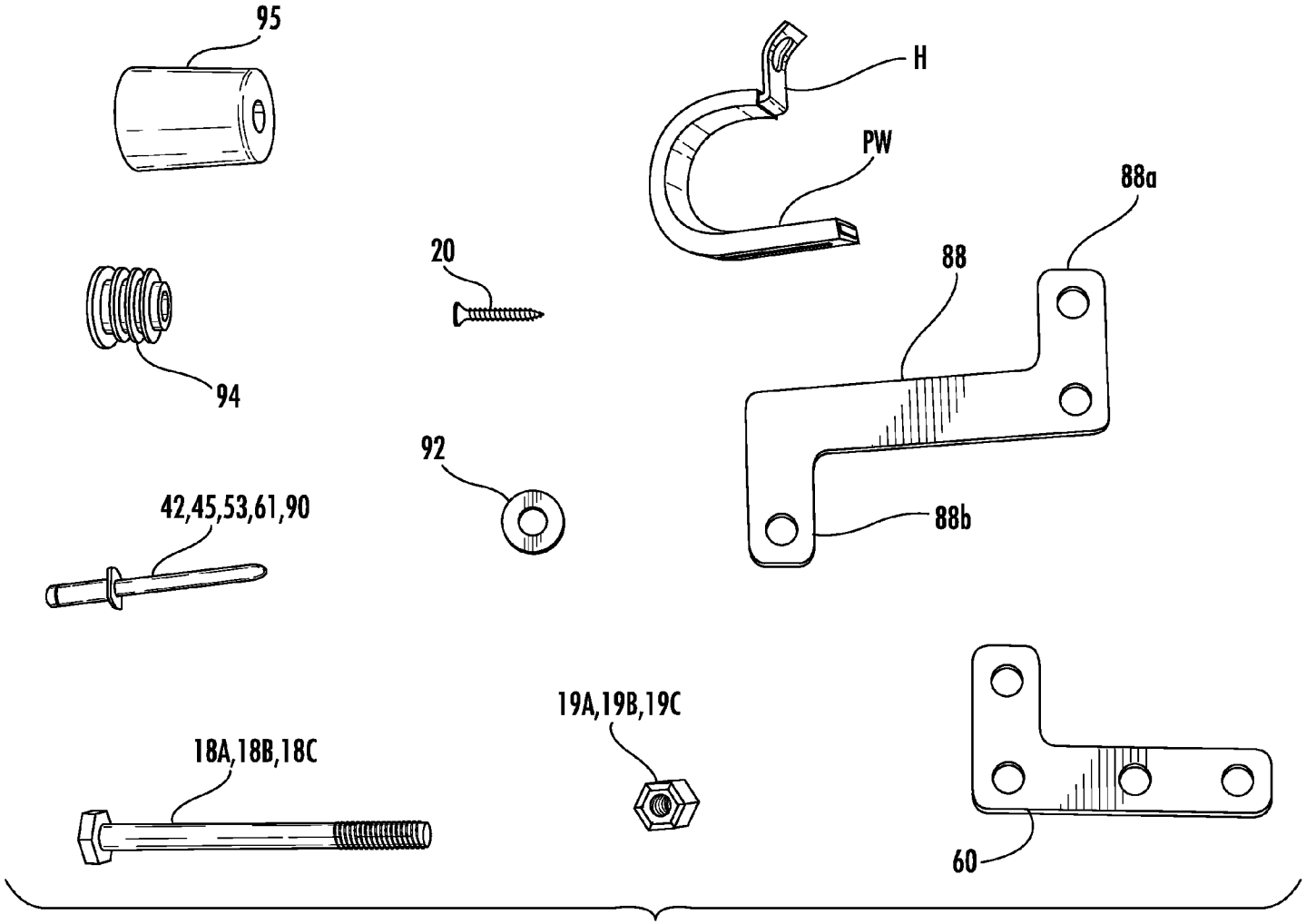
FIGS. 53-56 are perspective views of the brackets (i.e. the hinge brackets and the handle brackets), the hook, the fasteners, the fastener washers, the bolts, the nuts, the set screw, the caps, and the plugs of the portable barrier of FIG. 1.
Figure 54:
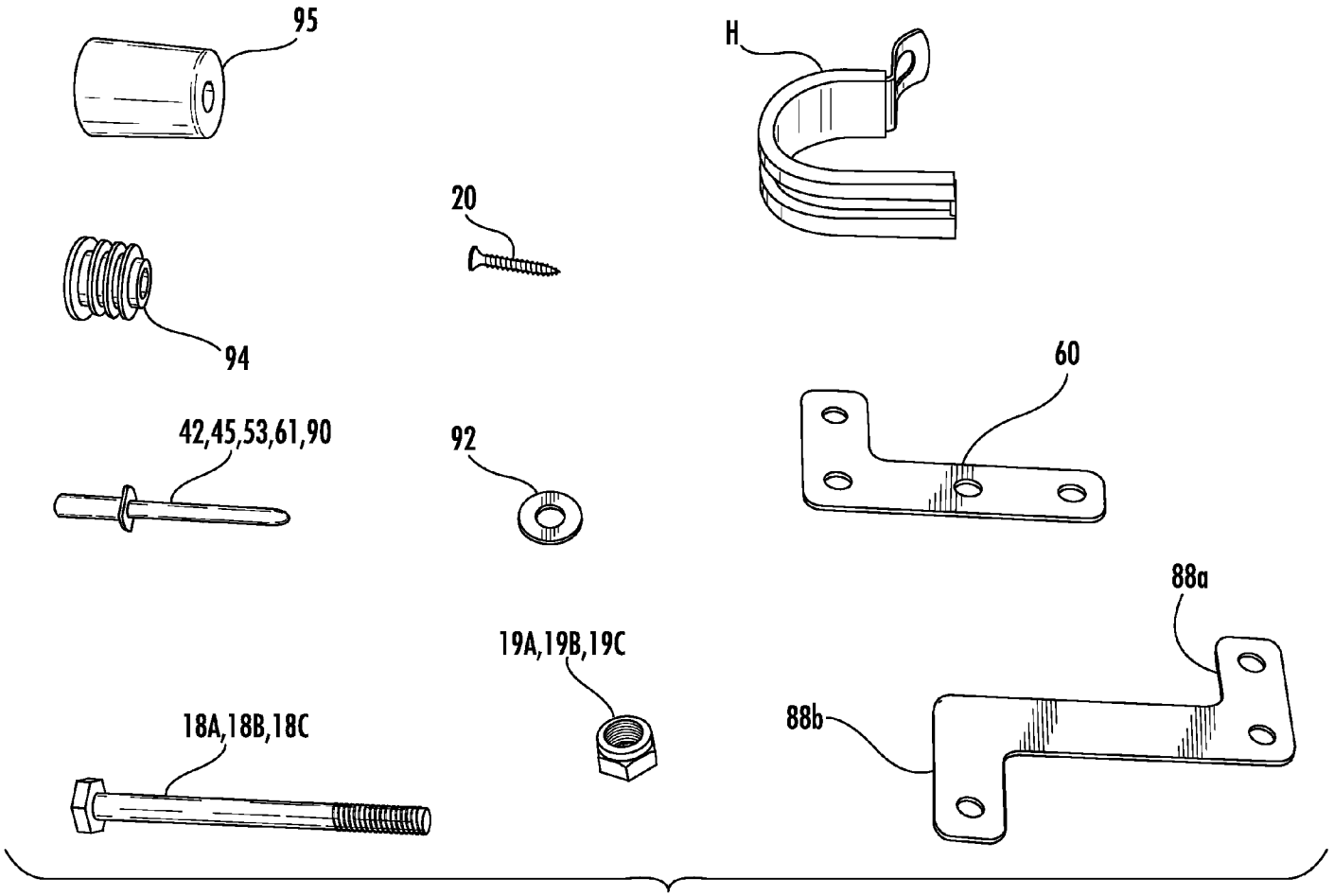
Figure 55:
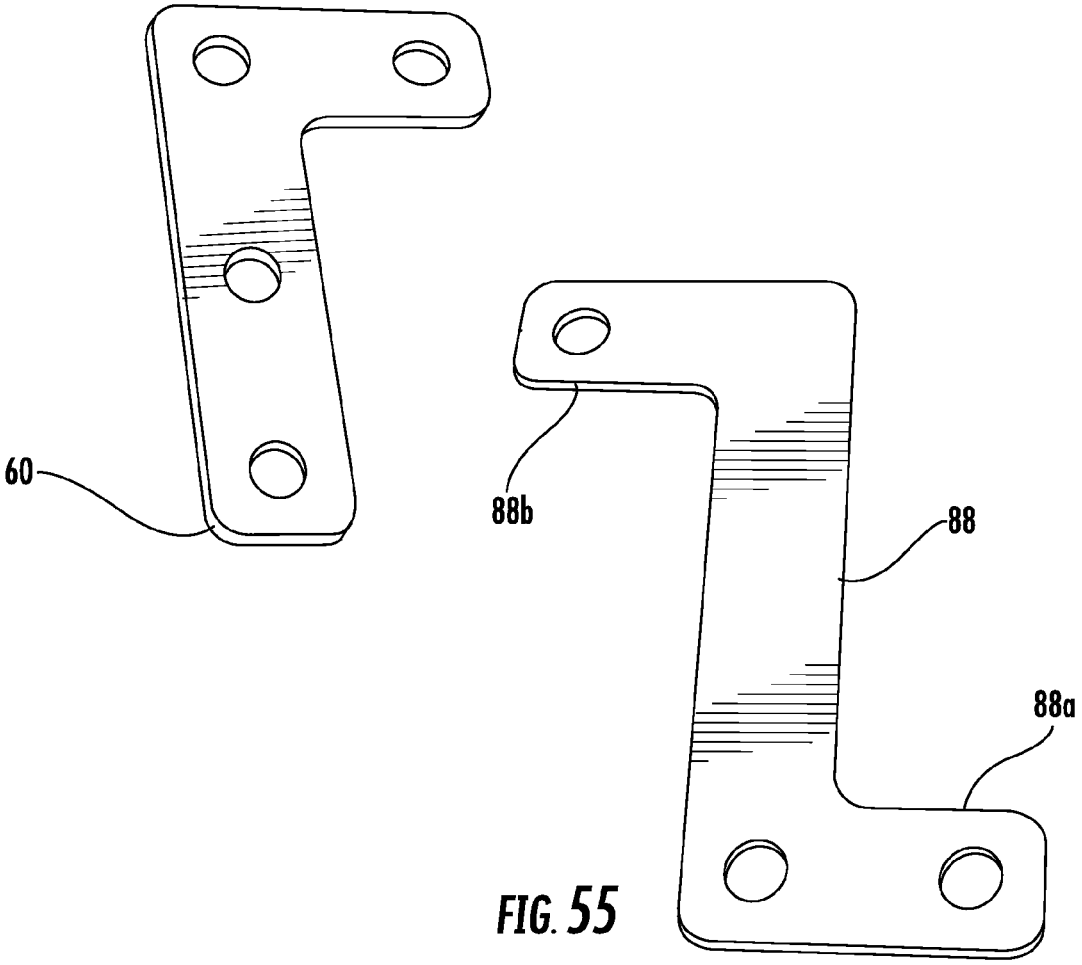

FIGS. 53-55 show the brackets 88 that are utilized in the hinge joints 70, 72, 74, 76, 78. The brackets 88 include three (3) fastener holes that extend therethrough as shown in FIGS. 53-55. All of the brackets 88 used in the hinge joints 70, 72, 74, 76, 78 are essentially the same, so only one hinge joint is shown in FIGS. 53-55 for efficiency of description. FIGS. 53-55 also shows the brackets 60 that are used secure the handle 51H to the strut portion 51S of the supplemental component 51. The brackets 60 include four (4) fastener holes that extend therethrough as shown in FIGS. 53-55.

Figure 56:
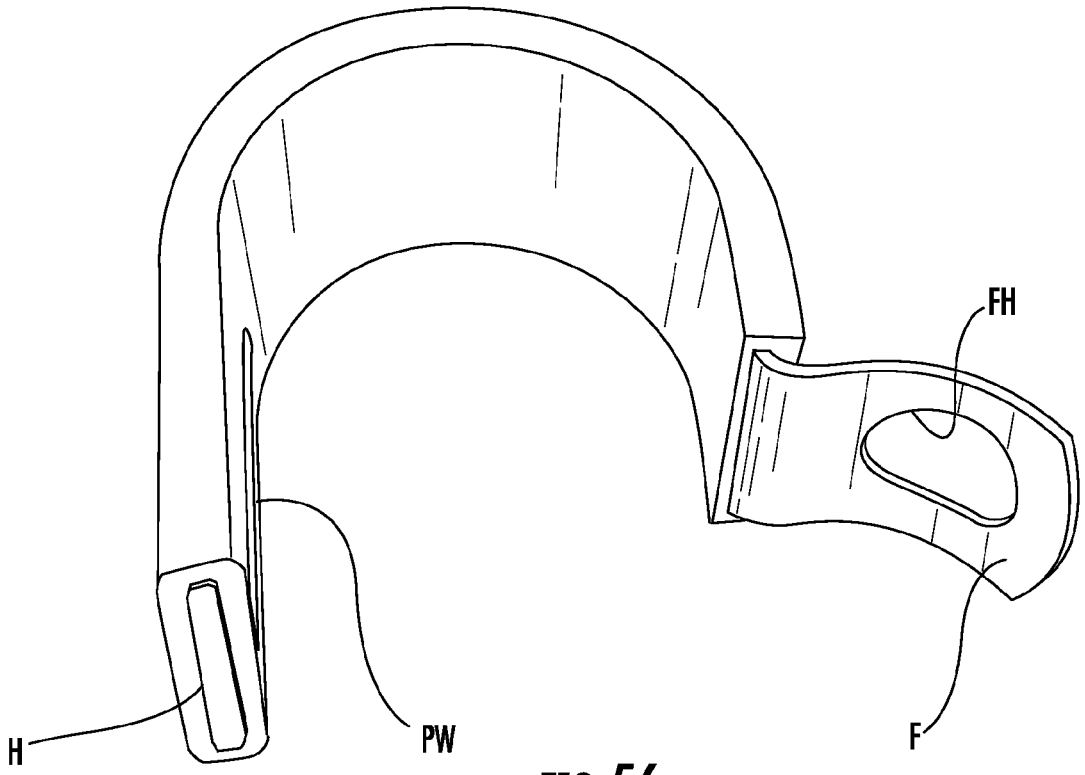

FIGS. 53 and 56 show the hook H used to secure the handle 51H in fixed relation to the leg 38B in the embodiment of FIGS. 30-45. The hook H includes a flange F that defines a fastener hole FH therein that is configured to receive a rivet therethrough. FIGS. 53-54 further show the fasteners 42, 45, 53, 61, 90 used in the portable barrier 10. In particular, the fasteners 42, 45, 53, 61, 90 are rivets such as aluminum rivets. Washers 92 are used in association with each of the fasteners 42, 45, 53, 61, 90 in a conventional manner as shown in the figures of this disclosure.

Figure 61:
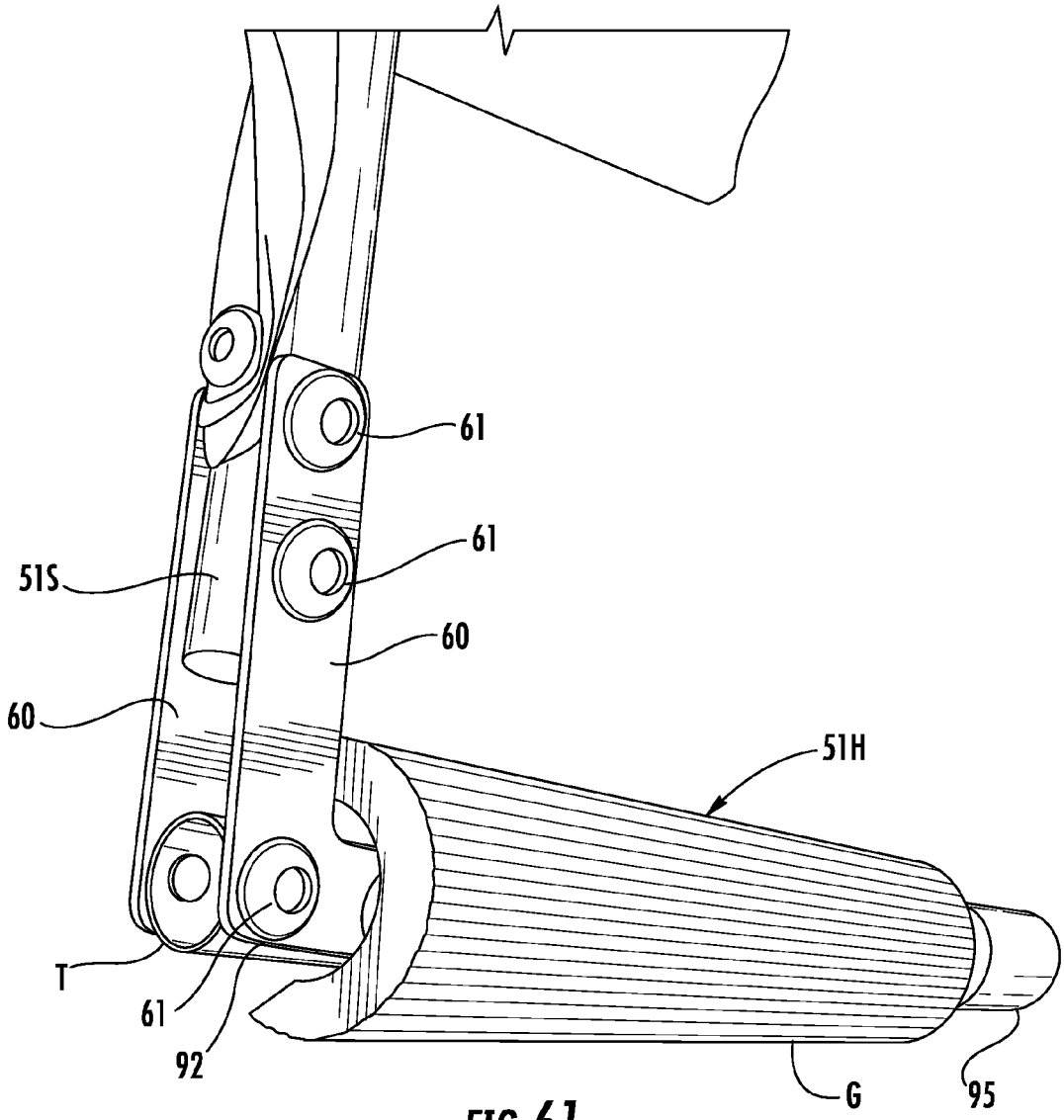
FIGS. 61-63 are perspective views of the handle portion of the strut portion of the supplemental component of the portable barrier of FIG. 1.
Figure 62:
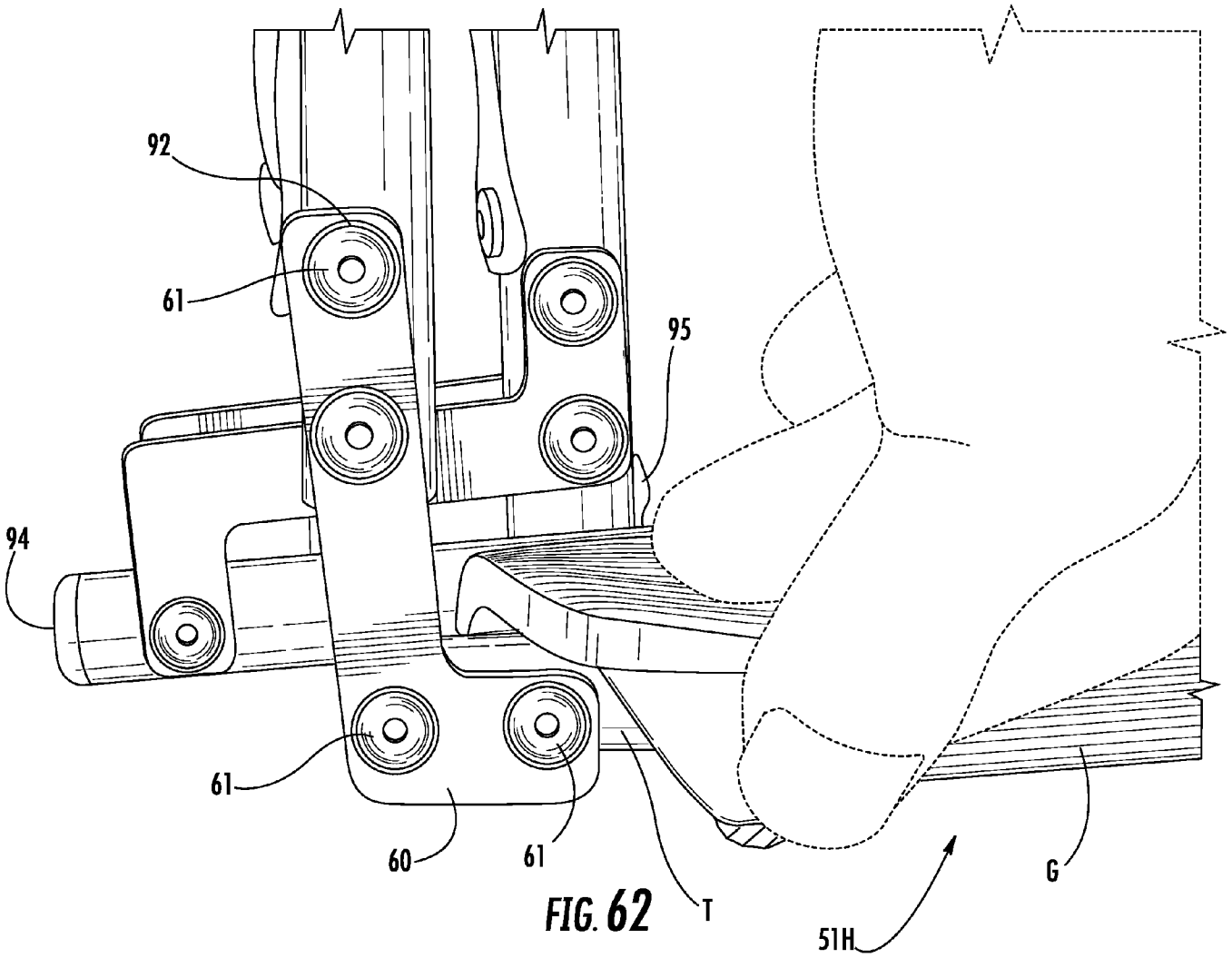
Figure 63:
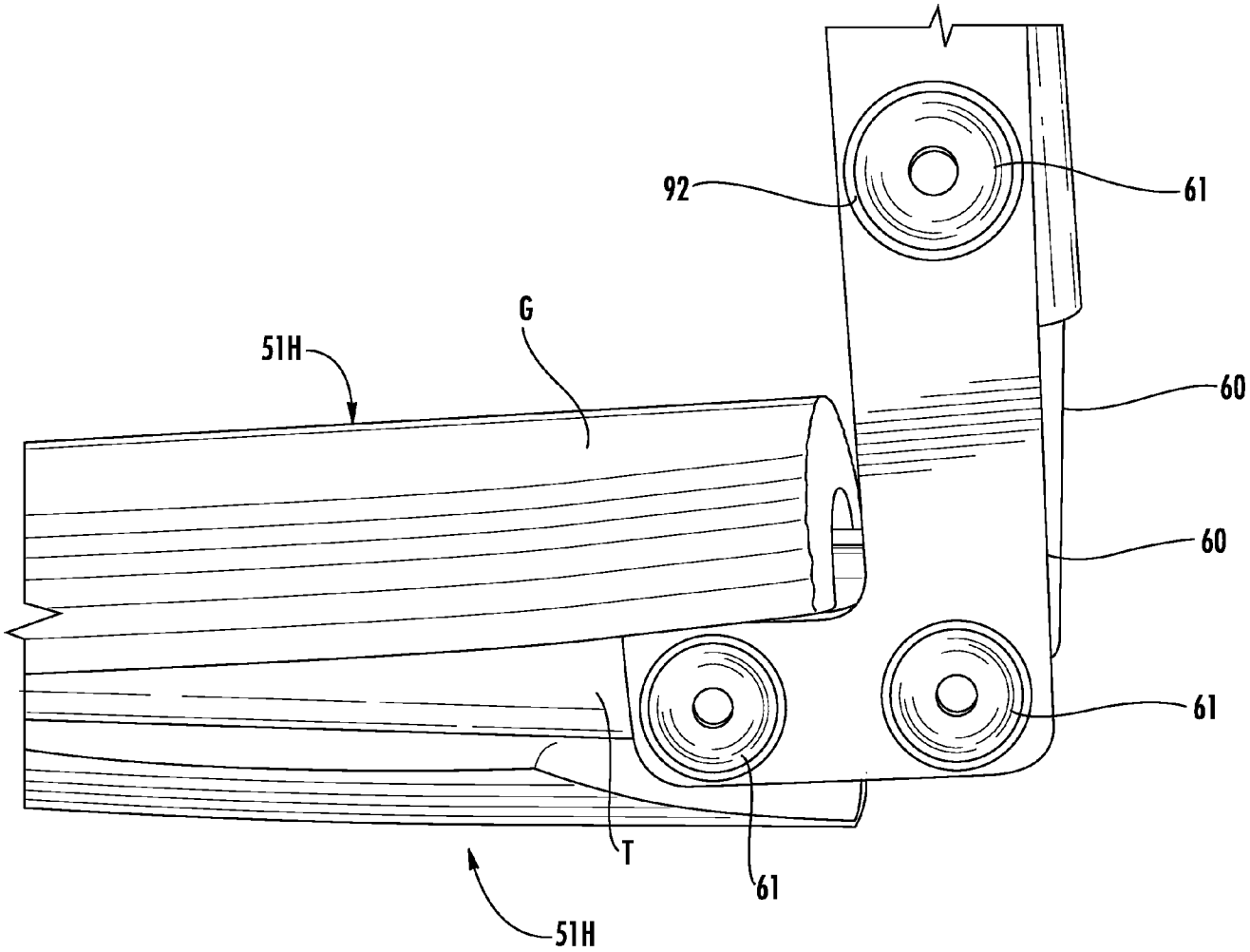
Figure 91:
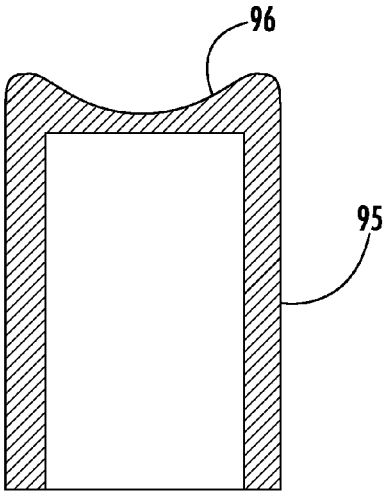
FIG. 91 is a cross sectional view of the cap of the portable barrier of FIG. 1.

FIGS. 53-54 further show the bolts 18A, 18B, 18C, and the nuts 19A, 19B, 19C, and the set screw 20 of the junction assembly 16. (See also FIG. 90.) In addition, FIGS. 53-54 show a plug 94 that is utilized by the portable barrier 10 to reduce sharp edges thereof. More specifically, the plug is inserted into each end of the tubes of each of the cantilevered portions 38A-C, 38B-C, 50A-C, 50N-C, and 50B-C as shown in FIGS. 62, 69, 85, 88, and 89. Furthermore, FIGS. 53-54 show an end cap 95 that is also utilized by the portable barrier 10 to reduce sharp edges thereof. In particular, the end cap 95 is secured around each end of the tubes of each of the strut portions 38A-S, 38B-S, 50A-SC, 50N-S, and 50B-S that are opposite the junction assembly as shown in FIGS. 62, 69, 82, 84, 87-89. A groove 96 is defined in the top portion of each cap 95 as shown in FIG. 91 (see also FIGS. 69-70). The groove 96 assists in preventing lateral movement of the cantilevered portions 38A-C, 38B-C, 50A-C, 50N-C, and 50B-C respectively in relation to the strut portions 38A-S, 38B-S, 50A-S, 50N-S, and 50B-S when the portable barrier 10 is positioned in its deployed or use position (i.e. its protection mode). Another end cap 95 is utilized in the handle portion 51H. Specifically, the end cap 95 is secured around the end of the tube segment T of the handle portion 51H as shown in FIG. 61.

Storage Compartment

Figure 57:
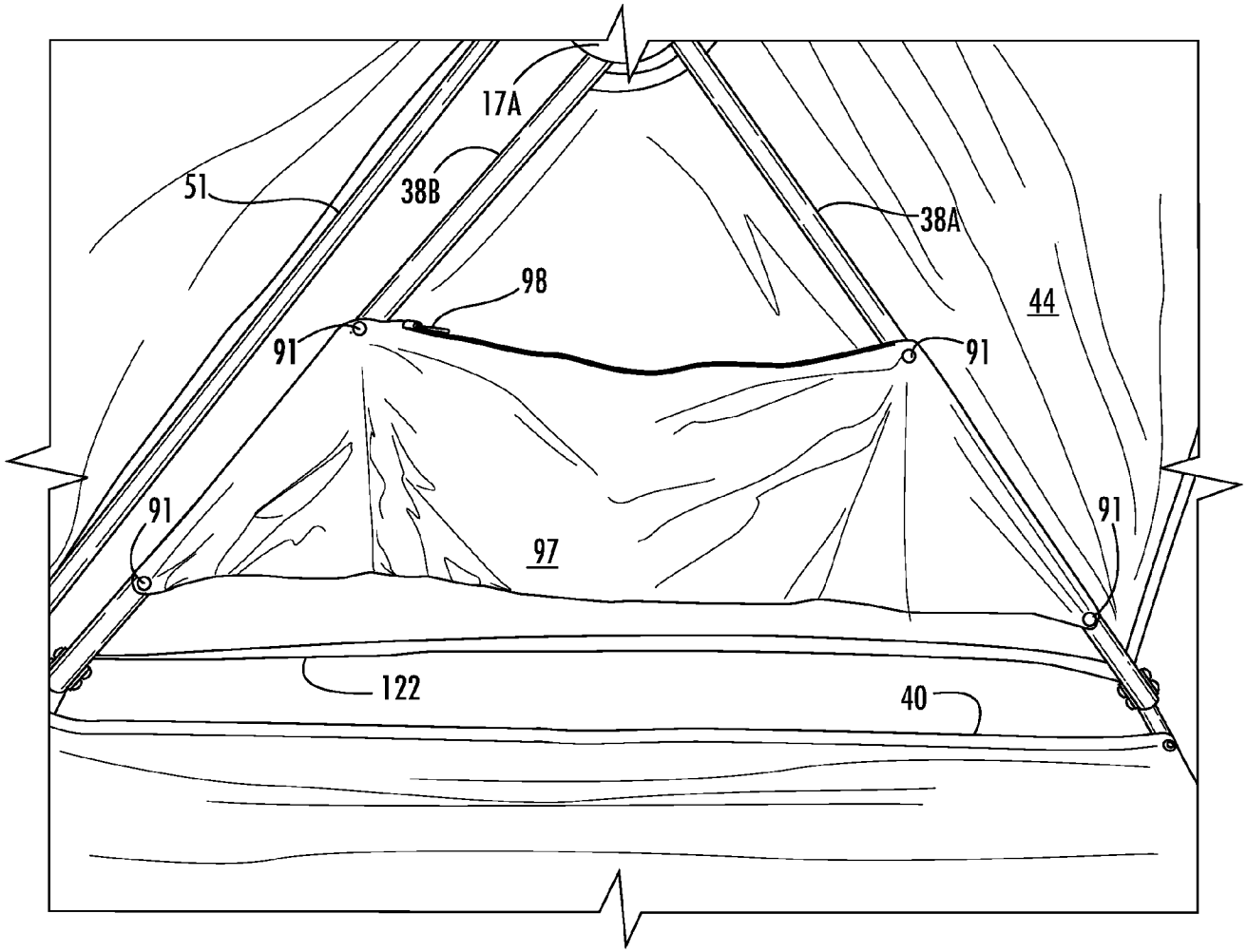
FIGS. 57-60 are perspective views of the pouch or storage compartment of the portable barrier of FIG. 1, with the portable barrier positioned in its protection mode of operation.
Figure 58:
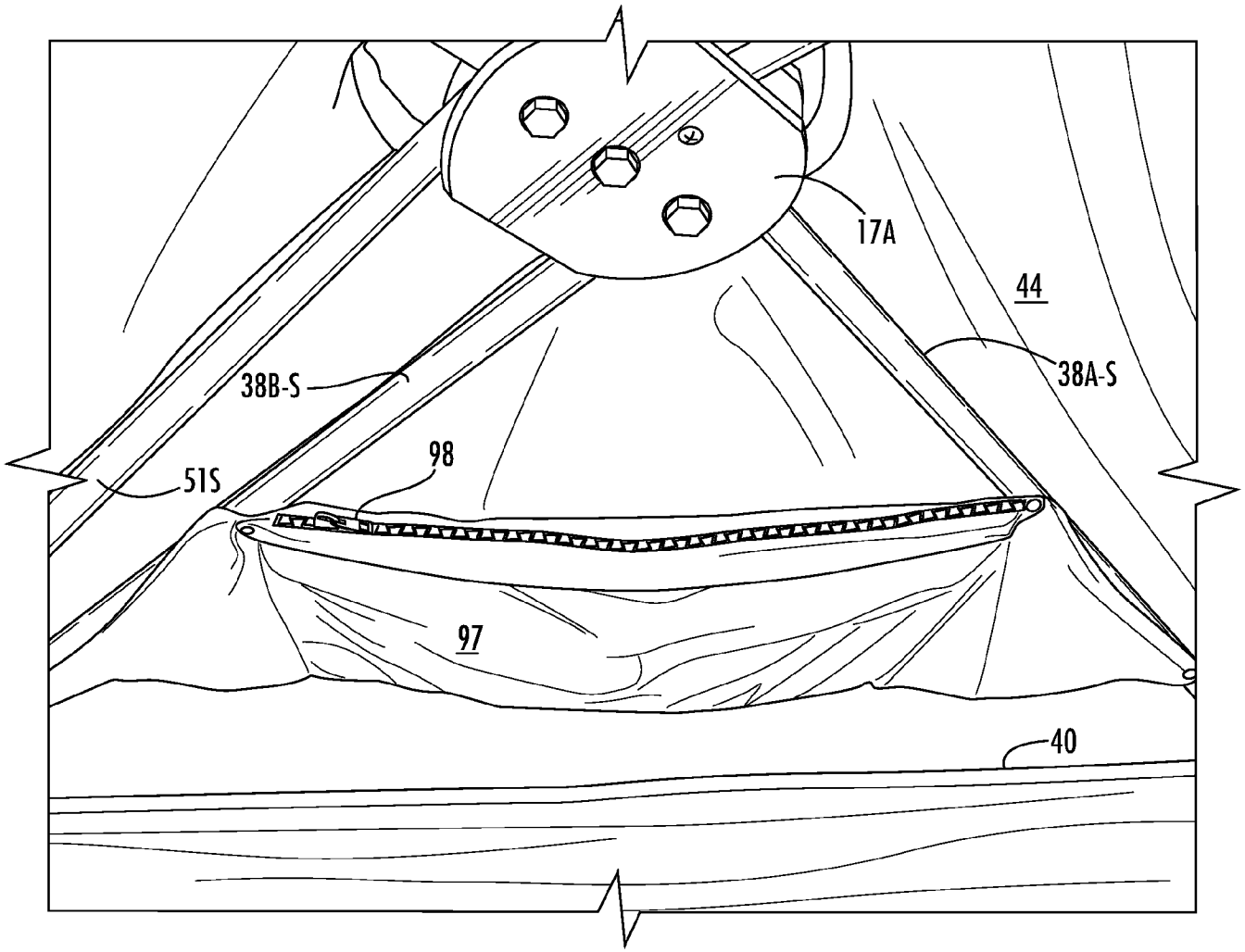
Figure 59:
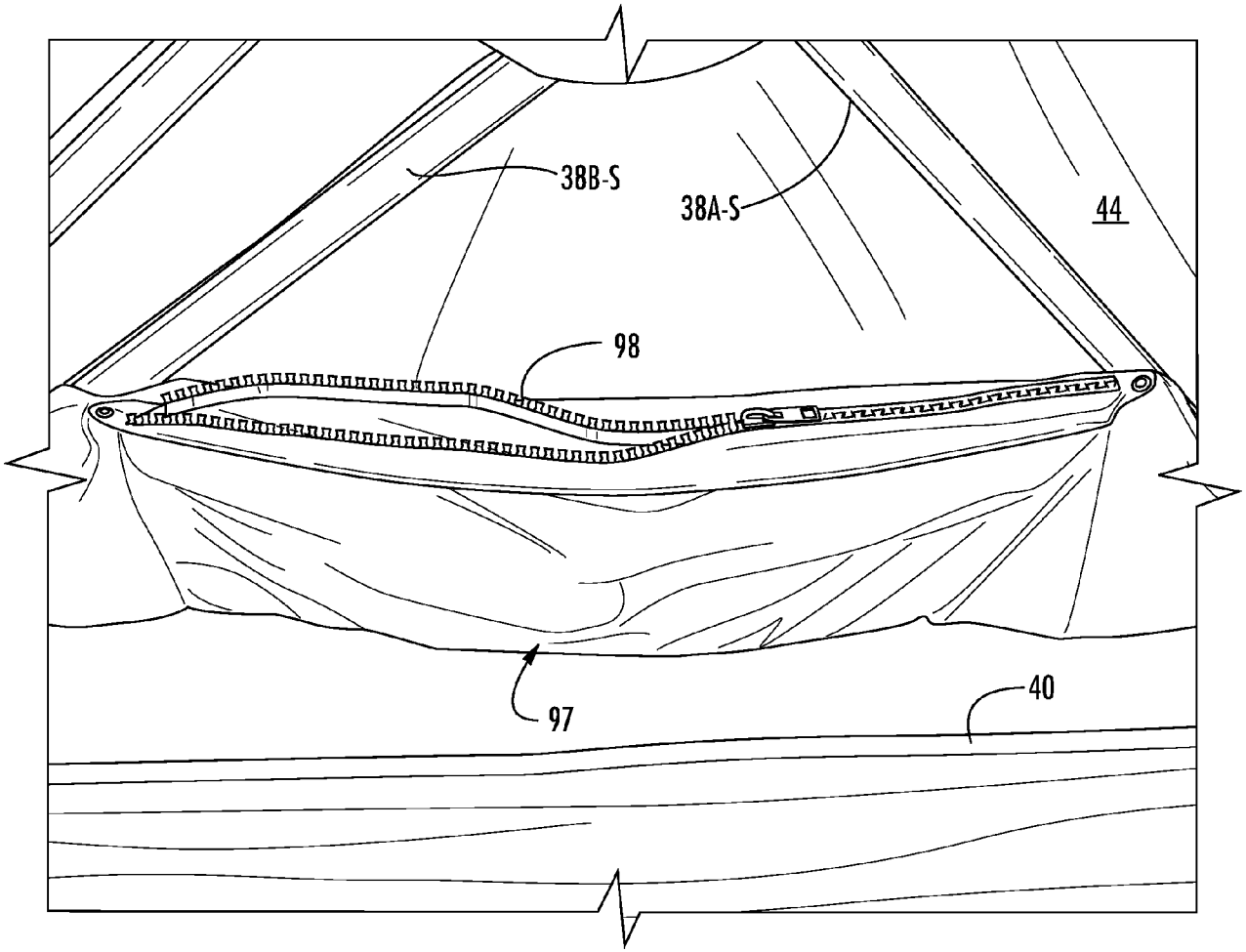
Figure 60:
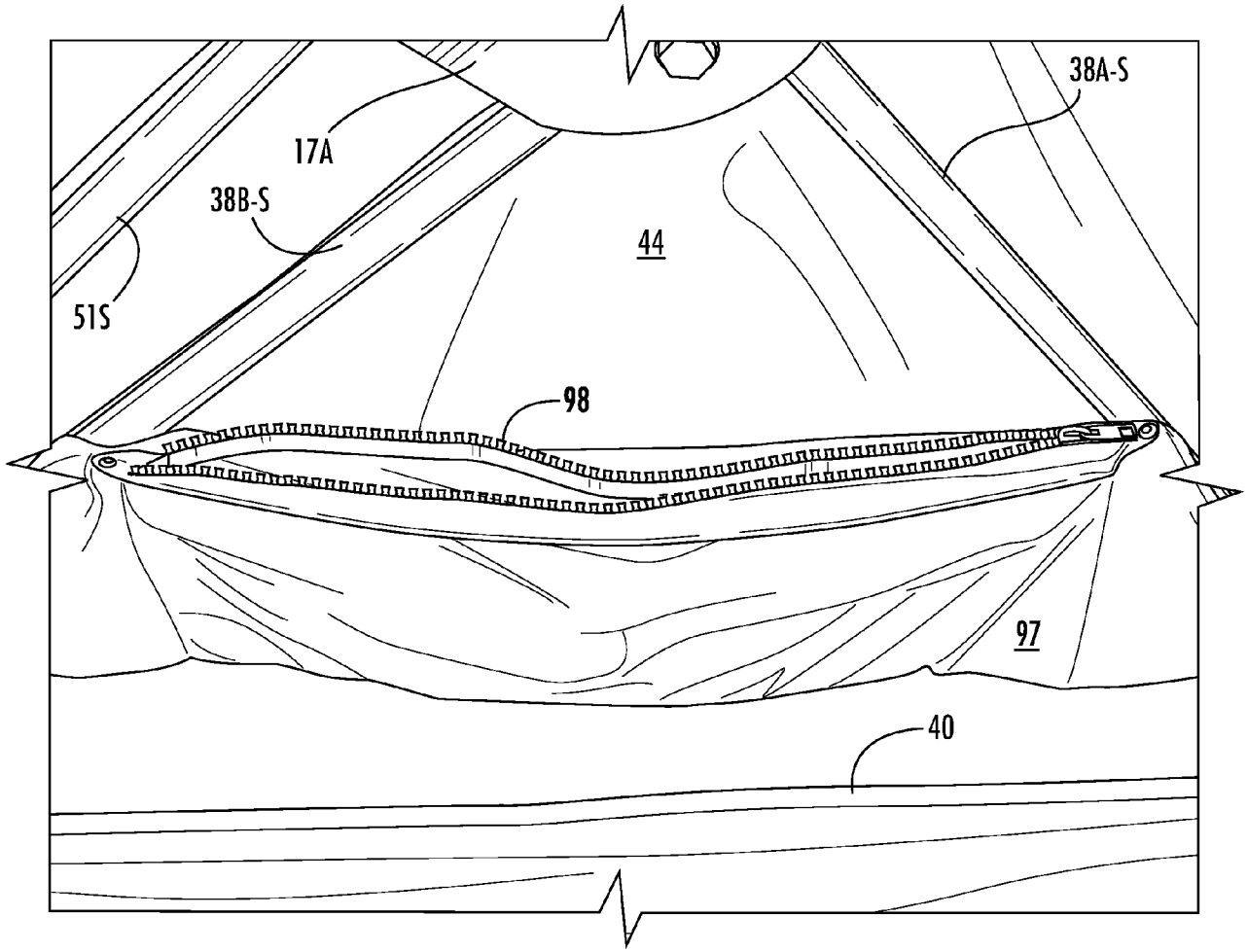

Turning now to FIGS. 57-60, the portable barrier 10 includes a storage compartment or pouch 97 that is fastened to the legs 38A and 38B. The pouch 97 includes a bottom end that is closed and a top end that is configured to be selectively opened and closed with a zipper 98. FIGS. 57-58 show the pouch 97 in the closed state. FIG. 59 shows the pouch in a partially opened state. And FIG. 60 shows the pouch 97 is a fully opened state. The pouch 97 is configured to store items such as a set of keys, a purse, a wallet, and other miscellaneous items while the occupant 27 is located in the occupant space 26. The pouch 97 is also configured to store items such as accessories of the portable barrier 10 therein that may be sold or supplied in conjunction with the portable barrier 10. It should be appreciated that the pouch 97 is positioned in an expanded or use state when the portable barrier is position in its protection mode (as shown in FIGS. 1-12 and 57-60). Further, the pouch 97 is positioned in a collapsed or storage state when the portable barrier is position in its storage mode (as shown in FIGS. 13, 15, and 16).

Auxiliary Support Mechanisms

Figure 64:
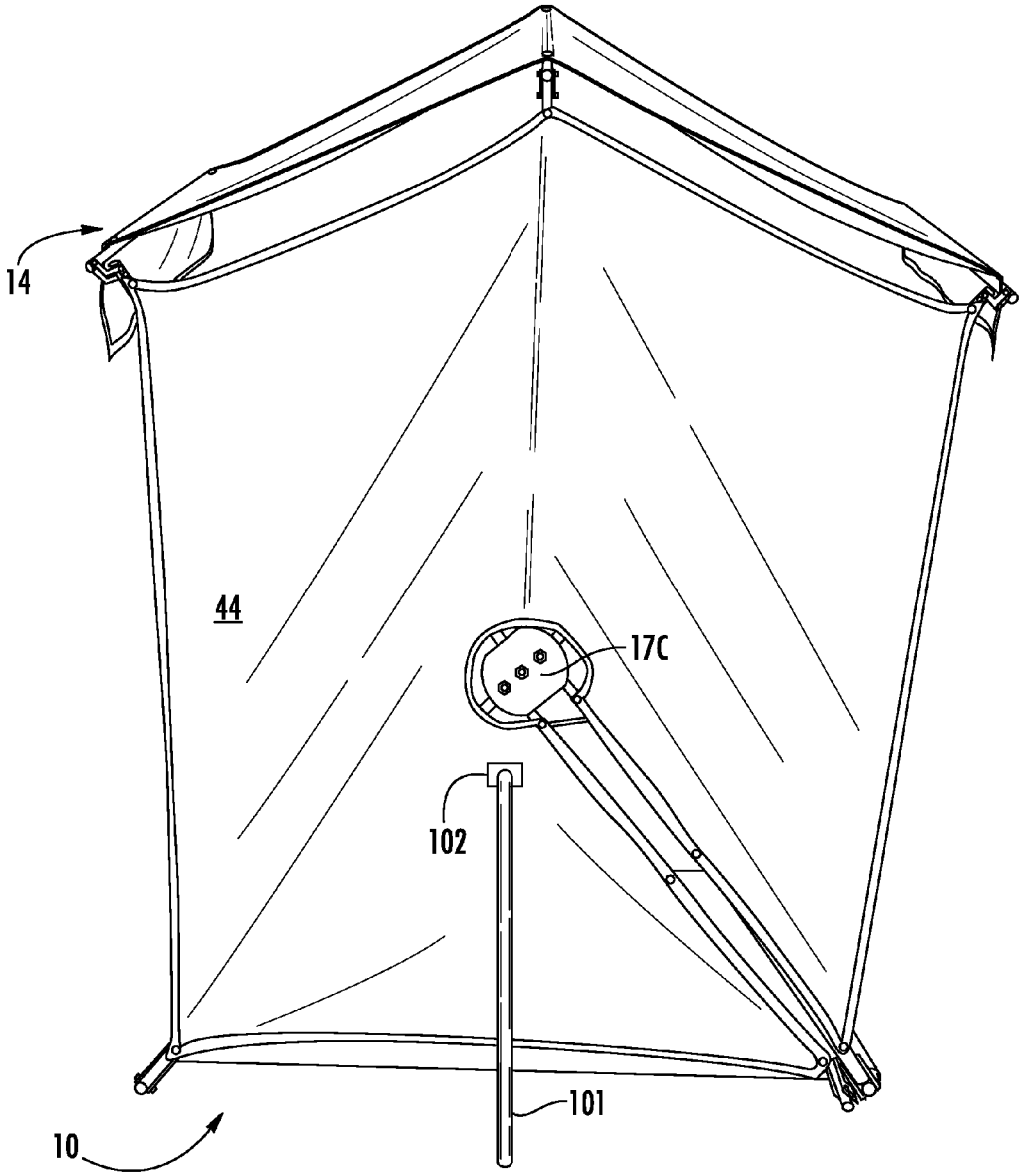
FIGS. 64-70 are various perspective views of the portable barrier of FIG. 1 or portions of the portable barrier of FIG. 1, with the portable barrier positioned in its protection mode of operation.
Figure 65:
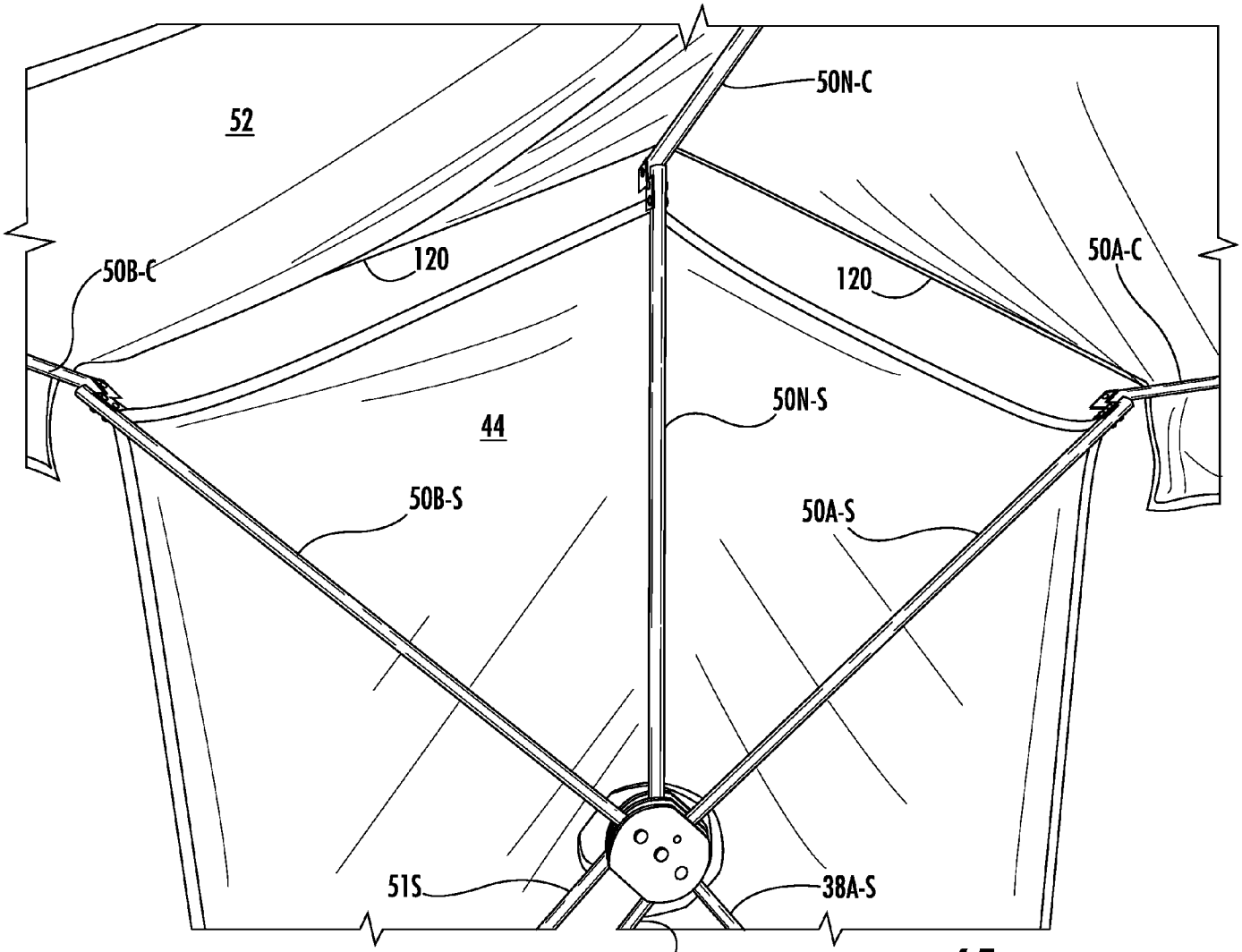
Figure 66:
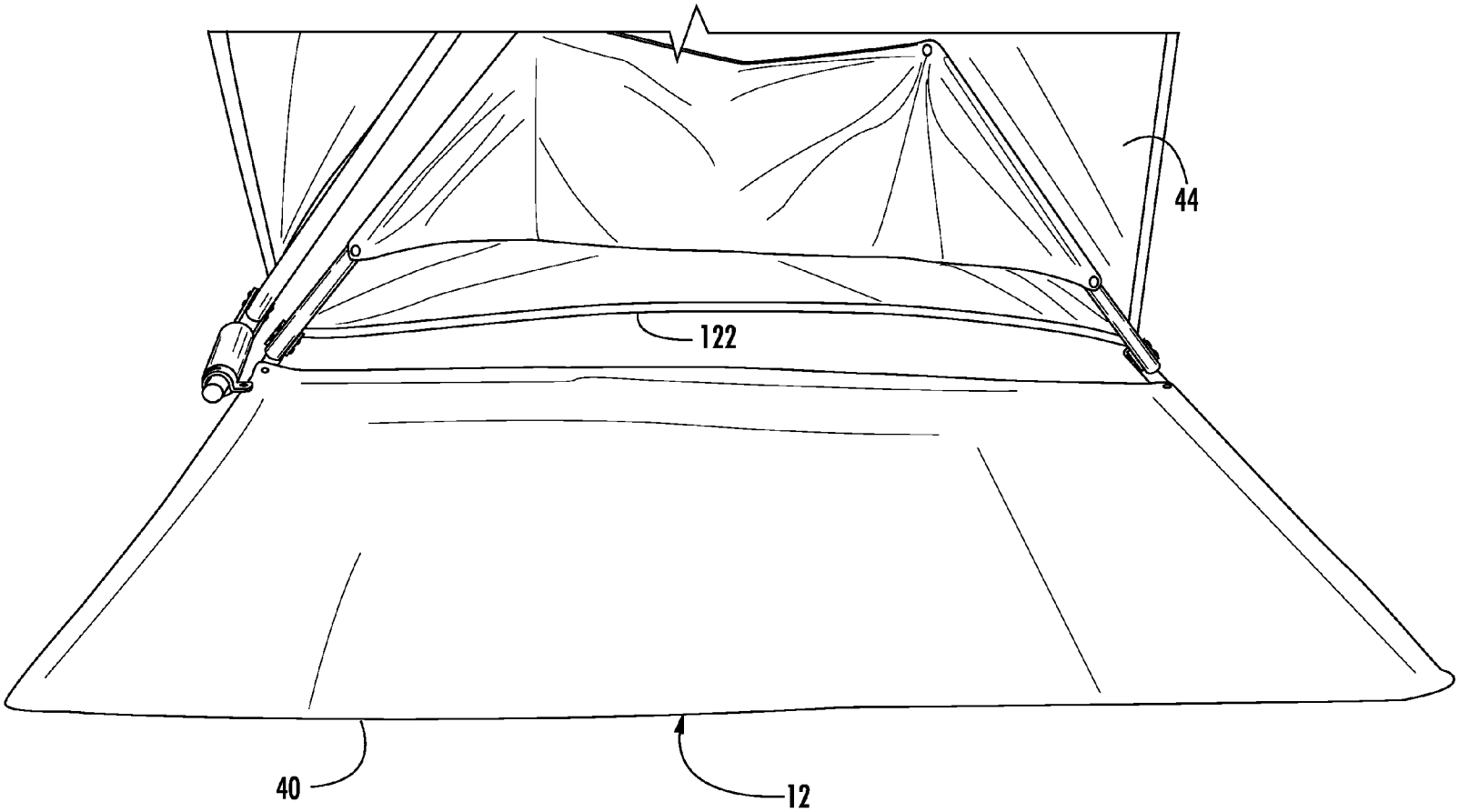
Figure 67:
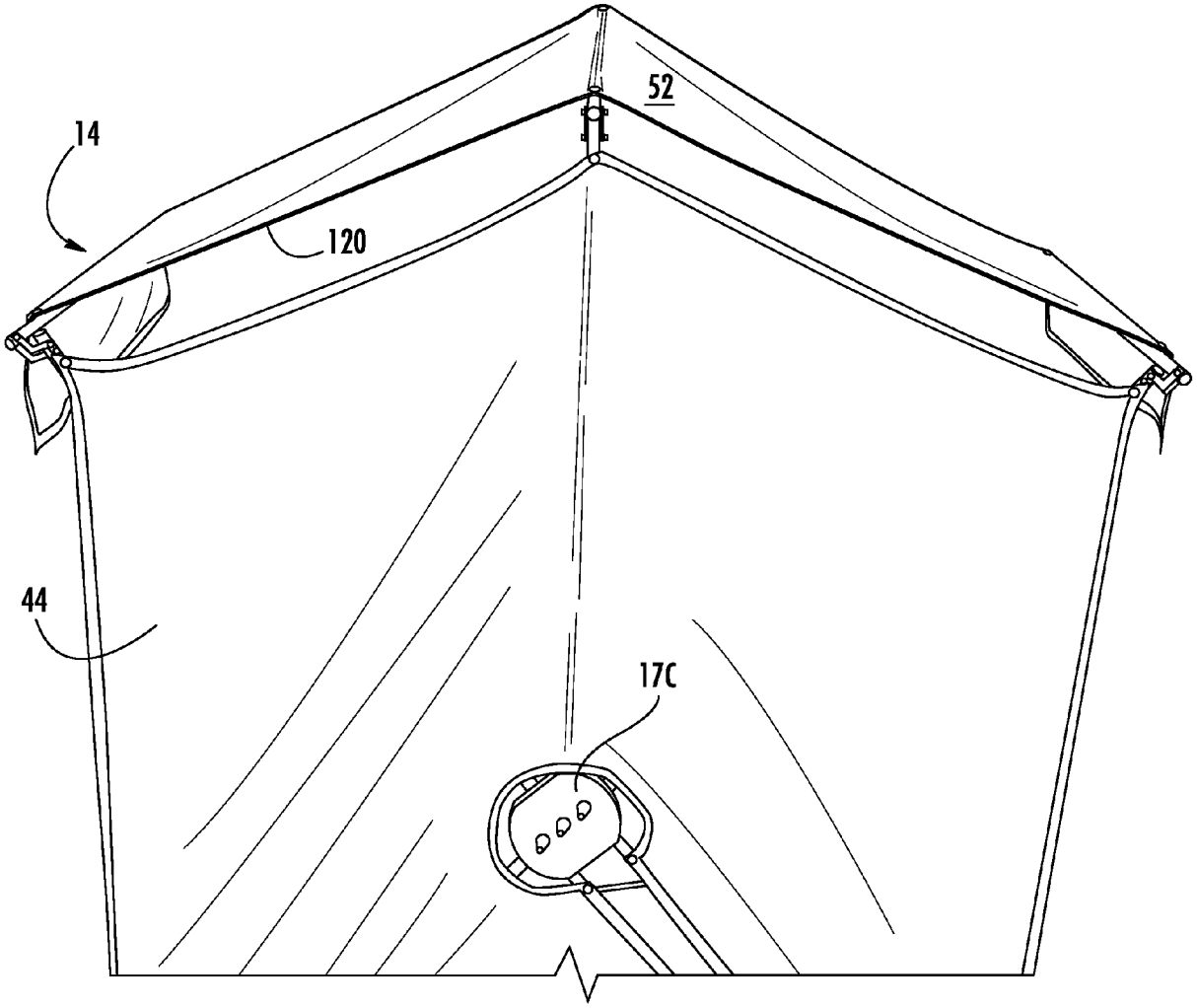
Figure 68:
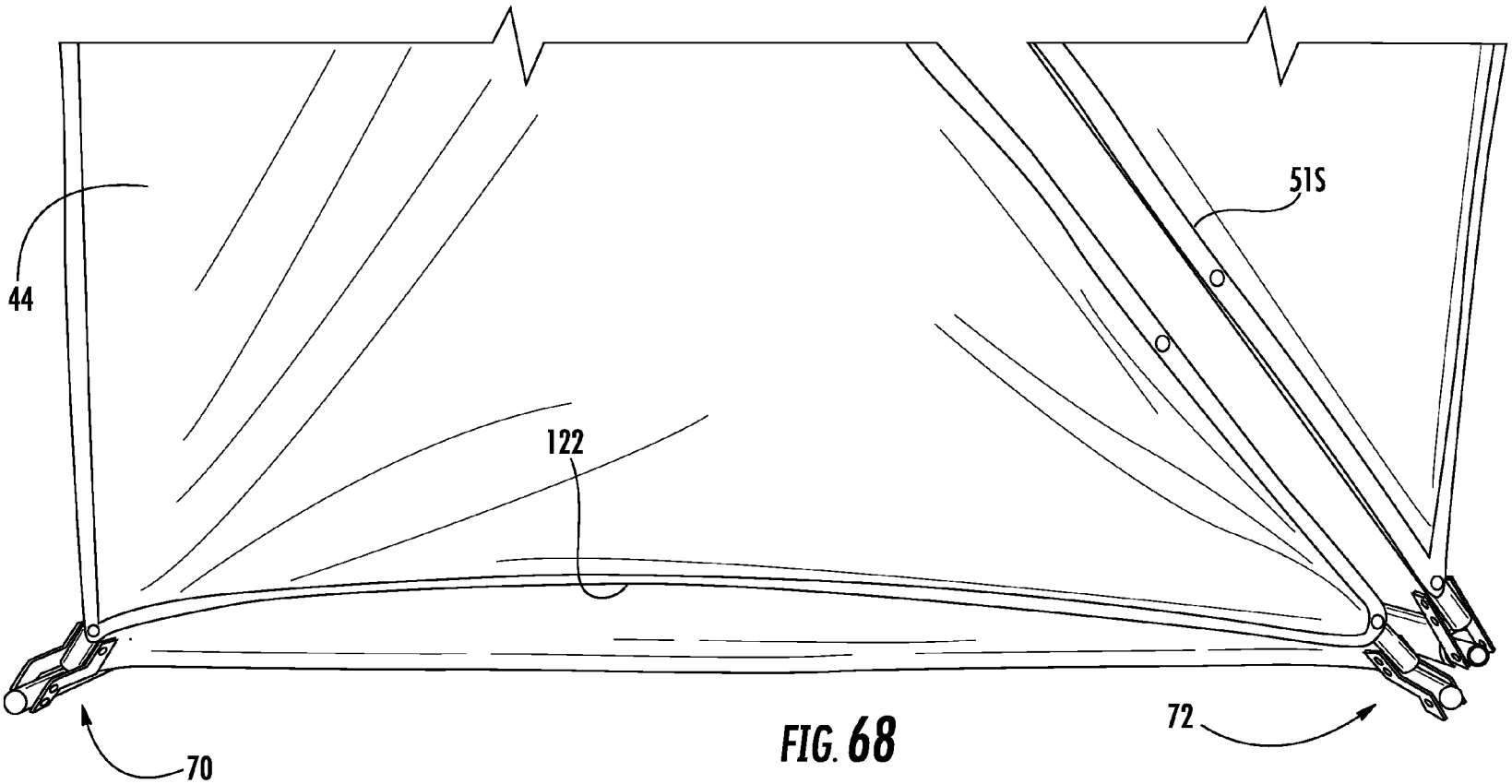
Figure 93:
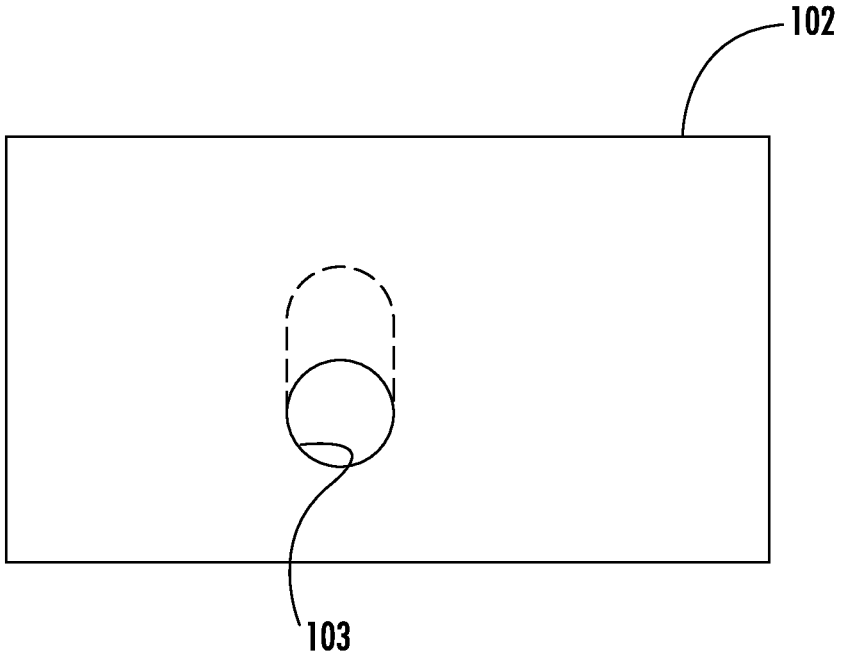
FIG. 93 is a front elevational view of a coupler of the auxiliary support mechanism of the portable barrier of FIG. 92.
Figure 94:
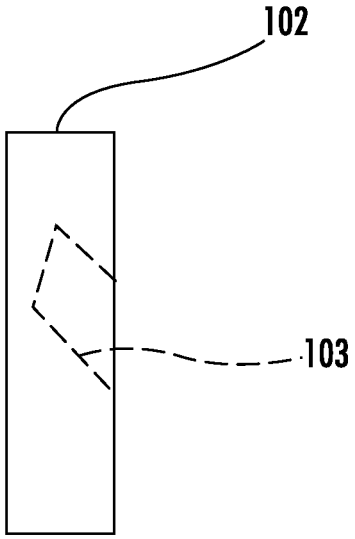
FIG. 94 is a side elevational view of the coupler of FIG. 93.

In order to further stabilize the portable barrier 10 on the ground or horizontal surface HS, the portable barrier further includes an auxiliary support mechanism 100. The auxiliary support mechanism 100 is shown in detail in FIGS. 92-94. The auxiliary support mechanism 100 includes a support rod 101 and a coupler 102. The support rod 101 is made of wood, plastic, or metal such as aluminum. The coupler 102 has a blind recess 103 defined therein for receiving an end portion of the rod 101 in a friction fit manner. The coupler 102 is configured as a generally rectangular block of plastic that defines the blind recess 103. The coupler 102 is affixed to the back screen 44 at the location shown in FIGS. 10, 64, and 86 by an adhesive. Alternatively, the coupler 102 may be sewn to the back screen 44 to affix it thereto. As an alternative, the coupler 102 is configured as a generally rectangular block of leather or fabric material that is configured with a blind recess or other pocket to receive the end portion of the support rod therein.

Figure 92:
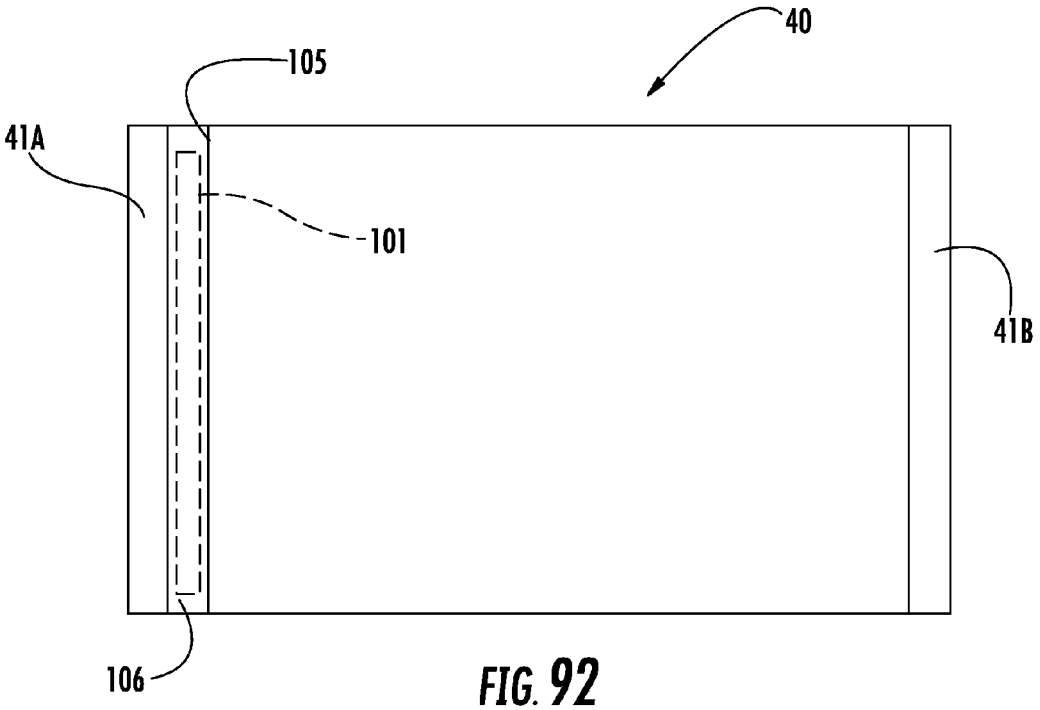
FIG. 92 is a plan view of the flooring of the portable barrier of FIG. 1, with the portable barrier positioned in its protection mode of operation, and with the various components of the portable barrier removed for clarity of description, and with the flooring possessing an additional pocket in relation to the flooring of FIG. 1, and with a support rod of an auxiliary support mechanism positioned in the additional pocket.

When not in use, the support rod 101 can be stowed in a pocket 105 defined in the flooring 40 as shown in FIG. 92. To this end, the flooring 40 further includes a pocket structure 106 that defines the pocket 105. The pocket structure 106 is similar in construction and configuration to the pocket structures 41A, 41B.

Figure 8:
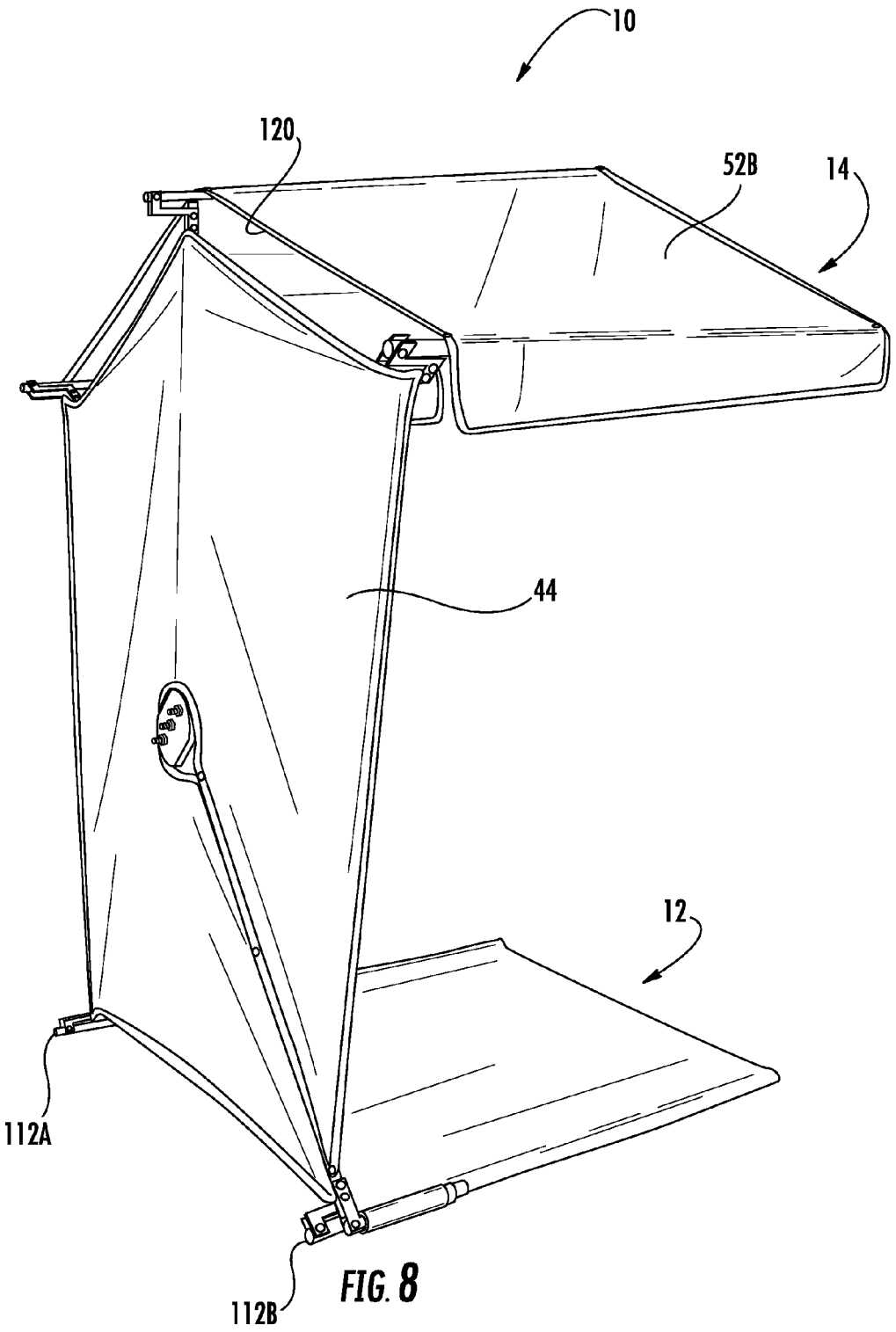
Figure 9:
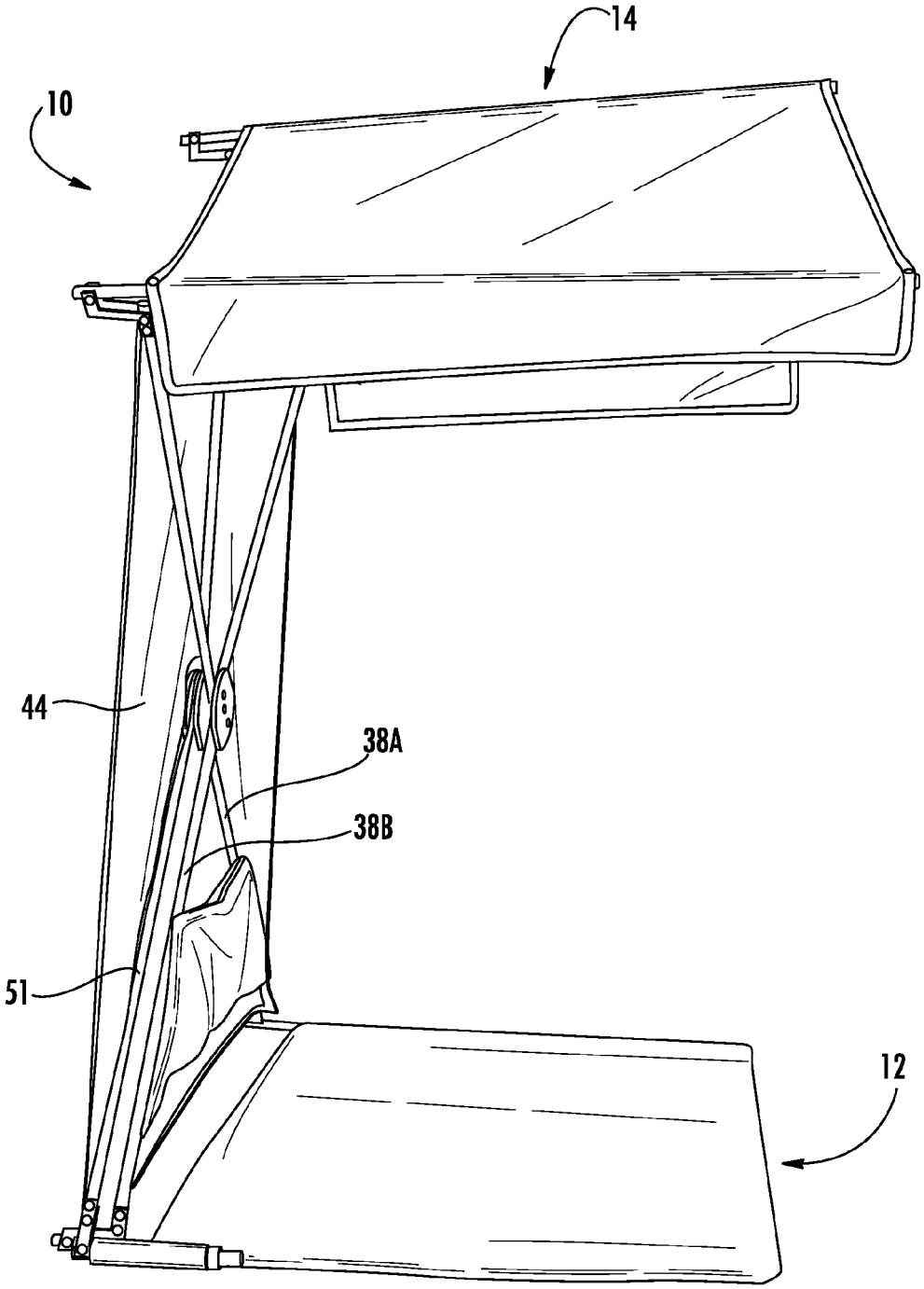
Figure 10:
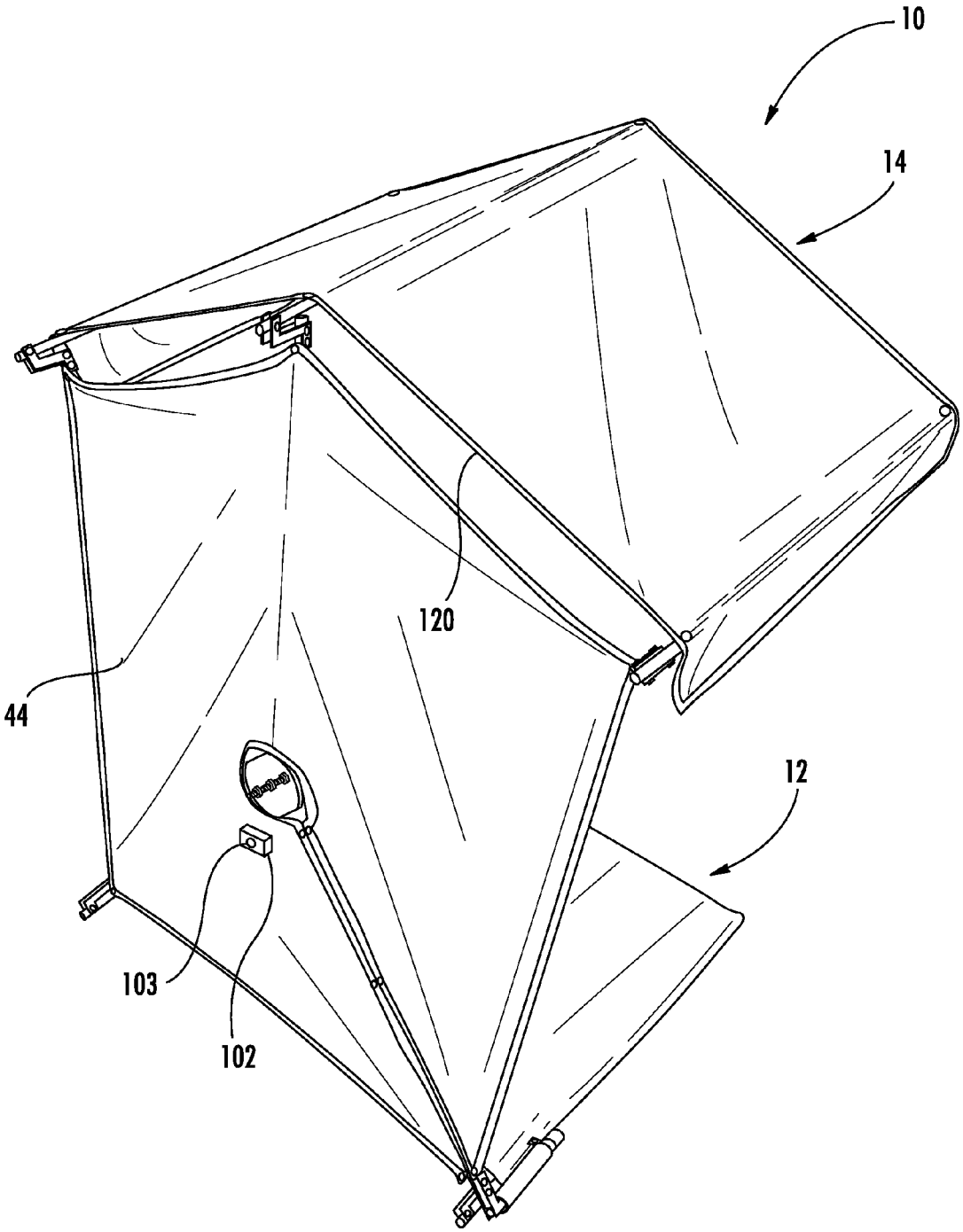
Figure 82:
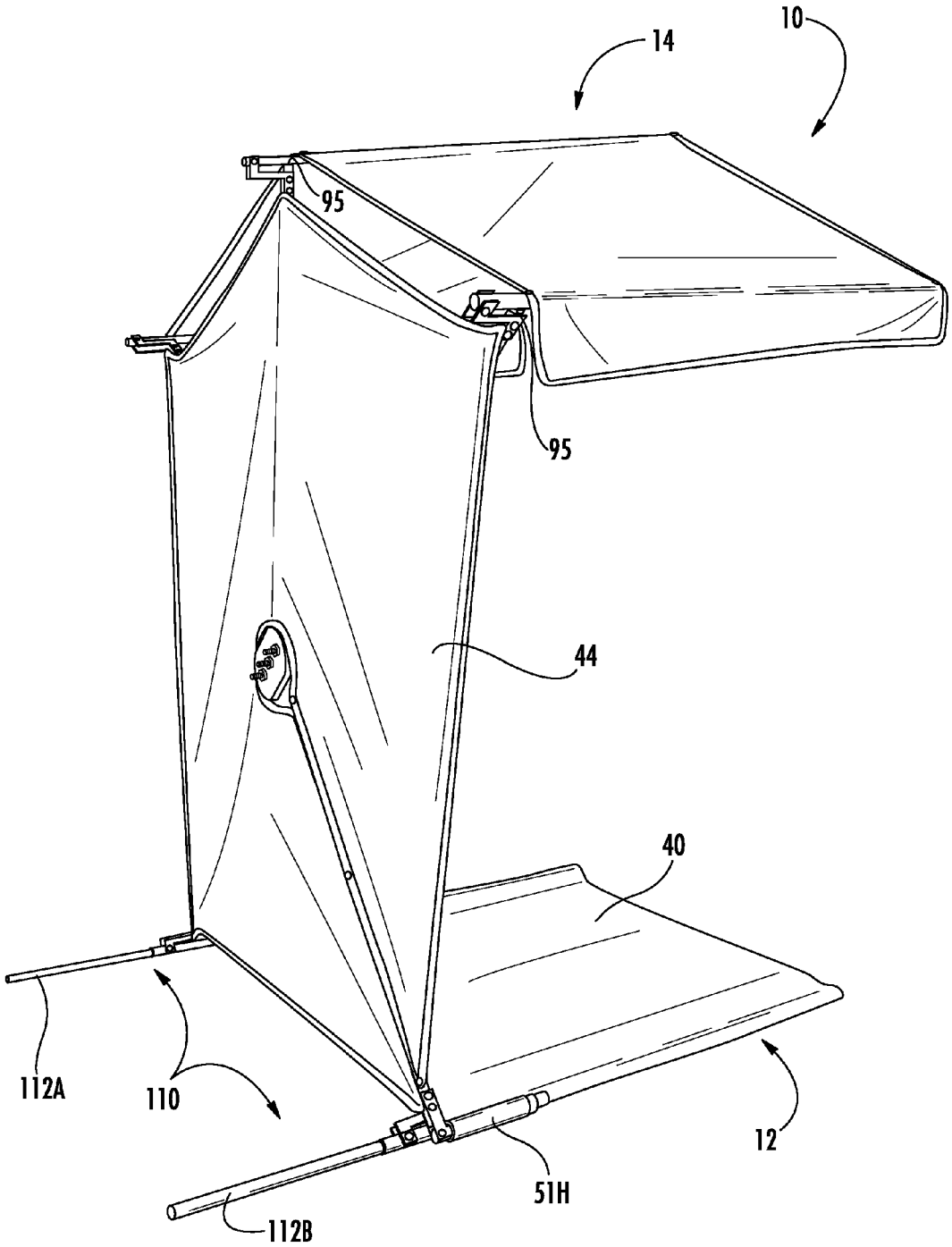
Figure 83:
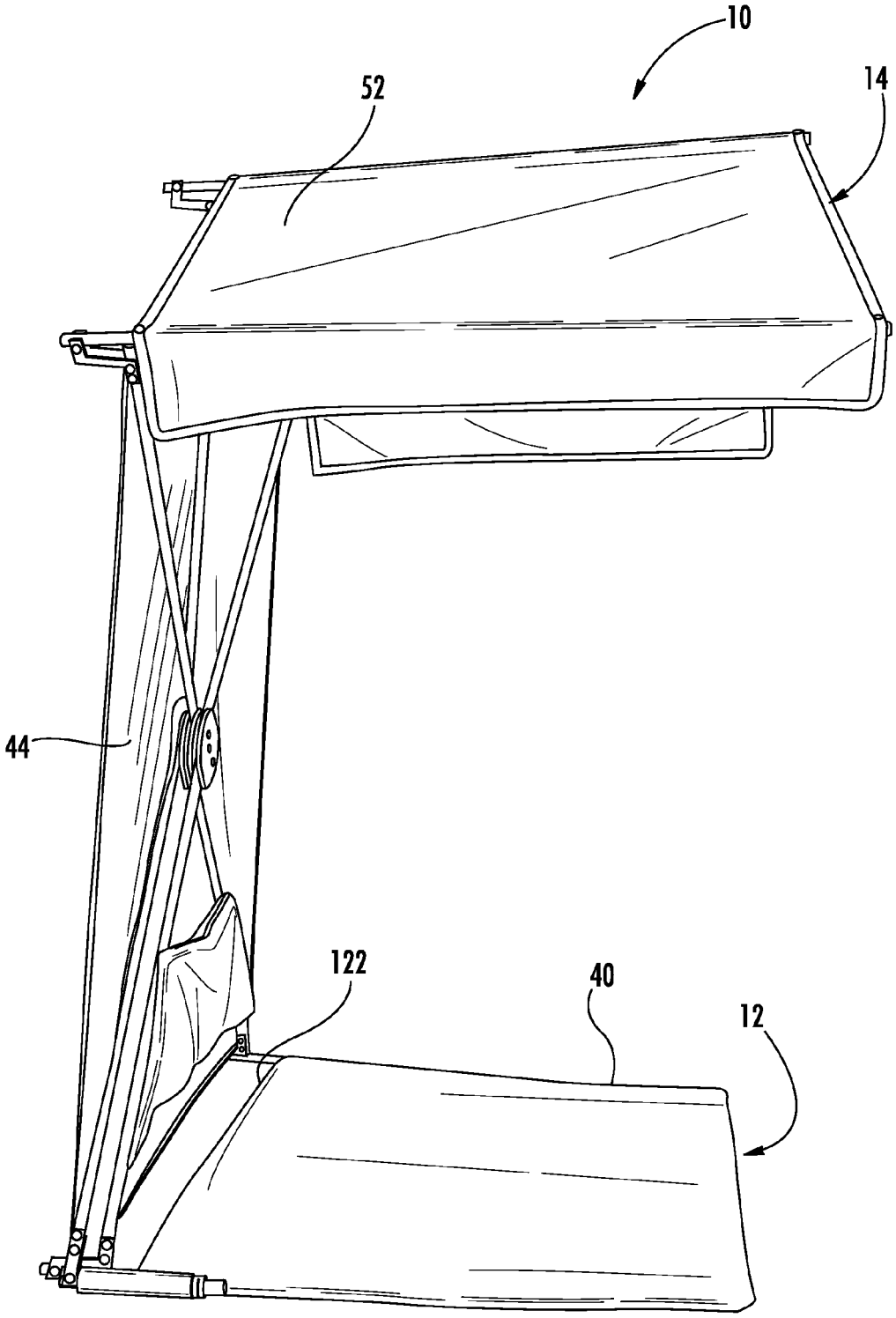
Figure 84:
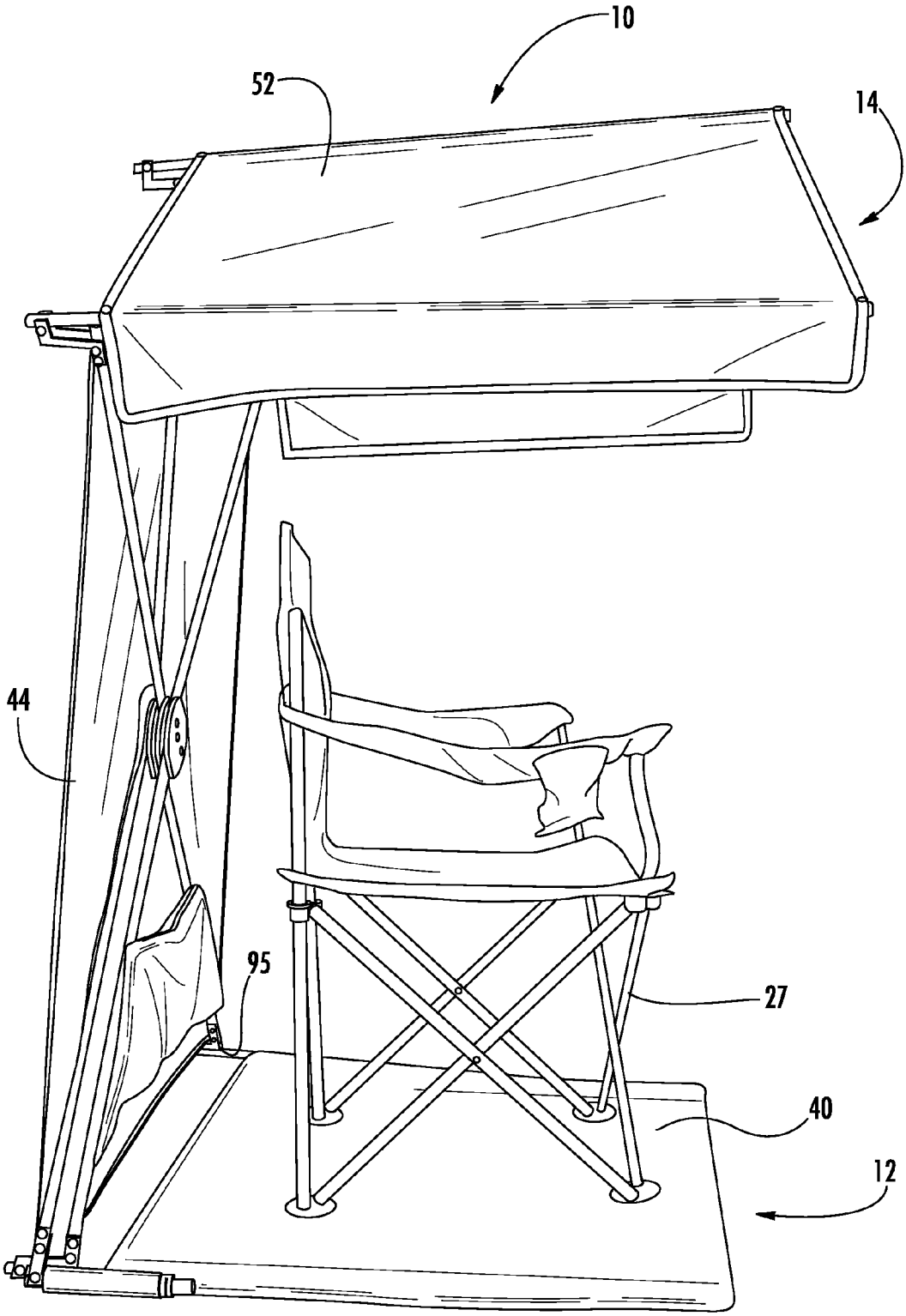
Figure 85:
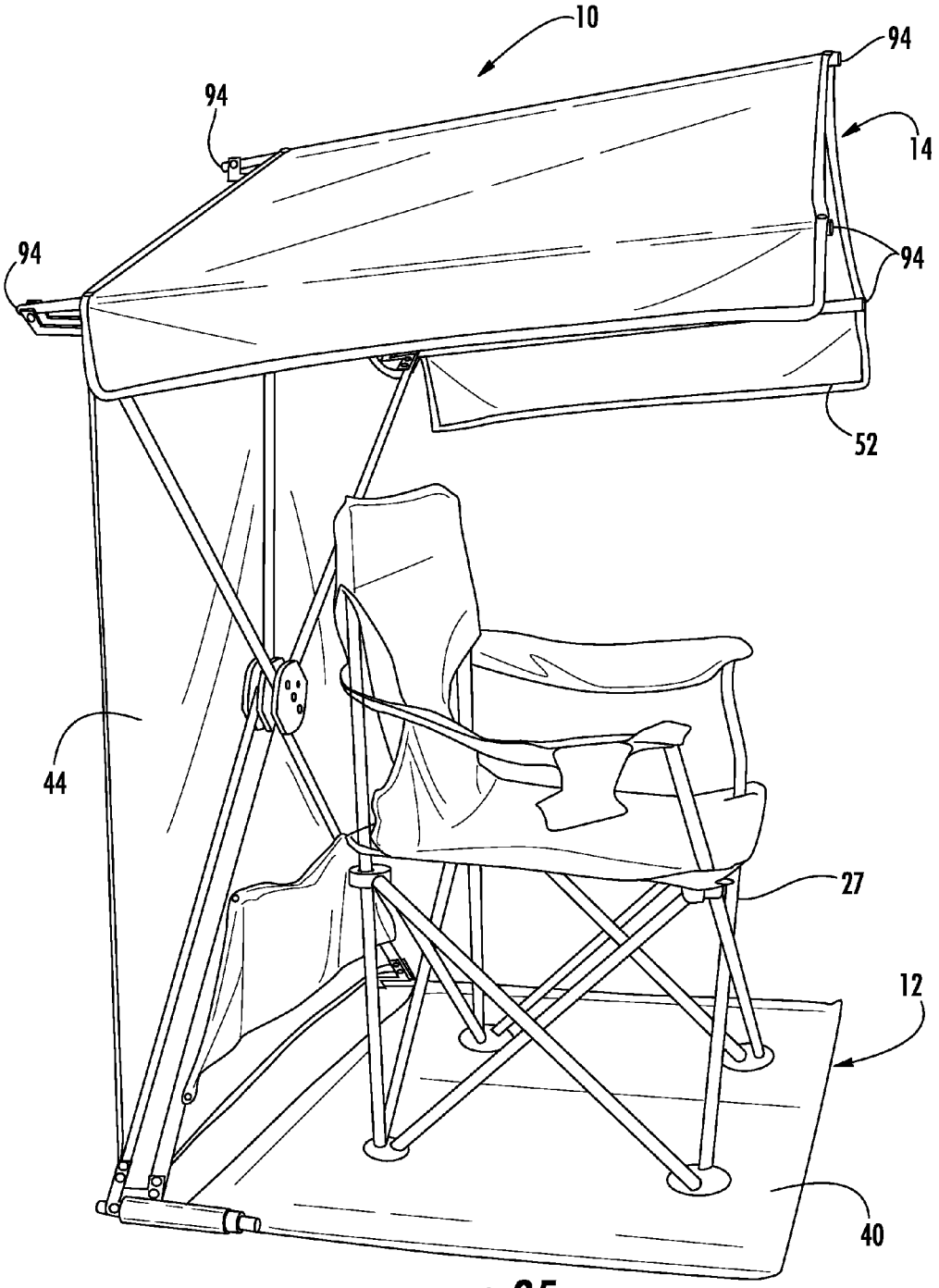
Figure 95:
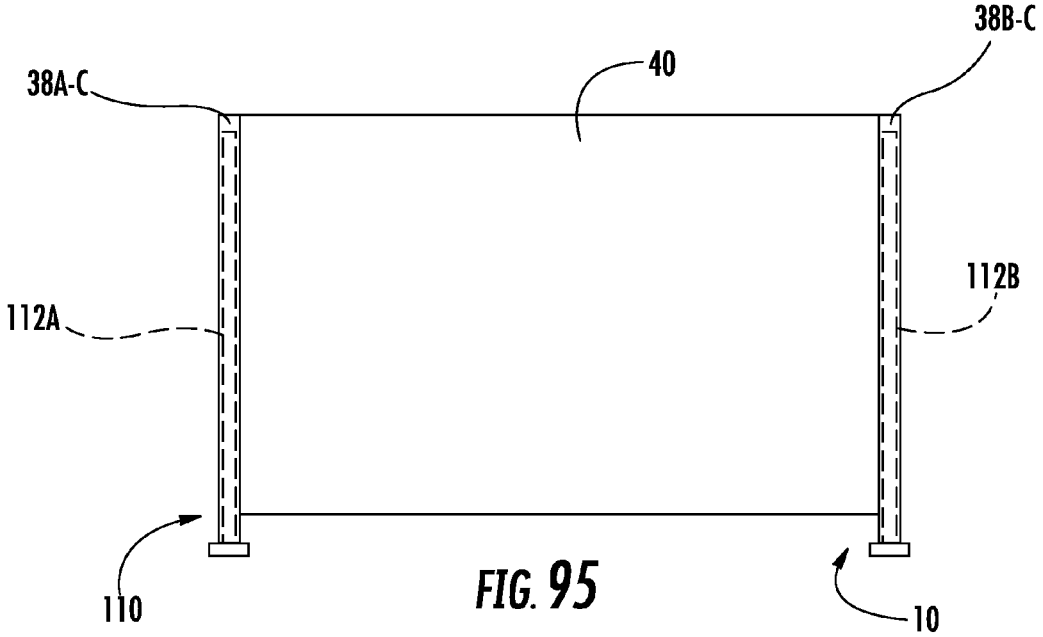
FIG. 95 is a plan view of the flooring of the portable barrier of FIG. 1, with the portable barrier positioned in its protection mode of operation, and with the various components of the portable barrier removed for clarity of description, and with the flooring possessing an alternative auxiliary support mechanism, and with the alternative auxiliary support mechanism shown in its stowed state.
Figure 96:
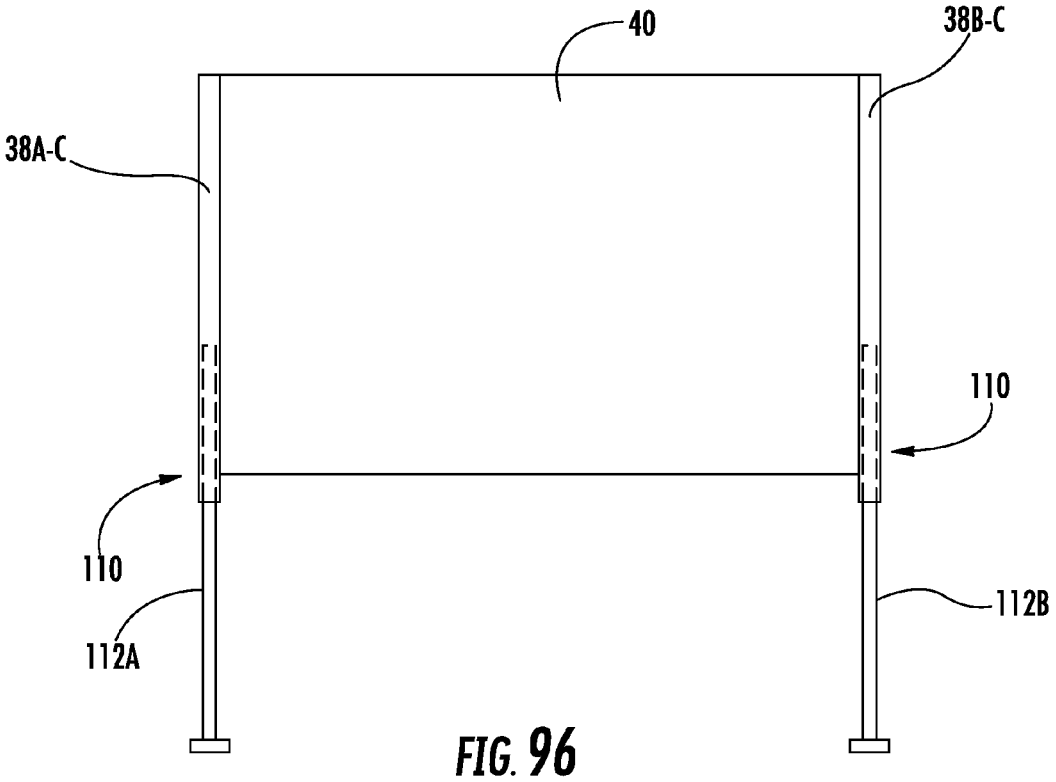
FIG. 96 is a view similar to FIG. 95, but showing the alternative auxiliary support mechanism shown in its stabilizing or use state.

Another feature of the portable barrier 10 that further stabilizes the portable barrier on the ground or horizontal surface HS is shown in FIGS. 8, 82 and 95-96. In particular, an auxiliary support mechanism 110 includes a pair of support rods 112A, 112B respectively telescopingly received within the cantilevered portions 38A-C, 38B-C. In particular, the auxiliary support mechanism 110 includes support rods 112A, 112B that are respectively slidably received in the within the cantilevered portions 38A-C, 38B-C as shown in FIGS. 95-96. FIGS. 8 and 95 show the support rods positioned in their stowed position, while FIGS. 82 and 96 show the support rods 112A, 112B positioned in their use or stabilizing position.

Figure 45:
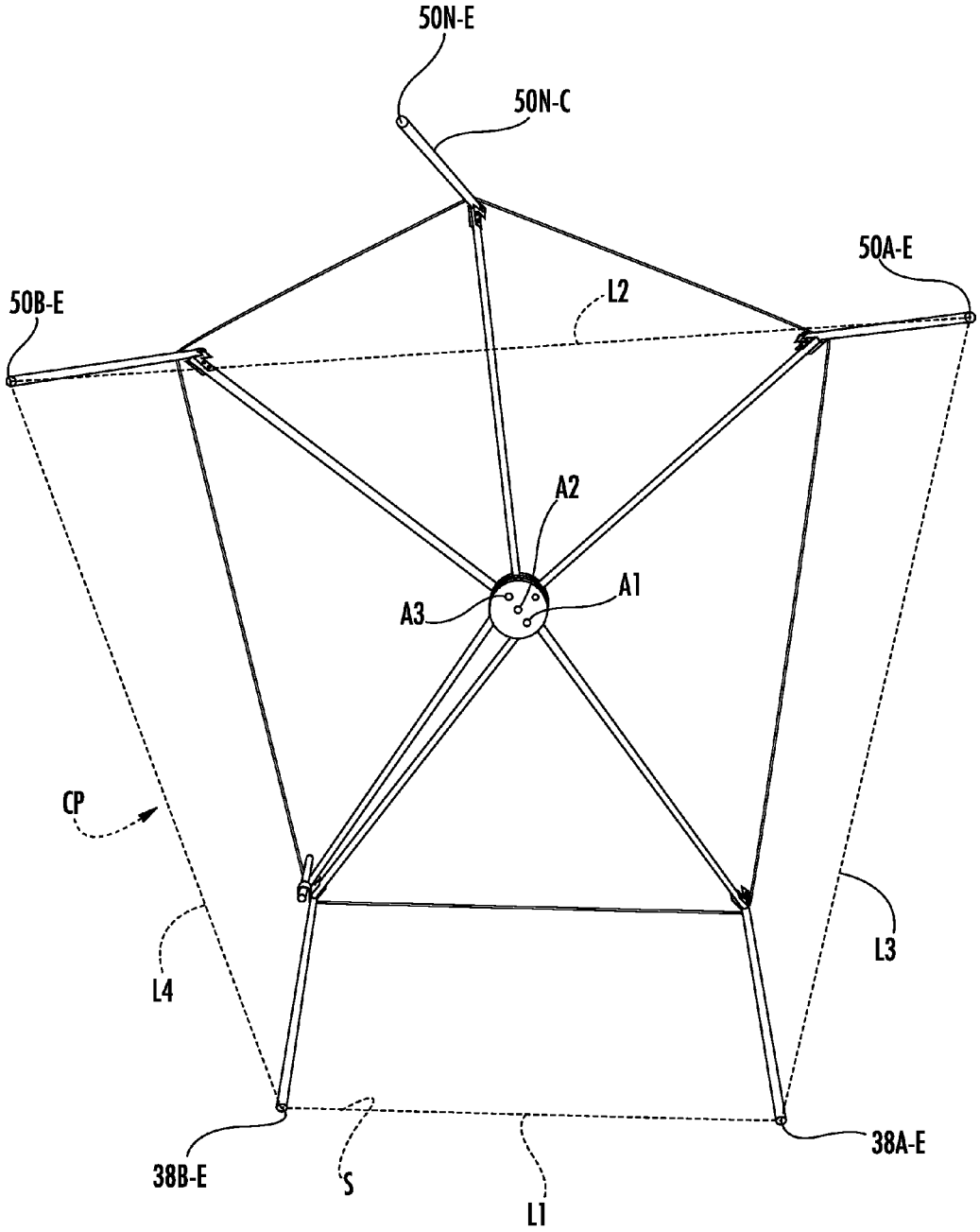

Further Discussion of FIGS. 2 and 45

As discussed above, the portable barrier 10 is configured to move between a protection mode (see FIGS. 2 and 45) and a storage mode (see FIGS. 13 and 30). When the portable barrier is positioned in the protection mode, (i) a first line L1 is defined between the unsupported end 38A-E and the unsupported end 38B-E, (ii) a second line L2 is defined between the unsupported end 50A-E and the unsupported end 50B-E, (iii) a third line L3 is defined between the unsupported end 38A-E and the unsupported end 50A-E, and (iv) a fourth line L4 is defined between the unsupported end 38B-E and the unsupported end 50B-E. The first line L1, the second line L2, the third line L3, and the fourth line L4 define a closed path CP. One of the first leg 38A, the second leg 38B, the first arm 50A, and the second arm 50B, and the supplemental component 51 pivots about a pivot axis during movement of the portable barrier between the protection mode and the storage mode. Indeed, for at least some duration of the movement between the portable barrier 10 between its protection mode and storage mode, (i) each of the leg 38A and the leg 38B pivots about the axis A1, (ii) the arm 50B pivots about the axis A3, (iii) the intermediate arm 50N pivots about the axis A2, and (iv) the supplemental component 51 pivots about the axis A3. Further, it should be appreciated that for at least some duration during movement of the portable barrier 10 from its protection mode (see FIG. 1) to its storage mode (see FIG. 13), all the arms 50A, 50B, 50N, and the supplemental component 51 pivot simultaneously about the line defined by the axis A1, as the plates 17A, 17B, 17C pivot about the line defined by the axis A1. Note that (i) the axis A1 defines a line that intersects the space S enclosed by the closed path CP without intersecting the closed path CP, (ii) the axis A2 defines a line that intersects the space S enclosed by the closed path CP without intersecting the closed path CP, and (iii) the axis A3 defines a line that also intersects the space S enclosed by the closed path CP without intersecting the closed path CP as shown in FIGS. 2 and 45.

Further Discussion of FIGS. 4, 42, 44, and 83

Turning now to FIGS. 4, 42, 44, and 83, it should be appreciated that (i) the cantilevered portion 38A-C is configured to pivot with respect to the strut portion 38A-S at least X degrees, (ii) the cantilevered portion 38B-C is configured to pivot with respect to the strut portion 38B-S at least X degrees, (iii) the cantilevered portion 50A-C is configured to pivot with respect to the strut portion 50A-S at least X degrees, (iv) the cantilevered portion 50B-C is configured to pivot with respect to the strut portion 50B-S at least X degrees, and (v), the cantilevered portion 50N-C is configured to pivot with respect to the strut portion 50N-S at least X degrees, and (vi) X>200, and preferable X>260. Further note that most preferably (i) the cantilevered portion 38A-C is configured to pivot 272 degrees with respect to said strut portion strut portion 38A-S, (ii) the cantilevered portion 38B-C is configured to pivot 272 degrees with respect to said strut portion 38B-S, (iii) the cantilevered portion 50A-C is configured to pivot 268 degrees with respect to the strut portion 50A-S, (iv) the cantilevered portion 50B-C is configured to pivot 268 degrees with respect to the strut portion 50B-S, and (v) the cantilevered portion 50N-C is configured to pivot 268 degrees with respect to the strut portion 50N-S.

Thus, when the portable barrier is positioned in the protection mode as shown in FIGS. 4, 42, 44, and 48, the (i) the cantilevered portion 38A-C defines an angle of 88 degrees with respect to said strut portion strut portion 38A-S, (ii) the cantilevered portion 38B-C defines an angle Θ2 of 88 degrees with respect to said strut portion 38B-S, (iii) the cantilevered portion 50A-C defines an angle Θ3 of 92 degrees with respect to the strut portion 50A-S, (iv) the cantilevered portion 50B-C defines an angle Θ4 of 92 degrees with respect to the strut portion 50B-S; and (v) the cantilevered portion 50N-C defines an angle Θ5 of 92 degrees with respect to the strut portion 50N-S.

This feature of the portable barrier 10 further assists in stabilizing the portable barrier on the horizontal surface HS. Indeed, this feature causes the center of gravity of the portable barrier 10 to be moved closer to the middle of the flooring 40 when the portable barrier is viewed in a side elevational view.

Further Discussion of FIGS. 6, 7, 65, 66, 81, 88, 89

Turning now to FIGS. 6, 7, 65, 66, 81, 88, 89, it should be appreciated that when the portable barrier is positioned in the protection mode, (i) the back screen 44 is entirely spaced apart from the cover 52 so that an air vent 120 is formed between the back screen 44 and the cover 52, and (ii) the back screen 44 is also entirely spaced apart from the flooring 40 so that another air vent 122 is formed between the back screen 44 and the flooring 40.

This feature of the portable barrier 10 further assists in stabilizing the portable barrier on the horizontal surface HS. Significantly, this feature allows air flow during a windy day to be directed through the air vents 120, 122 so as to inhibit tipping of the portable barrier during windy days.

Additional Set of Concepts

Concept 1. A portable barrier, comprising:

a junction assembly;

a pedestal assembly including a plurality of legs that are movable with respect to each other, said plurality of legs includes a first leg and a second leg;

a cover assembly including (i) a plurality of arms that are movable with respect to each other, said plurality of arms includes a first arm and a second arm, and (ii) a covering connected to said first arm and said second arm;

a supplemental component movable with respect to said second arm; and a back screen including (i) a first back screen portion extending between said first arm and said first leg, said first back screen portion being configured to limit movement of said first arm and said first leg away from each other, and (ii) a second back screen portion extending between said second arm and said supplemental component, said second back screen portion being configured to limit movement of said second arm and said supplemental component away from each other, wherein said portable barrier is configured to move between a protection mode and a storage mode, and wherein, when said portable barrier is positioned in said protection mode, said back screen is entirely spaced apart from said cover so that a first air vent is formed between said back screen and said cover.

Concept 2. The portable barrier of Concept 1, further comprising a flooring connected to said first leg and said second leg, wherein said back screen is entirely spaced apart from said flooring so that a second air vent is formed between said back screen and said flooring.

Concept 3. The portable barrier of Concept 1, wherein:

said first leg includes (i) a first strut portion extending from said junction assembly, and (ii) a first cantilevered portion pivotably coupled to said first strut portion, said first cantilevered portion terminates in a first unsupported end, said second leg includes (i) a second strut portion extending from said junction assembly, and (ii) a second cantilevered portion pivotably coupled to said second strut portion, said second cantilevered portion terminates in a second unsupported end, said first arm includes (i) a third strut portion extending from said junction assembly, and (ii) a third cantilevered portion pivotably coupled to said third strut portion, said third cantilevered portion terminates in a third unsupported end, said second arm includes (i) a fourth strut portion extending from said junction assembly, and (ii) a fourth cantilevered portion pivotably coupled to said fourth strut portion, said fourth cantilevered portion terminates in a fourth unsupported end, and said first back screen portion extends between said third strut portion and said first strut portion and is configured to limit movement of said third strut portion and said first strut portion away from each other.

Concept 4. The portable barrier of Concept 2, wherein:

said first leg includes (i) a first strut portion extending from said junction assembly, and (ii) a first cantilevered portion pivotably coupled to said first strut portion, said first cantilevered portion terminates in a first unsupported end, said second leg includes (i) a second strut portion extending from said junction assembly, and (ii) a second cantilevered portion pivotably coupled to said second strut portion, said second cantilevered portion terminates in a second unsupported end, said first arm includes (i) a third strut portion extending from said junction assembly, and (ii) a third cantilevered portion pivotably coupled to said third strut portion, said third cantilevered portion terminates in a third unsupported end, said second arm includes (i) a fourth strut portion extending from said junction assembly, and (ii) a fourth cantilevered portion pivotably coupled to said fourth strut portion, said fourth cantilevered portion terminates in a fourth unsupported end, said first back screen portion extends between said third strut portion and said first strut portion and is configured and arranged to limit movement of said third strut portion and said first strut portion away from each other, and said second back screen portion extends between said fourth strut portion and said second strut portion and is configured and arranged to limit movement of said fourth strut portion and said second strut portion away from each other.

Concept 5. The portable barrier of Concept 3, wherein:

wherein, when said portable barrier is positioned in said protection mode, (i) a first line is defined between said first unsupported end and said second unsupported end, (ii) a second line is defined between said third unsupported end and said fourth unsupported end, (iii) a third line is defined between said first unsupported end and said third unsupported end, and (iv) a fourth line is defined between said second unsupported end and said fourth unsupported end, wherein said first line, said second line, said third line, and said fourth line define a closed path, wherein one of said first leg, said second leg, said first arm, said second arm, and said supplemental component pivots about a first pivot axis during movement of said portable barrier between said protection mode and said storage mode, and wherein said first pivot axis defines a fifth line that intersects a space enclosed by said closed path without intersecting said closed path.

Concept 6. The portable barrier of Concept 4, wherein:

wherein, when said portable barrier is positioned in said protection mode, (i) a first line is defined between said first unsupported end and said second unsupported end, (ii) a second line is defined between said third unsupported end and said fourth unsupported end, (iii) a third line is defined between said first unsupported end and said third unsupported end, and (iv) a fourth line is defined between said second unsupported end and said fourth unsupported end, wherein said first line, said second line, said third line, and said fourth line define a closed path, wherein one of said first leg, said second leg, said first arm, said second arm, and said supplemental component pivots about a first pivot axis during movement of said portable barrier between said protection mode and said storage mode, and wherein said first pivot axis defines a fifth line that intersects a space enclosed by said closed path without intersecting said closed path.

Concept 7. The portable barrier of Concept 6, wherein:

at least one of said first leg and said second leg pivots about a second pivot axis during movement of said portable barrier between said protection mode and said storage mode, and said second pivot axis defines a sixth line that intersects said space enclosed by said closed path without intersecting said closed path.

Concept 8. The portable barrier of Concept 7, wherein said fifth line is offset from said sixth line.

Concept 9. The portable barrier of Concept 8, wherein:

said cover assembly further includes an intermediate arm, and said covering includes (i) a first cover portion extending between said first arm and said intermediate arm, and (ii) a second cover portion extending between said intermediate arm and said second arm.

Concept 10. The portable barrier of Concept 9, wherein an occupant space is defined between said flooring and said covering when said portable barrier is positioned in said protection mode.

Concept 11. The portable barrier of Concept 10, wherein:

said flooring includes a fabric flooring, said covering includes a fabric covering, and said occupant space is located between said fabric flooring and said fabric covering when said portable barrier is positioned in said protection mode.

There is a plurality of advantages arising from the various features of each of the embodiment(s) of the portable barrier and associated methods of use described herein. It will be noted that alternative embodiments of the portable barrier and its method of use may not include all of the features described yet still benefit from at least some of the advantages of such features. Those of ordinary skill in the art may readily devise their own implementations of the portable barrier and its method of use that incorporate one or more of the features of the portable barrier and its method of use and fall within the spirit of the inventions described herein.

What is claimed is:

1. A portable barrier configured to move between a protection mode and a storage mode, comprising:

a junction assembly;

a pedestal assembly including (i) a plurality of legs that are movable with respect to each other, said plurality of legs includes a first leg and a second leg, and (ii) a first limiter connected to said first leg and said second leg;

a cover assembly including (i) a plurality of arms that are movable with respect to each other, said plurality of arms includes a first arm and a second arm, and (ii) a covering connected to said first arm and said second arm;

a second limiter extending between said first arm and said first leg, a supplemental component being pivotably connected to said junction assembly, and movable with respect to both said second arm and said second leg; and a third limiter extending between said second arm and said supplemental component, wherein said first leg includes (i) a first strut portion extending from said junction assembly, (ii) a first extension portion pivotably coupled to said first strut portion, said first extension portion terminates in a first unsupported end, and (iii) a first hinge joint configured so as to cause said first extension portion to pivot with respect to said first strut portion via said first hinge joint during movement of the portable barrier between the protection mode and the storage mode, wherein said second leg includes (i) a second strut portion extending from said junction assembly, (ii) a second extension portion pivotably coupled to said second strut portion, said second extension portion terminates in a second unsupported end, and (iii) a second hinge joint configured so as to cause said second extension portion to pivot with respect to said second strut portion via said second hinge joint during movement of the portable barrier between the protection mode and the storage mode, wherein said first arm includes (i) a third strut portion extending from said junction assembly, (ii) a third extension portion pivotably coupled to said third strut portion, said third extension portion terminates in a third unsupported end, and (iii) a third hinge joint configured so as to cause said third extension portion to pivot with respect to said third strut portion via said third hinge joint during movement of the portable barrier between the protection mode and the storage mode, wherein said second arm includes (i) a fourth strut portion extending from said junction assembly, (ii) a fourth extension portion pivotably coupled to said fourth strut portion, said fourth extension portion terminates in a fourth unsupported end, and (iii) a fourth hinge joint configured so as to cause said fourth extension portion to pivot with respect to said fourth strut portion via said fourth hinge joint during movement of the portable barrier between the protection mode and the storage mode, wherein said first hinge joint is further configured to position a first distal end of said first strut portion between said first extension portion and said junction assembly so that so that said first strut portion and said first hinge joint are supported by said first extension portion when the portable barrier is positioned in the protection mode and the portable barrier is supported on a substantially horizontal surface, wherein said second hinge joint is further configured to position a second distal end of said second strut portion between said second extension portion and said junction assembly so that said second strut portion and said second hinge joint are supported by said second extension portion when the portable barrier is positioned in the protection mode and the portable barrier is supported on a substantially horizontal surface, wherein said third hinge joint is further configured to position a third distal end of said third strut portion between said third extension portion and said junction assembly so that said third extension portion is supported by said third strut portion and said third hinge joint when the portable barrier is positioned in the protection mode and the portable barrier is supported on a substantially horizontal surface, wherein said fourth hinge joint is further configured to position a fourth distal end of said fourth strut portion between said fourth extension portion and said junction assembly so that said fourth extension portion is supported by said fourth strut portion and said fourth hinge joint when the portable barrier is positioned in the protection mode and the portable barrier is supported on a substantially horizontal surface, and wherein said supplemental component extends substantially along side of and adjacent to said second strut portion of said second leg when the portable barrier is positioned in the protection mode.

2. The portable barrier of claim 1, wherein:

wherein, when said portable barrier is positioned in said protection mode, (i) a first line is defined between said first unsupported end and said second unsupported end, (ii) a second line is defined between said third unsupported end and said fourth unsupported end, (iii) a third line is defined between said first unsupported end and said third unsupported end, and (iv) a fourth line is defined between said second unsupported end and said fourth unsupported end, wherein said first line, said second line, said third line, and said fourth line define a closed path, wherein one of said first leg, said second leg, said first arm, said second arm, and said supplemental component pivots about a first pivot axis during movement of said portable barrier between said protection mode and said storage mode, and wherein said first pivot axis defines a fifth line that intersects a space enclosed by said closed path without intersecting said closed path.

3. The portable barrier of claim 2, wherein:

at least one of said first leg and said second leg pivots about a second pivot axis during movement of said portable barrier between said protection mode and said storage mode, and said second pivot axis defines a sixth line that intersects said space enclosed by said closed path without intersecting said closed path.

4. The portable barrier of claim 3, wherein said fifth line is offset from said sixth line.

5. The portable barrier of claim 1, wherein:

said supplemental component includes a fifth extension portion that terminates in a fifth unsupported end, and said fifth extension portion is configured as a handle.

6. The portable barrier of claim 5, wherein said handle lies adjacent to and extends along said second extension portion when said portable barrier is positioned in said protection mode.

7. The portable barrier of claim 1, wherein:

said cover assembly further includes an intermediate arm, and said covering includes (i) a first cover portion extending between said first arm and said intermediate arm, and (ii) a second cover portion extending between said intermediate arm and said second arm.

8. The portable barrier of claim 1, wherein said first limiter includes a flooring located between said first leg and said second leg when said portable barrier is positioned in said protection mode.

9. The portable barrier of claim 8, wherein an occupant space is defined between said flooring and said covering when said portable barrier is positioned in said protection mode.

10. The portable barrier of claim 9, wherein:

said flooring includes a fabric flooring, said covering includes a fabric covering, and said occupant space is located between said fabric flooring and said fabric covering when said portable barrier is positioned in said protection mode.

11. The portable barrier of claim 1, wherein:

said first extension portion is configured to pivot with respect to said first strut portion at least X degrees, said second extension portion is configured to pivot with respect to said second strut portion at least X degrees, said third extension portion is configured to pivot with respect to said third strut portion at least X degrees, said fourth extension portion is configured to pivot with respect to said fourth strut portion at least X degrees, and X is greater than 200.

12. The portable barrier of claim 11, wherein:

X is greater than 260.

13. The portable barrier of claim 12, wherein:

said first extension portion is configured to pivot with respect to said first strut portion at least 272 degrees, said second extension portion is configured to pivot with respect to said second strut portion at least 272 degrees, said third extension portion is configured to pivot with respect to said third strut portion no more than 268 degrees, and said fourth extension portion is configured to pivot with respect to said fourth strut portion no more than 268 degrees.

14. The portable barrier of claim 1, wherein when the portable barrier is positioned in the protection mode and the portable barrier is supported on a substantially horizontal surface:

said first distal end of said first strut portion is supported on said first extension portion, said second distal end of said second strut portion is supported on said second extension portion, said third extension portion is supported on said third distal end of said third strut portion, and said fourth extension portion is supported on said fourth distal end of said fourth strut portion.

15. The portable barrier of claim 1, wherein when the portable barrier is positioned in the protection mode and the portable barrier is supported on a substantially horizontal surface:

said first distal end of said first strut portion is positioned in contact with said first extension portion, said second distal end of said second strut portion is positioned in contact with said second extension portion, said third extension portion is positioned in contact with said third distal end of said third strut portion, and said fourth extension portion is positioned in contact with said fourth distal end of said fourth strut portion.

* * * * *